US006597884B2

(12) United States Patent
Miyaguchi et al.

(10) Patent No.: US 6,597,884 B2
(45) Date of Patent: Jul. 22, 2003

(54) IMAGE FORMING APPARATUS INCLUDING ELECTROSTATIC CONVEYANCE OF CHARGED TONER

(75) Inventors: Yohichiroh Miyaguchi, Kanagawa (JP); Takeshi Takemoto, Kanagawa (JP); Hiroyuki Okamoto, Kanagawa (JP); Chikara Imai, Tokyo (JP); Katsuo Sakai, Kanagawa (JP); Nobuaki Kondou, Kanagawa (JP); Tsukuru Kai, Kanagawa (JP); Makoto Obu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/948,576

(22) Filed: Sep. 10, 2001

(65) Prior Publication Data

US 2002/0037182 A1 Mar. 28, 2002

(30) Foreign Application Priority Data

Sep. 8, 2000 (JP) ..... 2000-273506
Sep. 13, 2000 (JP) ..... 2000-277721

(51) Int. Cl.[7] ..... G03G 15/08
(52) U.S. Cl. ..... 399/266; 399/289; 399/290
(58) Field of Search ..... 399/135, 222, 399/252, 265, 266, 289, 290, 291; 347/55, 140

(56) References Cited

U.S. PATENT DOCUMENTS 4,279,498 A 7/1981 Eda et al.
4,558,941 A * 12/1985 Nosaki et al. ..... 399/266
4,568,955 A * 2/1986 Hosoya et al. ..... 347/55
4,598,991 A * 7/1986 Hosoya et al. ..... 399/266
4,696,255 A 9/1987 Yano et al.
4,760,422 A 7/1988 Seimiya et al.
4,930,438 A 6/1990 Demizu et al.
4,975,748 A 12/1990 Koinuma et al.
5,079,591 A 1/1992 Tomita et al.
5,109,254 A 4/1992 Oka et al.
5,172,169 A 12/1992 Takashima et al.
5,220,383 A 6/1993 Enoki et al.
5,227,842 A 7/1993 Hayashi et al.
5,239,344 A 8/1993 Enoki et al.
5,245,391 A 9/1993 Suzuki et al.
5,286,918 A 2/1994 Iwata et al.
5,311,263 A 5/1994 Suzuki et al.
5,327,199 A 7/1994 Sekine
5,339,141 A 8/1994 Suzuki et al.
5,389,733 A 2/1995 Enoki et al.
5,394,231 A 2/1995 Sudo et al.
5,416,568 A 5/1995 Yoshiki et al.
5,424,814 A 6/1995 Suzuki et al.
5,450,177 A 9/1995 Oyama
5,451,713 A 9/1995 Suzuki et al.
5,474,869 A 12/1995 Tomita et al.
5,508,794 A 4/1996 Ikesue et al.
5,565,973 A 10/1996 Fujishiro et al.
5,598,254 A 1/1997 Ikesue et al.
5,627,630 A 5/1997 Matsumae et al.
5,655,193 A 8/1997 Fujishiro et al.
5,659,860 A 8/1997 Sasaki et al.

(List continued on next page.)

*Primary Examiner*—Sandra Brase
(74) *Attorney, Agent, or Firm*—Oblon, Spivak, McClelland Maier & Neustadt, P.C.

(57) ABSTRACT

An electrophotographic image forming apparatus of the present invention deposits charged toner on a latent image formed on a photoconductive drum or similar image carrier to thereby produce a corresponding toner image. The apparatus includes a toner flying device for electrostatically conveying the toner along the conveying surface of a conveyance board to one end of the conveyance board. The toner is caused to fly toward the image carrier from the end of the conveyance board.

59 Claims, 38 Drawing Sheets

U.S. PATENT DOCUMENTS 5,674,408 A 10/1997 Suzuki et al.
5,741,616 A 4/1998 Hirano et al.
5,761,591 A * 6/1998 Yamaguchi ..... 399/289
5,771,426 A 6/1998 Oka et al.
5,774,772 A 6/1998 Kai et al.
5,805,965 A 9/1998 Tsuda et al.
5,819,145 A 10/1998 Tanaka et al.
5,822,664 A 10/1998 Oka et al.
5,848,327 A * 12/1998 Badesha et al. ..... 399/266 X
5,864,733 A 1/1999 Mae et al.
5,915,155 A 6/1999 Shoji et al.
5,955,228 A 9/1999 Sakai et al.
6,070,036 A * 5/2000 Thompson et al. ..... 399/266
6,081,684 A 6/2000 Naganuma et al.
6,125,243 A 9/2000 Shoji et al.
6,160,979 A 12/2000 Shoji
6,163,669 A 12/2000 Aoki et al.
6,175,707 B1 * 1/2001 Eklund et al. ..... 399/265
6,295,437 B1 9/2001 Hodoshima et al.
6,366,751 B1 4/2002 Shakuto et al.
6,385,423 B1 5/2002 Kai
6,442,364 B2 8/2002 Kai et al.
6,449,452 B1 9/2002 Kai
6,456,806 B2 9/2002 Shoji et al.
6,507,720 B2 1/2003 Kabumoto et al.

* cited by examiner

1 PERIOD

| TIME \ ELECTRODE | a | b | c |
|---|---|---|---|
| 1 | + | − | 0 |
| 2 | 0 | + | − |
| 3 | − | 0 | + |
| 4 | + | − | 0 |

1 PERIO

| TIME \ ELECTRODE | a | b | c |
|---|---|---|---|
| 1 | + | + | − |
| 2 | − | + | + |
| 3 | + | − | + |
| 4 | + | + | − |

1 PERIO

| TIME \ ELECTRODE | a | b | c | d | e | f |
|---|---|---|---|---|---|---|
| 1 | + | + | 0 | − | − | 0 |
| 2 | 0 | + | + | 0 | − | − |
| 3 | − | 0 | + | + | 0 | − |
| 4 | − | − | 0 | + | + | 0 |
| 5 | 0 | − | − | 0 | + | + |
| 6 | + | 0 | − | − | 0 | + |
| 7 | + | + | 0 | − | − | 0 |

| TIME \ ELECTRODE | a | b | c |
|---|---|---|---|
| 1 | − | + | + |
| 2 | + | + | − |
| 3 | + | − | + |
| 4 | − | + | + |

1 PERIOD

| TIME \ ELECTRODE | a | b | c |
|---|---|---|---|
| 1 | − | + | 0 |
| 2 | 0 | − | + |
| 3 | + | 0 | − |
| 4 | − | + | 0 |

1 PERIOD

| TIME \ ELECTRODE | a | b | c |
|---|---|---|---|
| 1 | − | − | + |
| 2 | + | − | − |
| 3 | − | + | − |
| 4 | − | − | + |

1 PERIOD

| TIME \ ELECTRODE | a | b | c |
|---|---|---|---|
| 1 | + | − | 0 |
| 2 | 0 | + | − |
| 3 | − | 0 | + |
| 4 | + | − | 0 |

1 PERIOD

| TIME \ ELECTRODE | a | b | c |
|---|---|---|---|
| 1 | + | + | − |
| 2 | − | + | + |
| 3 | + | − | + |
| 4 | + | + | − |

DRIVER
DRIVER
93
93
31
30
30
98
98
91
91
92
92
Vc3
Vb3
Va3
Vc2
Vb2
Va2
Vc1
Vb1
Va1
Va3
Vb3
Vc3
Va2
Vb2
Vc2
Va1
Vb1
Vc1
96
96
T
1

IMAGE FORMING APPARATUS INCLUDING ELECTROSTATIC CONVEYANCE OF CHARGED TONER

BACKGROUND OF THE INVENTION

1. Field of the Invention

The present invention relates to an image forming apparatus for depositing toner, or developer, on a latent image formed on a photoconductive drum or similar image carrier to thereby form a corresponding toner image and transferring the toner image to a paper sheet or similar recording medium.

2. Description of the Background Art

An image forming apparatus includes a developing device for developing a latent image formed on an image carrier. It is a common practice with a developing device to deposit toner agitated in the apparatus on a developing roller or developer carrier. The developing roller is rotated to convey the toner to a position where the roller faces the image carrier, so that the toner is transferred to a latent image formed on the image carrier to thereby develop the latent image. The toner left on the developing roller after development is collected in the apparatus due to the rotation of the developing roller. Fresh toner is charged by agitation and again deposited on the developing roller.

Japanese Patent Laid-Open Publication No. 5-19615 discloses another type of developing device in which toner is electrostically conveyed on the surface of a developing roller and then transferred to the surface of an image carrier by attraction, which acts between the developing roller and the image carrier. Japanese Patent Laid-Open Publication No. 59-181375, for example, proposes a developing device including a conveyance board for electrostatically conveying toner to a position where the board faces an image carrier. The toner is then separated from the conveying surface of the conveyance board by attraction acting between the board and an image carrier and transferred to the image carrier.

Further, Japanese Patent Laid-Open Publication Nos. 11-170591, 11-115235 and 11-179951, for example, each teach an image forming apparatus of the type causing toner to fly from a developing roller to a recording medium. This type of apparatus includes control electrodes arranged between a developing roller and a recording medium and counter electrodes located at the rear of the recording medium. Electric fields are generated between the developing roller and the counter electrodes, so that toner can fly toward the recording medium. The control electrodes selectively control the flight of the toner to thereby form an image on the recording medium.

The image forming apparatus of the type transferring toner from the developing roller to the image carrier or causing toner to fly by controlling the electric fields has the following problem. The developing roller essential with such a type of image forming apparatus increases the overall size and cost of the apparatus. Further, the problem with the developing device using the developing roller is that toner enters a gap between the roller and side walls and coheres due to friction, degrading image quality. With the developing device of the type electrostatically conveying toner, it is impracticable to surely convey the toner.

When toner is charged by friction or corona discharge, toner particles reached saturation charge and toner particles not reached it exist together, resulting in a broad charge distribution. Assume that such toner is forcibly transferred to an image carrier by, e.g., a magnet brush or a transfer roller. Then, the toner particles with low charge and deposited on the image carrier are apt to leave the it due to the developing speed of the state-of-the-art developing roller, i.e., about 100 cm/sec in terms of linear velocity. The toner particles left the image carrier fly about or deposit on the background of an image.

Moreover, the particle size of toner for development or image formation should preferably be uniform as far as possible. The conventional image forming apparatuses or developing devices thereof feed toner particles sized less than 5 $\mu$m to a developing roller together with the other toner particles. Let toner particles, or powder, sized less than 5 m be referred to as extremely fine toner particles hereinafter.

SUMMARY OF THE INVENTION

It is an object of the present invention to provide an image forming apparatus and a developing device that are simple in construction, low cost, and high in image quality.

It is another object of the present invention to provide a powder jetting device feasible for the developing device.

It is still another object of the present invention to provide a toner feeding device capable of uniforming the particle size of toner to be fed to a developing device to thereby enhance image quality.

It is yet another object of the present invention to provide a toner conveying device for conveying toner to an image carrier or a recording medium.

It is a further object of the present invention to provide a classifying device for classifying powder.

In accordance with the present invention, an image forming apparatus includes an image carrier for forming a latent image thereon, and a developing device for developing the latent image with charged toner to thereby form a corresponding toner image. The developing device electrostatically conveys the charged toner toward one end of a conveyance board along the conveying surface of the board and causes it to fly toward the image carrier from the one end.

Also, in accordance with the present invention, in a toner conveying device for electrostatically conveying toner, a conveyance board includes a first and a second board stacked on each other. The first board includes a substrate and a plurality of substantially parallel electrodes arranged at a preselected distance in the direction of toner conveyance and each extending in the direction crossing the above direction. The second board includes an insulative substrate and a surface layer formed on the surface of the insulative substrate and having low contact resistance with respect to the toner. The surface layer forms a conveying surface.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Figure 1:
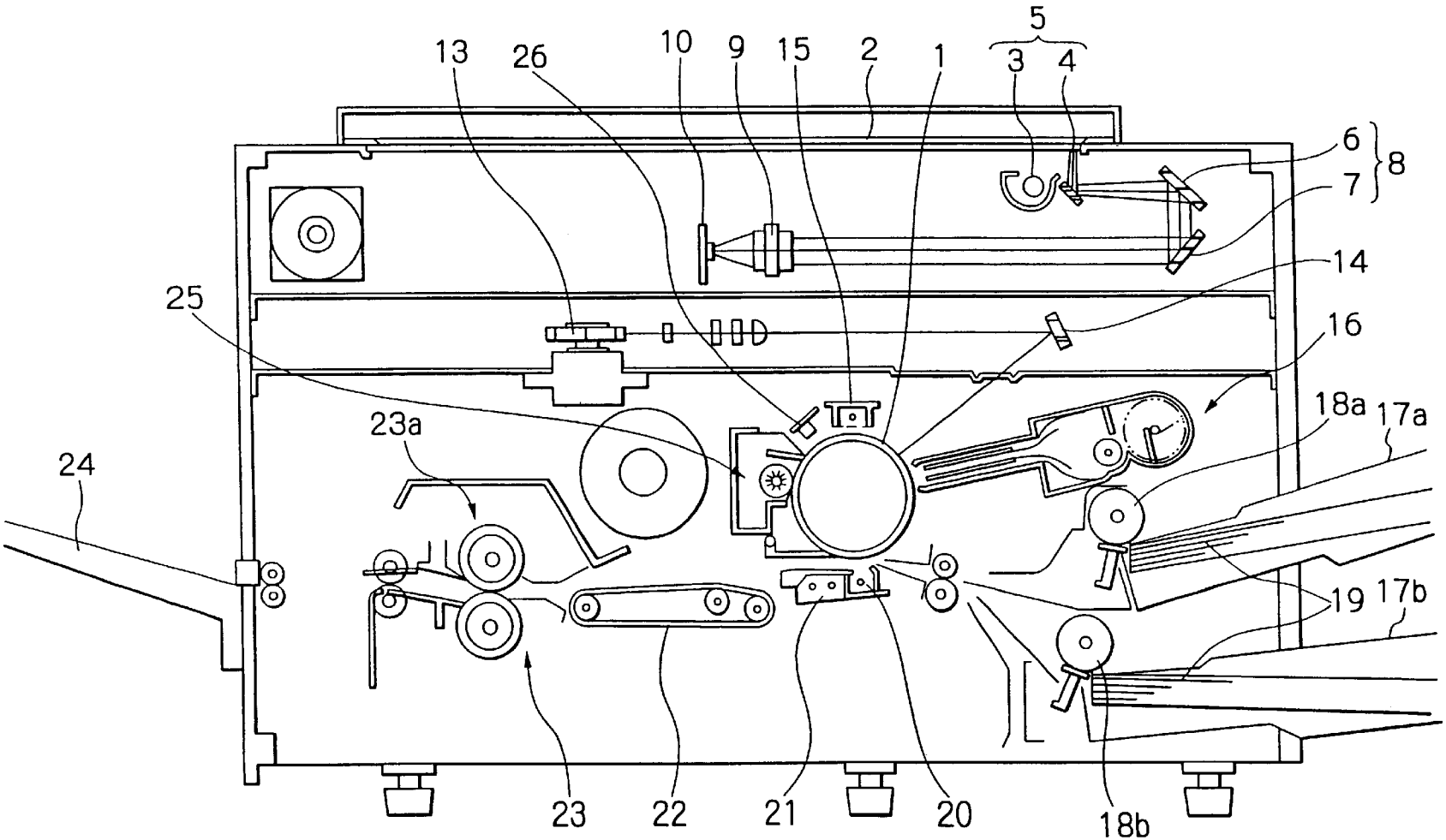
FIG. 1 is a view showing the general construction of an image forming apparatus with which preferred embodiments of the present invention are practicable.

Referring to FIG. 1 of the drawings, an image forming apparatus embodying the present invention is shown. It is to be noted that other embodiments to be described later are also practicable with the construction shown in FIG. 1. As shown, the image forming apparatus includes a photoconductive drum or image carrier 1. The drum 1 is implemented by OPC (Organic PhotoConductor) by way of example and rotatable clockwise, as viewed in FIG. 1. When the operator of the apparatus lays a document on a glass platen 2 and then pushes a print start switch, not shown, optics 5 including a light source 3 and a mirror 4 and optics 8 including mirrors 6 and 7 move while scanning the document.

An imagewise reflection from the document is incident to an image sensor 10 located at the rear of the lens 9. The image sensor 10 outputs an image signal corresponding to the incident reflection. The image signal is digitized and then subjected to image processing. A laser diode emits a laser beam in accordance with the image signal. A polygonal mirror 13 steers the laser beam toward the drum 1, which is uniformly charged beforehand, via a mirror 14. The laser beam forms a latent image on the charged surface of the drum 1.

A developing device 16 develops the latent image formed on the drum 1 with toner to thereby produce a corresponding toner image. A paper sheet or similar recording medium is fed from a sheet feed section 17*a* or 17*b* toward the drum 1. A corona charger 20 transfers the toner image from the drum 1 to the paper sheet by corona discharge. A separation charger 21 separates the paper sheet with the toner image from the drum 1. A belt conveyor 22 conveys the paper sheet separated from the drum 1 to a fixing device 23. The fixing device 23 fixes the toner image on the paper sheet with a pair of rollers 23. The paper sheet coming out of the fixing device 23 is driven out of the apparatus to a tray 24.

A drum cleaner 25 removes the toner left on the drum 1 after the image transfer. Subsequently, a discharge lamp 26 dissipates charge left on the surface of the drum 1.

Figure 2:
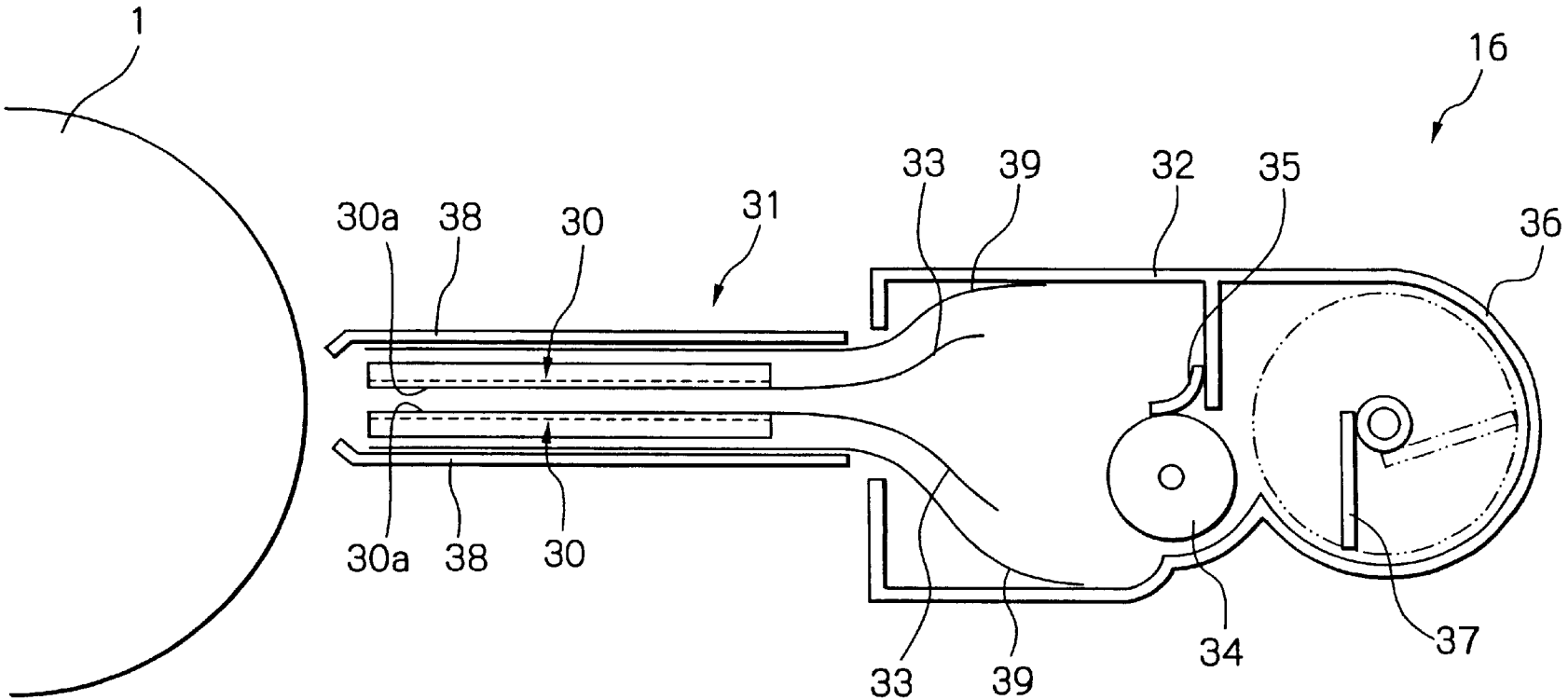
FIG. 2 is a view showing a developing device included in the apparatus of FIG. 1.

The developing device or developing means 16, which characterizes the illustrative embodiment, will be described in detail with reference to FIG. 2. As shown, the developing device 16 includes a toner flying device 31 for electrostatically conveying charged toner toward one end or outlet along the conveying surfaces of conveyance boards 30. The toner reached the outlet flies toward the drum 1. The toner flying device 31 is representative of a powder jetting device of the present invention.

More specifically, path members 33 deliver charged toner from a toner box 32 to a path between the conveyance boards 30. A charge roller 34 charges the toner to be fed into the toner box 32. A doctor blade 35 is held in contact with the circumference of the charge roller 34. An agitator 37 conveys the toner stored in a toner hopper 36 toward the charge roller 34. Gutters or collecting means 38 collect part of the toner flown out of the toner flying device 31, but not used for development. Return members 39 electrostatically return the toner collected by the gutters 38 to the toner box 32. The conveyance boards 30 each have a respective conveying surface 30*a*.

Figure 3:
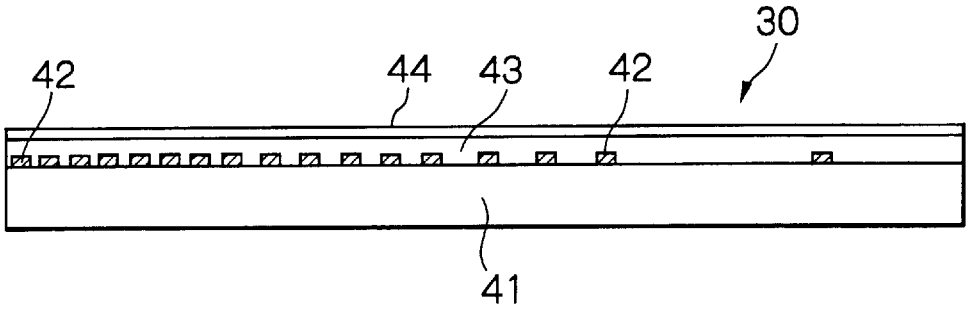
FIG. 3 is a section showing a conveyance board included in a toner flying device representative of a first embodiment of the present invention.
Figure 4:
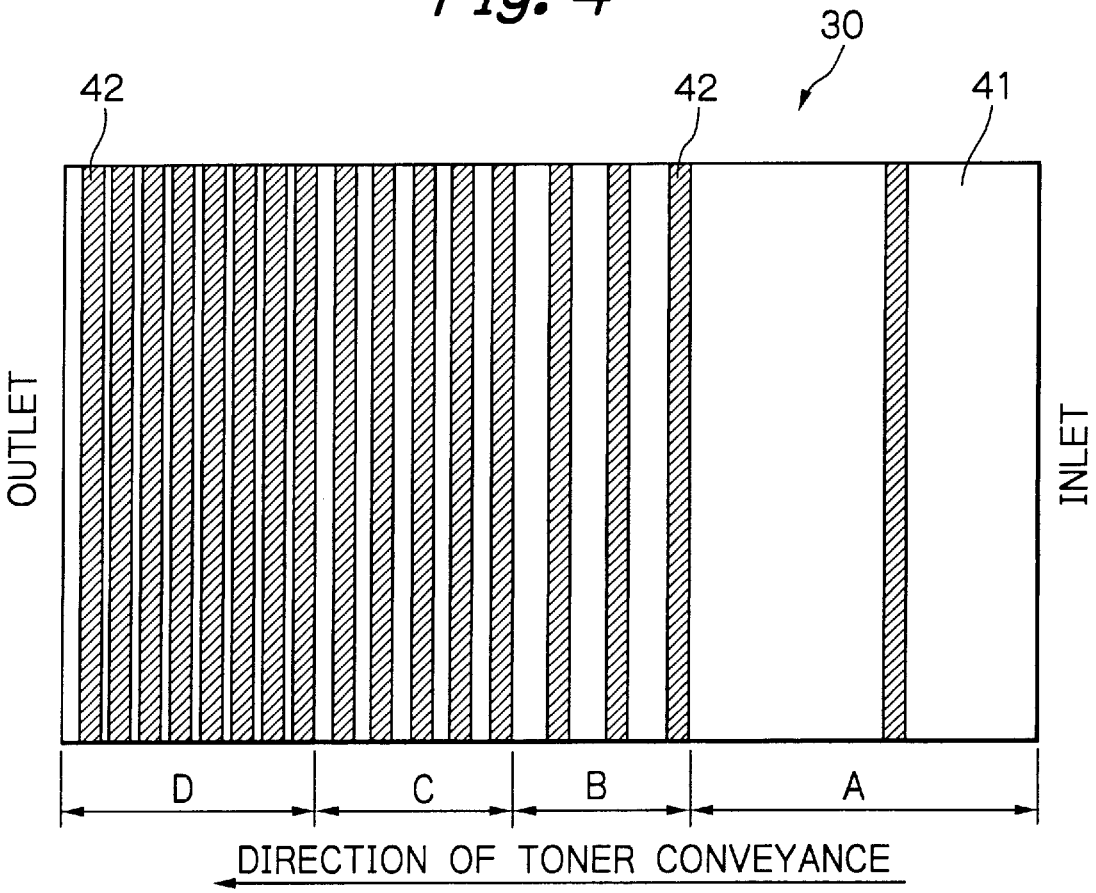
FIG. 4 is a plan view of the conveyance board.

Reference will be made to FIGS. 3 and 4 for describing the conveyance boards 30 specifically. As shown, each conveyance board 30 includes an elongate, flat substrate 41 on which a number of electrodes 42 are arranged. The electrodes 42, each three of which make a set, extend in the direction perpendicular to the direction in which the toner is conveyed (direction of toner conveyance hereinafter). A member 43 for forming a conveying surface is stacked on the electrodes 42. A coating layer or film 44 is formed the surface of the member 43 in order to reduce contact resistance between the member 43 and the toner. With this configuration, the conveyance board 30 conveys the toner along its conveying surface while accelerating it with an electrostatic force.

The substrate 41 may be formed of glass, resin, ceramics or similar insulating material or SUS or similar conductive material coated with $SiO_2$ (silicon dioxide) or similar insulating film. In the illustrative embodiment, the substrate 41 is formed of glass and 0.9 mm to 1.1 mm thick.

To form the electrodes 42, a film of Al (aluminum), Ni—Cr (nickel-chromium) or similar conductive material is formed on the substrate 41 and then patterned by photolithography or similar semiconductor technology. The electrodes 42 should preferably be arranged in density that is one-third to 100 times, particularly one-half to five times, as great as the particle size of toner in terms of lines per space (L/S). This makes toner conveyance desirable in speed and amount. Each electrode 42 should preferably have a width that is one time to three times as great as the particle size of toner in order to guarantee desirable toner conveyance.

In light of the above, as shown in FIG. 4, the density of the electrodes 42 is sequentially increased stepwise in the direction of toner conveyance. For example, assume consecutive zones A, B, C and D beginning at the toner inlet and ending at the toner outlet. Then, the electrodes 42 are arranged at intervals of 100 $\mu$m in the zone A, at intervals of 20 $\mu$m in the zone B, at intervals of 10 $\mu$m in the zone C, and at intervals of 5 $\mu$m in the zone D. Assuming that the mean particle size of toner is 8 $\mu$m, the illustrative embodiment provides each electrode 42 with a width of 10 $\mu$m.

The member 43 for forming the conveying surface is implemented as an insulating film having a specific inductive capacity, e.g., $SiO_2$ or $Ta_2O_5$ (tantalum pentoxide) and 0.5 $\mu$m to 1 $\mu$m thick. $Ta_2O_3$ has a specific inductive capacity of 28. Alternatively, use may be made of a film of polyimide whose specific inductive capacity is about 3.6. The apparent, specific inductive capacity of polyimide can be increased to 10 to 12 if about 1% of fine $BaTiO_3$ (barium metasilicate) is added in the event of coating.

By increasing the specific inductive capacity of the member 43, it is possible to lower required drive voltage and to promote the bounce of the toner particles and conveying speed. Therefore, to surely convey the charged toner by low voltage at a speed that allows the toner to fly, the member 43 should preferably be formed of a material whose specific inductive capacity is 10 or above. It was experimentally found that a 1 $\mu$m thick polyimide film required a drive voltage of DC 500 V, but derived an acceptable result with a drive voltage of 300 V when about 1% of fine $BaTiO_3$ particles were added.

The coating layer 44, which reduces contact resistance between the conveying surface and the charged toner, may be formed of PTFE (polytetrafluoroehtylene), PFA (perfluoroalcoxy alkane) or similar fluorine-containing resin and 0.1 $\mu$m to 0.3 $\mu$m thick.

Even a single conveyance board 30 suffices for conveying the charged toner. In the illustrative embodiment, two conveyance boards 30 are positioned with their conveying surfaces 30*a*, FIG. 2, facing each other. The conveyance boards 30 are spaced from each other by 30 $\mu$m to 200 $\mu$m. A plurality of conveyance boards 30 increase the amount of toner to fly for a unit period of time. Further, the conveyance boards 30 can be selectively driven in order to control the amount of toner to fly.

Figure 5:
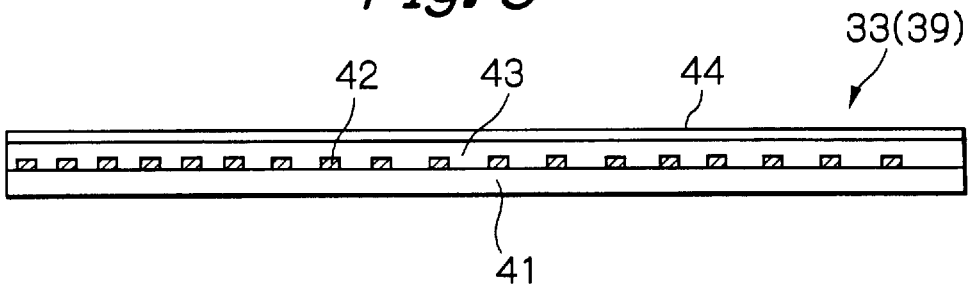
FIG. 5 is a section showing path members and return members included in the toner flying device.

The path members 33 and return members 39 will be described specifically with reference also made to FIG. 5. As shown, the path members 33 and return members 39 each are basically identical in configuration with the conveyance boards 30. Specifically, the path members 33 and return members 39 each include an insulative FPC substrate 48 on which a number of electrodes 42 are arranged; each three of the electrodes 42 make a set. The substrates 48 extend in the direction perpendicular to the direction of toner conveyance. A member 43 for forming a conveying surface is formed on the electrodes 42. A coating layer or film 44 is formed on the surface of the member 43 in order to reduce contact resistance between the member 43 and the toner. The electrodes 42 are positioned at substantially identical intervals on both of the members 33 and 39.

Figure 6:
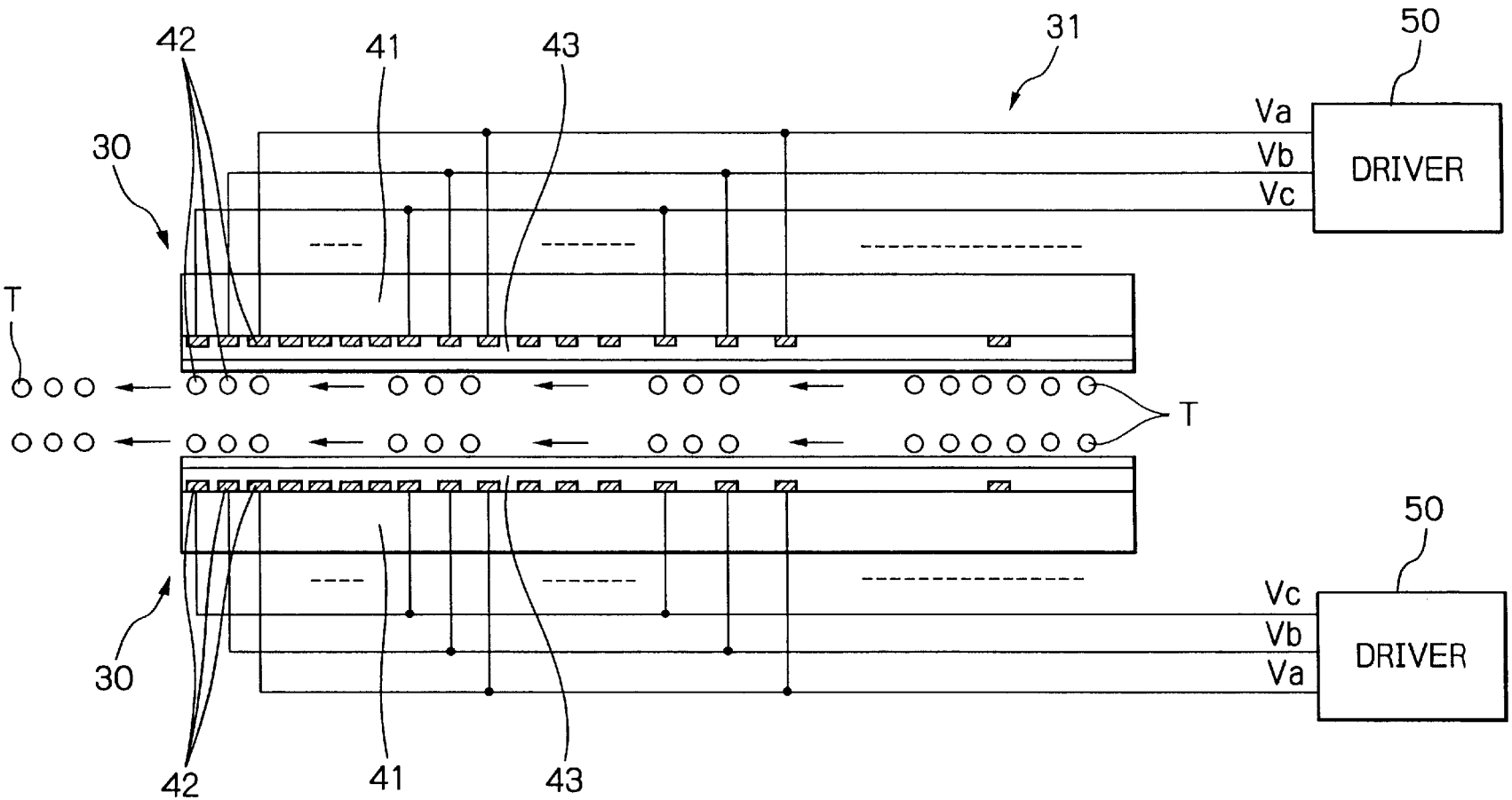
FIG. 6 is a schematic block diagram showing drive circuitry included in the toner flying device.

Referring to FIGS. 6 through 11, how the toner flying device 31 conveys the toner and causes it to fly will be described. As shown in FIG. 6, the toner flying device 31 includes two drivers 50 each for applying three-phase drive waveforms or voltages Va, Vb and Vc to each group of three electrodes 42 of one conveyance board 30. Some delay is provided between the drive waveforms Va, Vb and Vc output from each driver 50. The drive waveforms Va, Vb and Vc each selectively take a positive potential, a negative potential and zero potential (not applied).

Figure 7:
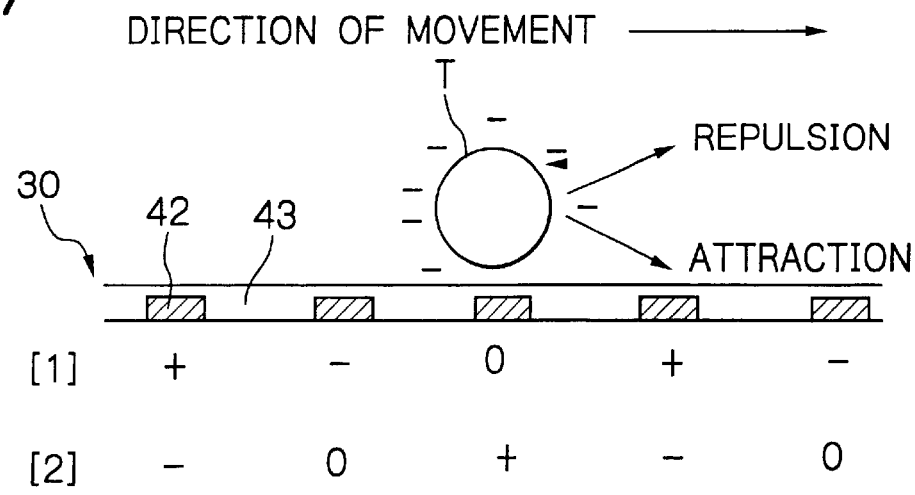
FIG. 7 is a view for describing the principle of toner conveyance unique to the conveyance board.

As shown in FIG. 7, assume that a charged toner particle T is positioned on the conveyance board 30. Also, assume that the potentials "+", "−", "0", "+" and "−" are respectively applied to the consecutive electrodes 42 on the board 30, as indicated by row [1]. Further, assume that the toner particle T is positioned on the "0" electrode 42. Then, repulsion acts between the toner particle T and the "−" electrode 42 positioned at the left-hand side of the "0" electrode 42, as viewed in FIG. 7. At the same time, attraction acts between the toner particle and the "+" electrode 42 positioned at the right-hand side of the "0" electrode 42. As a result, the toner particle T moves to the "+" electrode 42.

Figure 8:
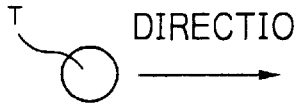
FIG. 8 is a table listing a specific pattern in which drive waveforms applied to the conveyance board vary.

Assume that the driver 50 applies the three-phase drive voltages Va, Vb and Vc to each three electrodes 42 in a specific pattern shown in FIG. 8. Then, the voltages indicated in row [1] of FIG. 7 are replaced with voltages "0", "+", "−", "0" and "+" indicated in row [2]. Consequently, no force acts between the toner particle T and the electrode 42 changed from "+" to "0". At the same time, repulsion acts between the toner particle T and the electrode 42 changed from "0" to "−" while attraction acts between the toner particle T and the electrode 42 changed from "−" to "+". The toner particle T therefore moves further to the "+" electrode 42.

As stated above, the potentials of the drive waveforms applied to the electrodes 42 are varied to apparently move the drive waveforms, so that the toner particle T sequentially moves toward the "+" electrode 4. That is, the toner particle T is conveyed along the conveying surface of the conveyance board 30. The pattern shown in FIG. 8 will be reversed when the toner particle is charged to positive polarity. Let the following description concentrate on toner charged to negative polarity.

The distance between nearby electrodes 42 is reduced from the inlet toward the outlet stepwise, as stated earlier. Therefore, repulsion and attraction acting on the negatively charged toner particle T sequentially increase toward the outlet stepwise (region A→region→B region C→region D). Finally, the toner particle T flies from one end of the conveyance board 30.

Figure 9:
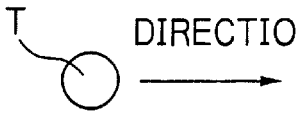
FIG. 9 is a table listing another specific pattern of variation.

FIG. 9 shows another specific pattern of the three-phase drive voltages Va, Vb and Vc that does not include "0". As shown, a "+" drive waveform is applied to two adjoining ones of three electrodes 42 while a "−" drive waveform is applied to the remaining electrode 42. This is also successful to convey the negatively charged toner T along the surface of the conveyance board 30 while accelerating it.

Figure 10:
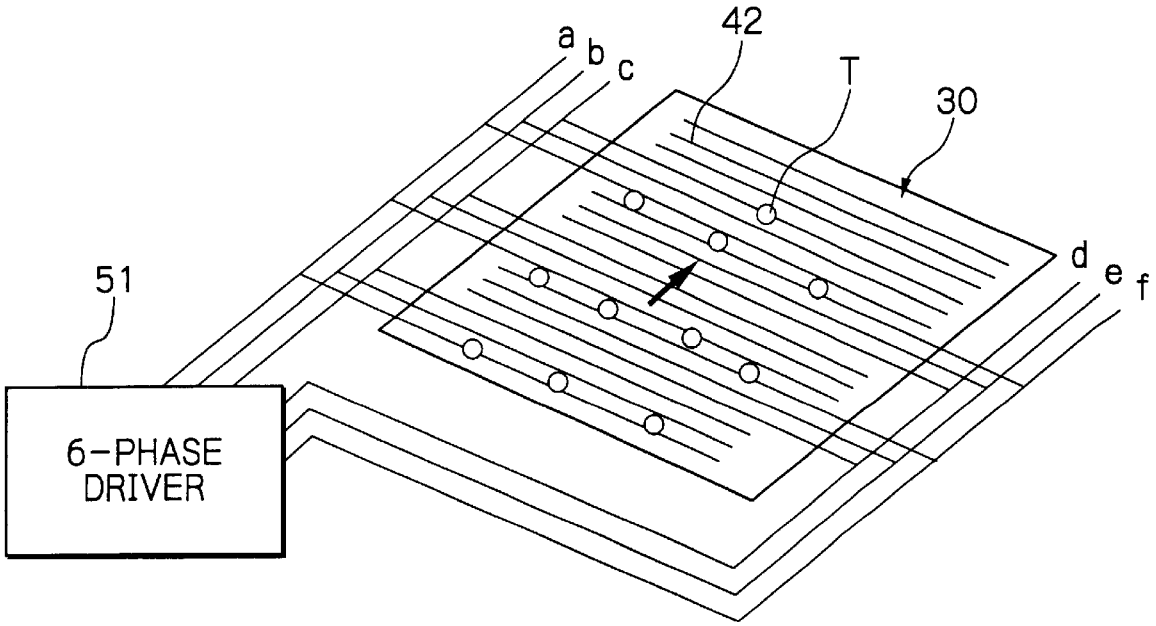
FIG. 10 is a view for describing another system for driving the toner flying device.
Figure 11:
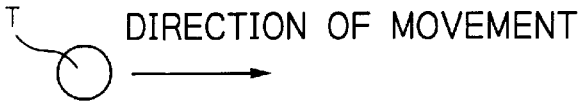
FIG. 11 is a table showing a specific pattern of drive waveforms applicable to the system of FIG. 10.

Further, as shown in FIG. 10, the driver 50 may be replaced with a six-phase driver 51 that applies drive voltages Va, Vb and Vc and drive waveforms Vd, Ve and Vf to each three electrodes 42. FIG. 11 shows a specific pattern in which the drive voltages va, Vb and Vc and drive waveforms Vd, Ve and Vf are applied in the configuration shown in FIG. 10.

Figure 12:
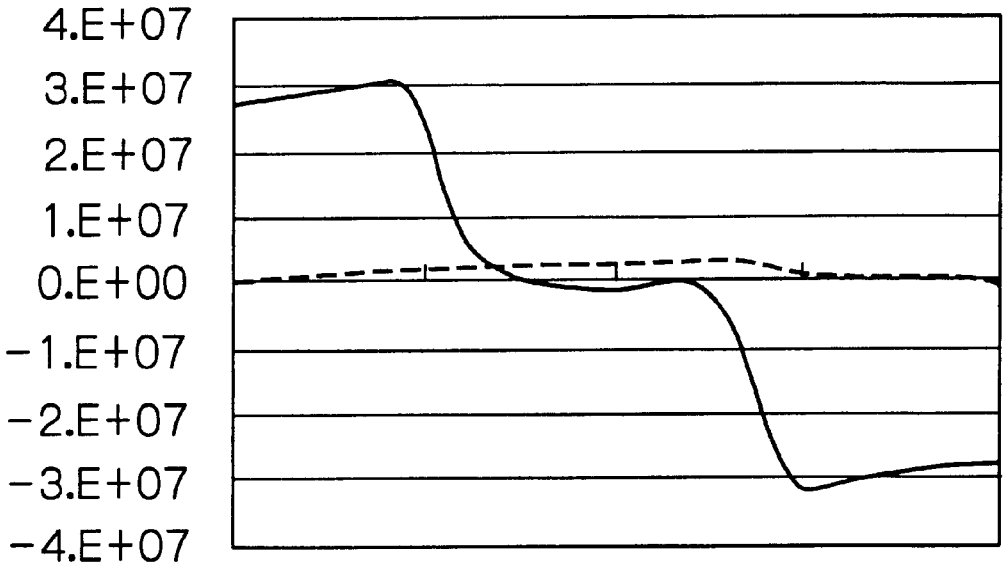
FIG. 12 is a graph showing field strengths and distribution thereof measured with the conveyance board.
Figure 13:
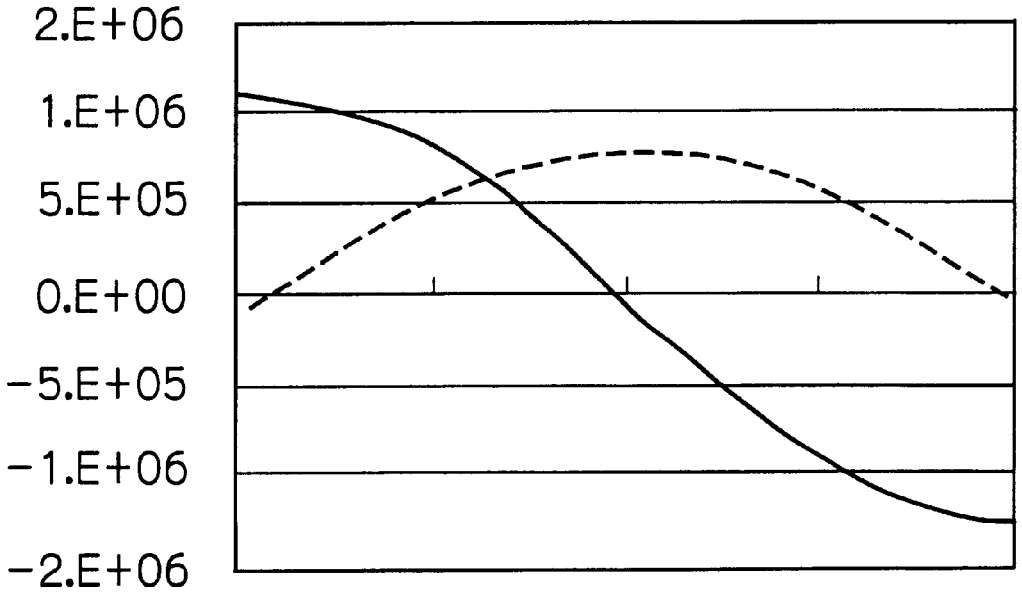
FIG. 13 is a graph similar to FIG. 12, showing the results of measurement effected with a comparative example.

Reference will be made to FIGS. 12 and 13 for describing a relation between the configuration of the conveyance board 30 and the field strength. FIG. 12 shows field strengths and the distribution of electric fields unique to the illustrative embodiment. FIG. 13 shows field strengths and the distribution of electric fields measured with a comparative conveyance board. In the illustrative embodiment, the electrodes 10 were 10 $\mu$m wide each and spaced from each other by 100 $\mu$m while the member 43 was 10 $\mu$m thick and formed of $SiO_2$. In the comparative conveyance board, the electrodes were 10 $\mu$m wide each and spaced from each other by 100 $\mu$m while the member 43 was 100 $\mu$m thick and formed of organic resin as conventional.

FIGS. 12 and 13 show electric fields formed by the consecutive electrodes 42 in y direction (perpendicular to the conveying surface; solid lines) and electric fields in x direction (parallel to the conveying surface). It will be seen that the conveyance board 30 of the illustrative embodiment implements electric fields in y direction that is about three times as great as the electric fields of the comparative conveyance board. Further, the conveyance board 30 includes flat regions where the electric field is substantially zero between nearby electrodes.

The great field intensity and the digital field distribution including flat regions between electrodes allow the toner to move at high speed on the conveyance board 30. The toner T therefore surely flies from the outlet at higher speed. Experiments showed that the conveyance board 30 caused the toner to fly at a speed of 0.5 m/sec to 5 m/sec although dependent on voltage and frequency.

Figure 14:
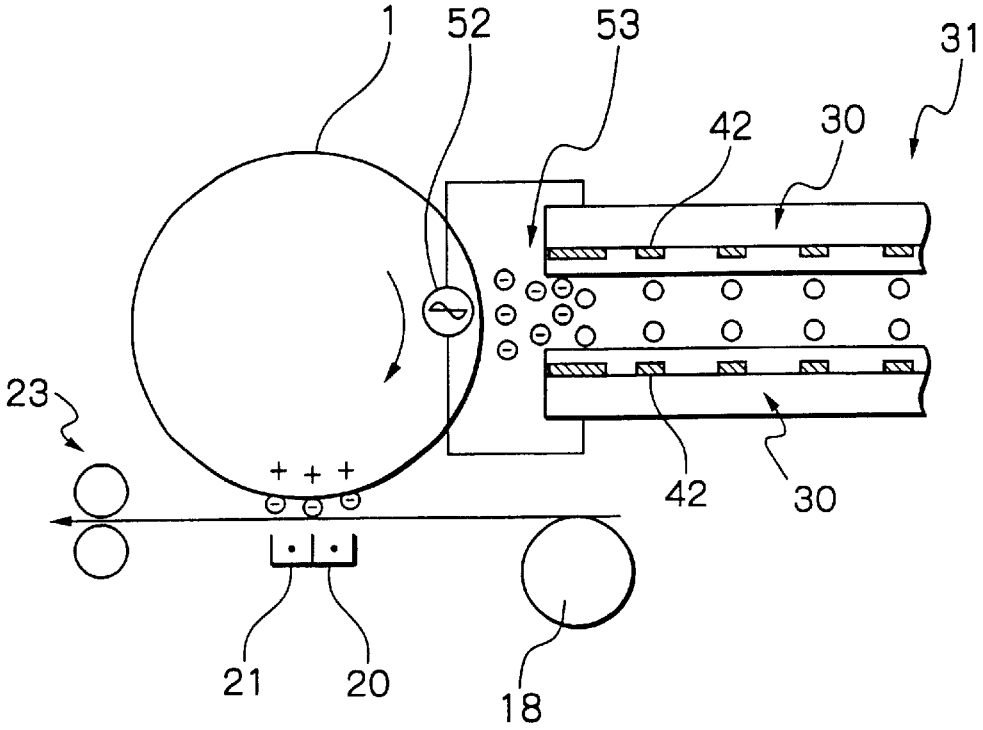
FIG. 14 is a view for describing the principle of development unique to the illustrative embodiment.

Development using the developing device 6 will be described hereinafter with reference also made to FIG. 14. As shown, the toner particles with negative charge fly from the toner flying device 31 toward the drum 1 by being conveyed and accelerated by the conveyance boards 30. The toner particles then deposit on a latent image, i.e., the positively charged portions of the surface of the drum 1, thereby developing the latent image. An AC power supply 52 may be connected to the outlet end of the conveyance boards 33 so as to form an AC electric field between the boards 33. The electric field causes the toner T flying toward the drum 1 to form a toner cloud 53 and evenly deposit on the latent image. The toner cloud 53 is successful to enhance image quality.

As stated above, the developing means (toner flying device or powder jetting device) electrostatically conveys the charged toner toward one end thereof along the conveying surfaces of the conveyance boards and then causes it to fly. Such developing means directly deposits the toner on the drum 1 without contacting the drum 1 and is therefore simple and low cost.

Further, the developing means of the illustrative embodiment deteriorates the toner less than conventional developing means using a developing roller. Specifically, it is a common practice with developing means to deposit frictionally charged toner on a developing roller together with a carrier, cause the toner electrostatically deposited on the carrier to form a magnet brush, and then bring the magnet brush into contact with an image carrier for thereby developing a latent image. The developing roller, however, kneads the toner or smashes it into fine powder. As a result, $SiO_2$, $TiO_2$ or similar additive is rubbed into the resin of the toner to thereby deteriorate the characteristics of the toner. The developing means of the present invention solves this problem.

Figure 15:
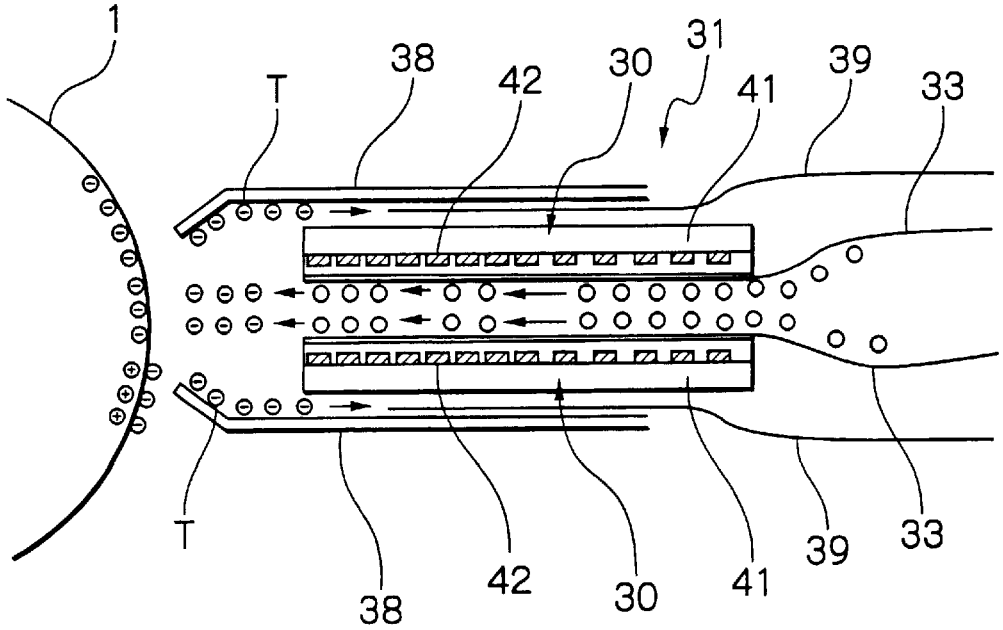
FIG. 15 is a view for describing the collection of toner effected in the illustrative embodiment.

The collection of the toner will be described with reference also made to FIG. 15. While the toner flies out of the conveyance boards 30 to deposit on the latent image formed on the drum 1, not all toner particles are used for development, as stated earlier. As shown in FIG. 15, toner gutters 38 are positioned outside of the conveyance boards 30 and cause the toner particles not used for developing and tending to be scattered around to deposit on the toner gutters 38. The return members 39 convey the above toner particles toward the inlet in the same manner as the conveyance boards 30. Consequently, such toner particles are collected in the toner box 32 and used again.

As stated above, returning means collects the toner not used for development and thereby prevents it from being scattered around. Further, the collecting means includes means for electrostatically returning the collected toner toward the inlet. This successfully promotes the reuse of the toner and thereby reduces the cost.

If desired, a bias voltage of the same polarity as the toner and a bias voltage opposite in polarity to the toner may be alternately applied to each toner gutter 38 in order to selectively attract or repulse the toner. In such a case, the toner will be collected and then returned to the outlet of the conveyance board 30 to be reused thereby. This configuration makes it needless to return the collected toner to the toner box 32.

Second Embodiment

Figure 16:
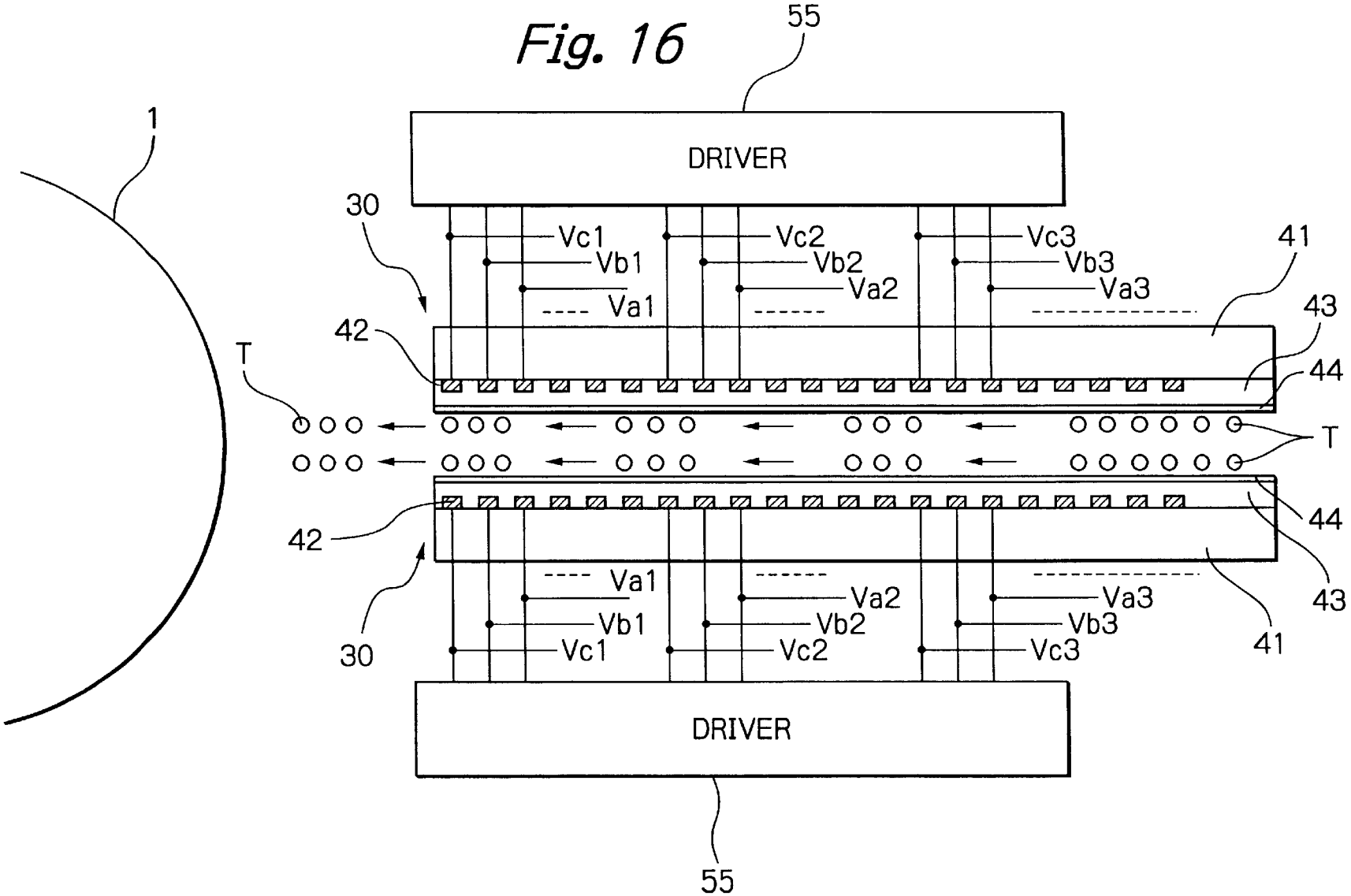
FIG. 16 is a schematic block diagram showing a second embodiment of the present invention.

FIG. 16 shows a second embodiment of the present invention, particularly the toner flying device 31 included therein. As shown, each conveyance board 30 has a number of electrodes 42 arranged at substantially the same interval in the direction of toner conveyance. Drivers 55 each apply to the associated electrodes 42 three-phase drive waveforms Va1, Vb1 and Vc1 having a frequency f1, three-phase drive waveforms Va2, Vb2 and Vc2 having a frequency f2, and three-phase drive waveforms Va3, Vb3 and Vc3 having a frequency f3 (f1>f2>f3).

More specifically, each driver 55 applies the drive waveforms Va1, Vb1 and Vc1 to part of the electrodes 42 that lie in a preselected zone of the conveyance board 30 adjoining the outlet. The driver 55 applies the drive waveforms Va2, Vb2 and Vc2 to the electrodes 42 lying in the intermediate zone of the conveyance board 30. Further, the driver 55 applies the drive voltages Va3, Vb3 and Vc3 to part of the electrodes 42 that lie in a preselected zone adjoining the inlet. As for the rest of the construction, the illustrative embodiment is identical with the first embodiment.

In the illustrative embodiment, although the electrodes 42 are arranged on the conveyance board 30 at substantially the same interval, the frequencies of the drive waveforms Va, Vb and Vc sequentially increase from the inlet toward the outlet stepwise, i.e., from the frequency f3 to the frequency f1. Attraction and repulsion to act on the charged toner vary in a shorter period of time as the frequency of the drive waveform increases. Therefore, the toner entered the space between the conveyance boards 30 via the inlet is sequentially accelerated as the frequency of the drive waveform increases. The toner is therefore conveyed along the conveying surfaces of the conveyance boards 30 while being accelerated.

The illustrative embodiment, which varies the frequency of the drive waveform stepwise, is advantageous over the first embodiment in that the electrodes 42 can be arranged at substantially the same interval. The illustrative embodiment, however, makes the configuration of each driver 55 slightly sophisticated. Either one of the two embodiments may be selected in consideration of the production cost of the drivers and conveyance boards. The two embodiments may be combined, if desired.

Third Embodiment

Figure 17:
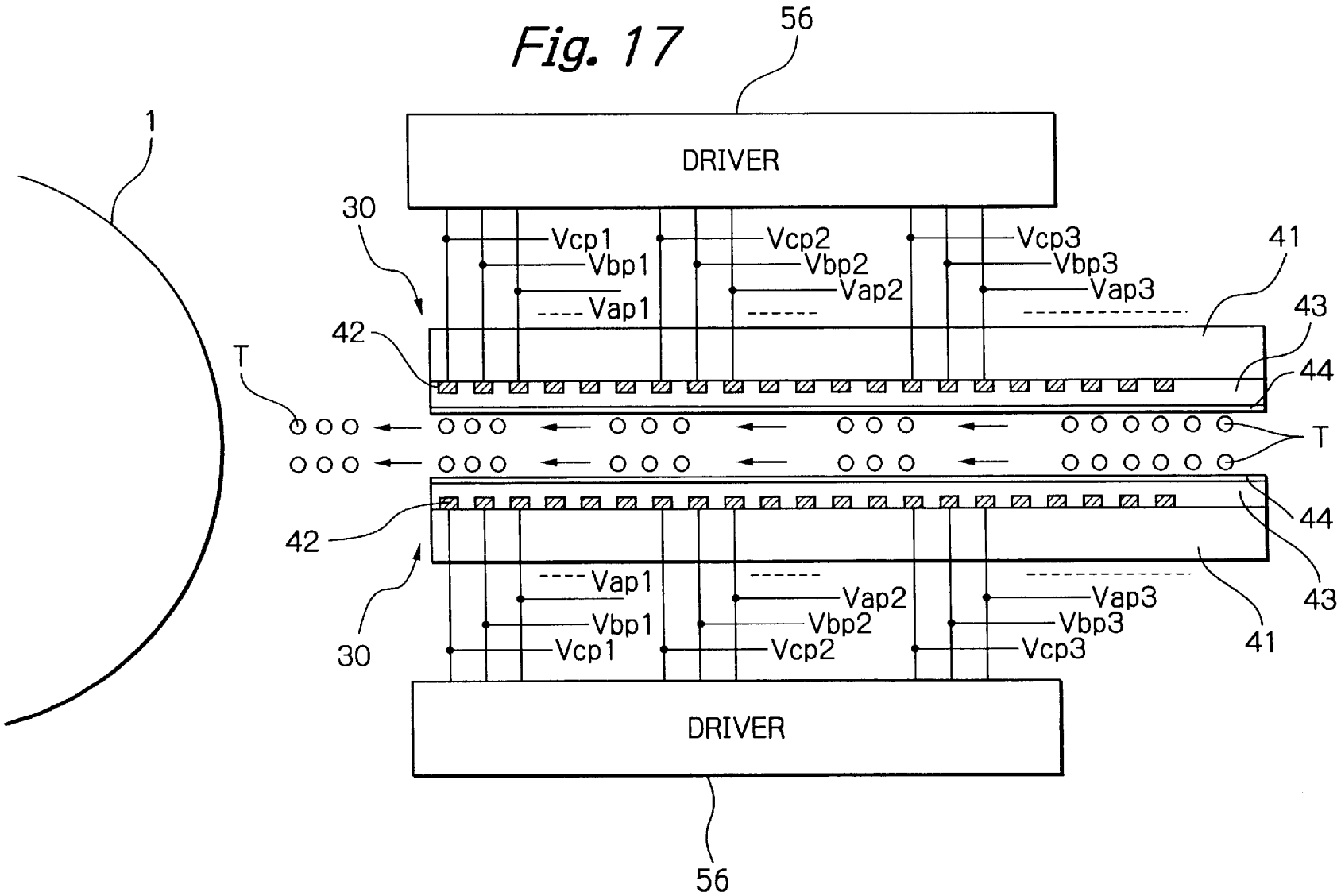
FIG. 17 is a schematic block diagram showing a third embodiment of the present invention.

FIG. 17 shows a third embodiment of the present invention, particularly the toner flying device 31 thereof. As shown, the electrodes 42 are arranged on each conveyance board 30 at substantially the same interval in the direction of toner conveyance. Drivers 56 each applies to the electrodes 42 three-phase drive waveforms Vap1, Vbp1 and Vpc1 having a crest value Vp1, three-phase drive waveforms Vap2, Vbp2 and Vcp2 having a crest value Vp2, and three-phase drive waveforms Vap3, Vbp3 and Vcp3 having a crest value Vp3 (Vp1>Vp2>Vp3).

More specifically, the driver 56 applies the drive waveforms Vap1, Vbp1 and Vcp1 to part of the electrodes 42 lying in a preselected zone that adjoins the outlet. The driver 56 applies the drive waveforms Vap2, Vbp2 and Vcp2 to the electrodes 42 lying in the intermediate zone of the conveyance board 30. Further, the driver 56 applies the drive waveforms Vap3, Vbp3 and Vcp3 to part of the electrodes 42 that lie in a preselected zone adjoining the inlet. As for the rest of the construction, this embodiment is identical with the previous embodiments.

In the illustrative embodiment, although the electrodes 42 are arranged on the conveyance board 30 at substantially the same interval, the crest values of the drive waveforms Va, Vb and Vc sequentially increase from the inlet toward the outlet stepwise, i.e., from the crest value Vp3 to the crest value Vp1. Attraction and repulsion to act on the charged toner vary in a shorter period of time as the crest value of the drive waveform increases. Therefore, the toner entered the space between the conveyance boards 30 via the inlet is sequentially accelerated as the crest value of the drive waveform increases. The toner is therefore conveyed along the conveying surfaces of the conveyance boards 30 while being accelerated.

Fourth Embodiment

Figure 18:
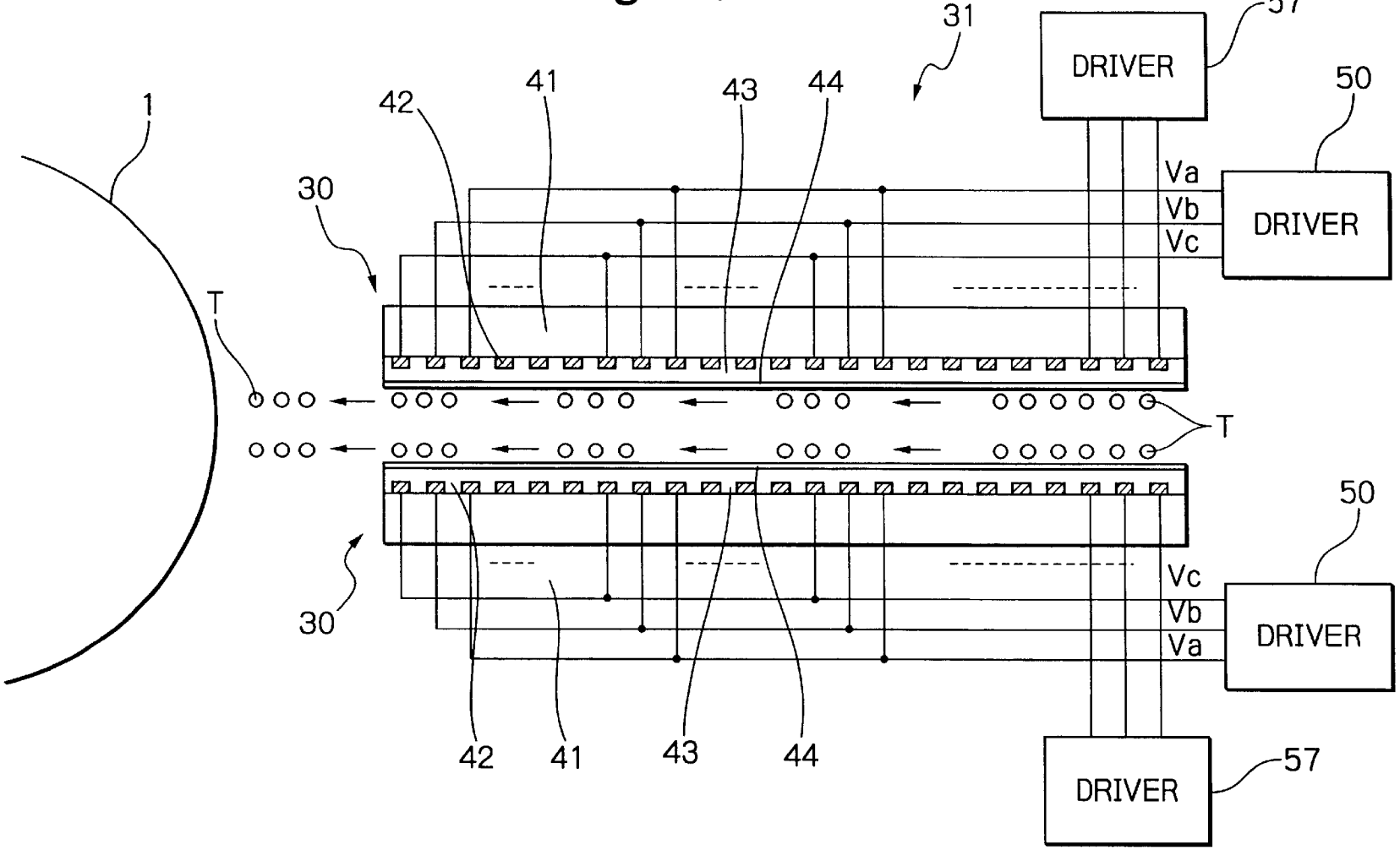
FIG. 18 is a schematic block diagram showing a fourth embodiment of the present invention.

FIG. 18 shows a fourth embodiment of the present invention, particularly the toner flying device 31 thereof. As shown, the electrodes 42 are arranged at substantially the same interval in the direction of toner conveyance. The illustrative embodiment includes drivers 57 in addition to the drivers 50 stated earlier. The drivers 57 each apply drive waveforms Vad, Vbd and Vcd higher in duty ratio than the drive waveforms Va, Vb and Vc to preselected ones of the electrodes 42, e.g., the electrodes 42 adjoining the outlet.

The drive waveforms Vad, Vbd and vcd applied to the electrodes 42 provide the toner with initial speed high enough for the toner to fly. Subsequently, the toner is sequentially conveyed by the electrodes 42 to which the drive waveforms Va, Vb and Vc are applied at substantially the initial speed. The toner then flies toward the drum 1 from the outlet of the conveyance board 30.

Fifth Embodiment

Figure 19:
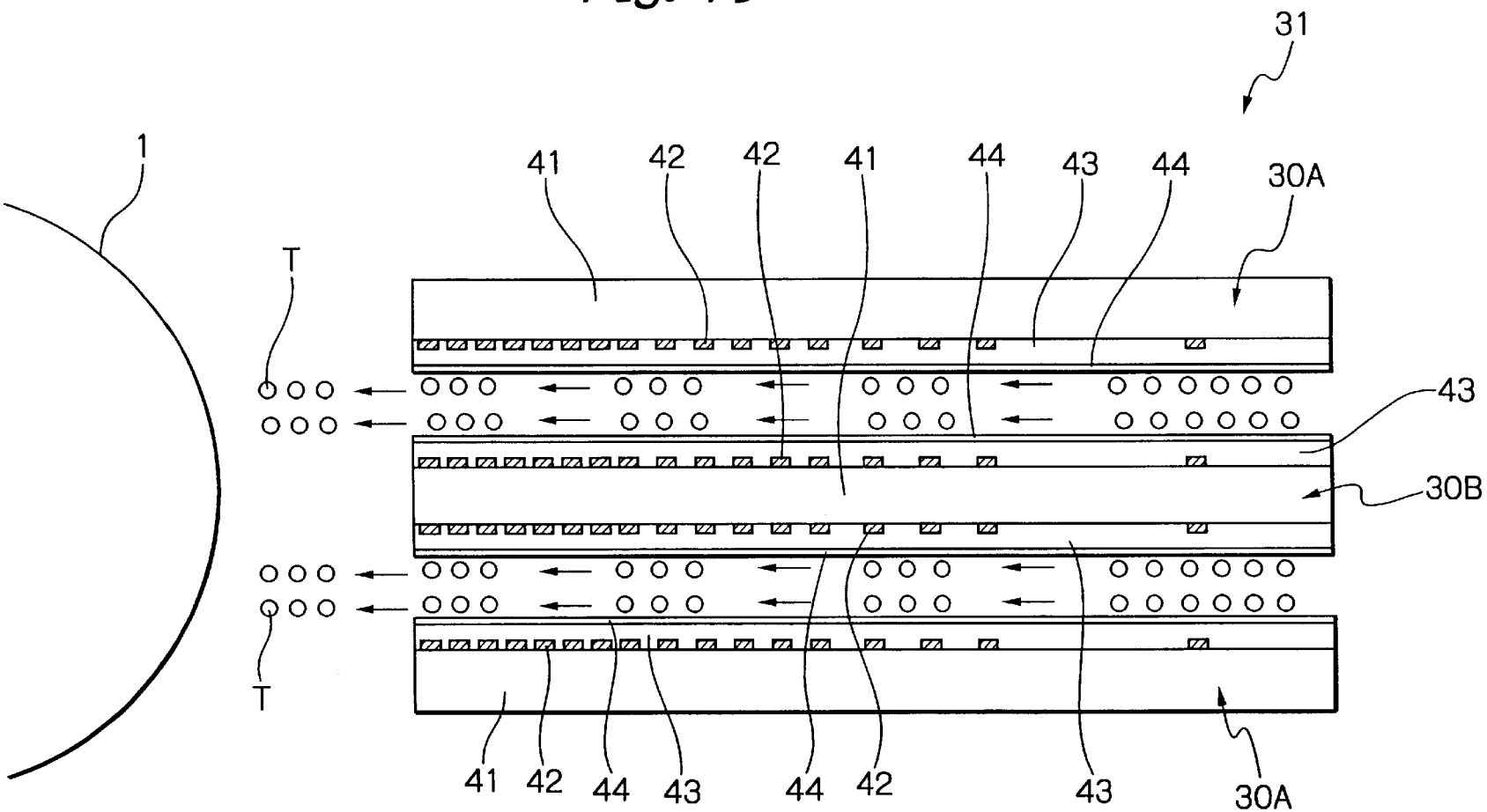
FIG. 19 is a schematic block diagram showing a fifth embodiment of the present invention.

FIG. 19 shows a fifth embodiment of the present invention, particularly the toner flying device 31 thereof. As shown, the illustrative embodiment includes two conveyance boards 30A and an additional conveyance board 30B intervening between the conveyance boards 30A. While the conveyance boards 30A has a single conveying surface as in the previous embodiments, the conveyance board 30B has a conveying surface on opposite sides thereof. The conveying surfaces of the boards 30A and those of the board 30B cooperate to convey the toner.

The illustrative embodiment with the above configuration conveys the toner by an amount two times as great as the amount available with the previous embodiments for a unit time. The illustrative embodiment can therefore sufficiently cope with high-speed recording. Specifically, the amount of toner consumption increases with an increase in recording speed with the result that toner replenishment sometimes becomes short. The illustrative embodiment can convey more toner with a simple configuration and successfully copes with high-speed recording.

Figure 20:
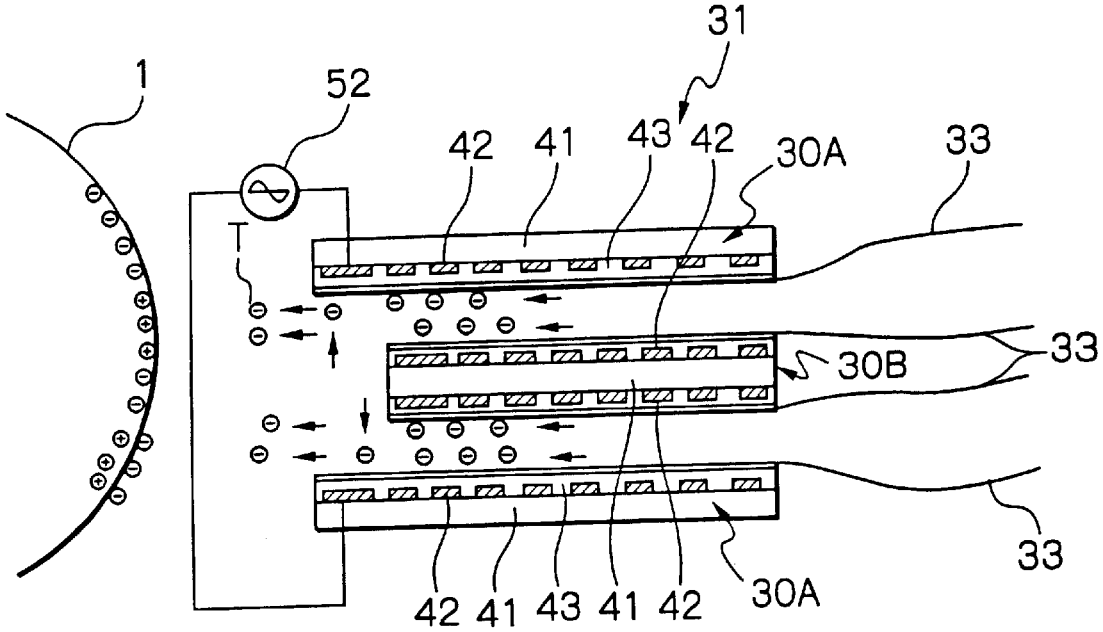
FIG. 20 is a view showing part of a modification of the fifth embodiment.

FIG. 20 shows a modification of the illustrative embodiment. As shown, the outlet of the intermediate conveyance board 30B is set back relative to the outlets of the conveyance boards 30A. The AC power supply applies an AC voltage between the conveyance boards 30A in order to form an AC electric field. The AC electric field causes the toner T to oscillate at the outlet side of the conveyance boards 30A and easily form a toner cloud.

Sixth Embodiment

Figure 21:
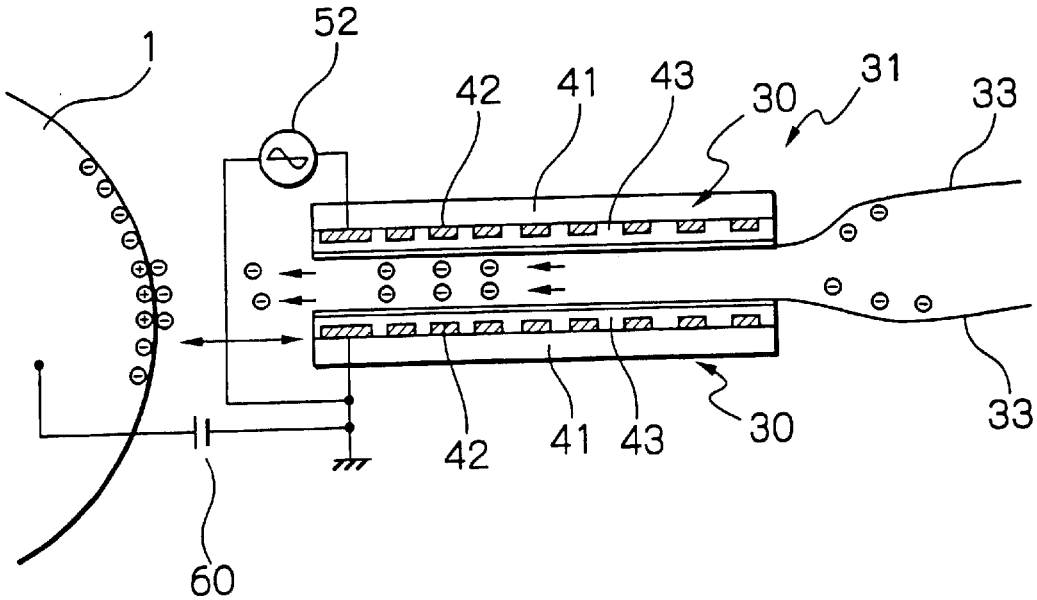
FIG. 21 is a view showing a sixth embodiment of the present invention.

FIG. 21 shows a sixth embodiment of the present invention. As shown, the AC power source 52 applies an AC voltage between the conveyance boards 30 as in the previous embodiment. In addition, a DC power supply 60 applies a DC voltage between the drum 1 and one of the conveyance boards 30 (lower conveyance board 30 in the illustrative embodiment).

The AC power supply 52 and DC power supply 60 respectively apply AC±300 V and DC 500 V by way of example. In this condition, +500 V is constantly applied between the drum 1 and the lower conveyance board 30 while 200 V (=500−(+300)) and 800 V (=500−(−300)) are alternately applied to the upper conveyance board 30. The alternating electric field generated between the upper conveyance board 30 and the drum oscillates. Consequently, the toner flown out of the conveyance boards 30 is scattered by the oscillation of the electric field and therefore deposits or leaves the drum 1 more frequently. It follows that the toner accurately deposits on the charge pattern of the drum 1 and enhances image quality.

Seventh Embodiment

Figure 22:
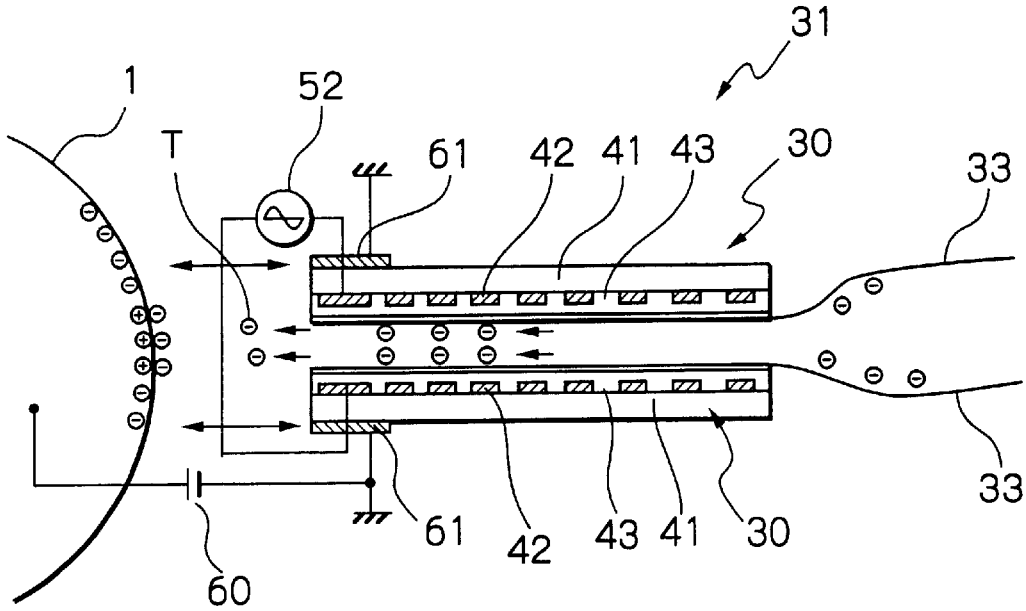
FIG. 22 is a view showing a seventh embodiment of the present invention.

FIG. 22 shows a seventh embodiment of the present invention. As shown, the AC power supply applies an AC voltage between the conveyance boards 30 as in the previous embodiment. In addition, a DC power supply 60 applies a DC voltage between the drum 1 and electrode portions 61 provided on the conveyance boards 30. In this configuration, DC bias electric fields are formed between the conveyance boards 30 and the drum 1. The DC bias electric fields confine the toner forming a toner cloud due to the AC electric field therebetween. The illustrative embodiment therefore prevents the toner from being scattered and further improves image quality.

Eighth Embodiment

Figure 23:
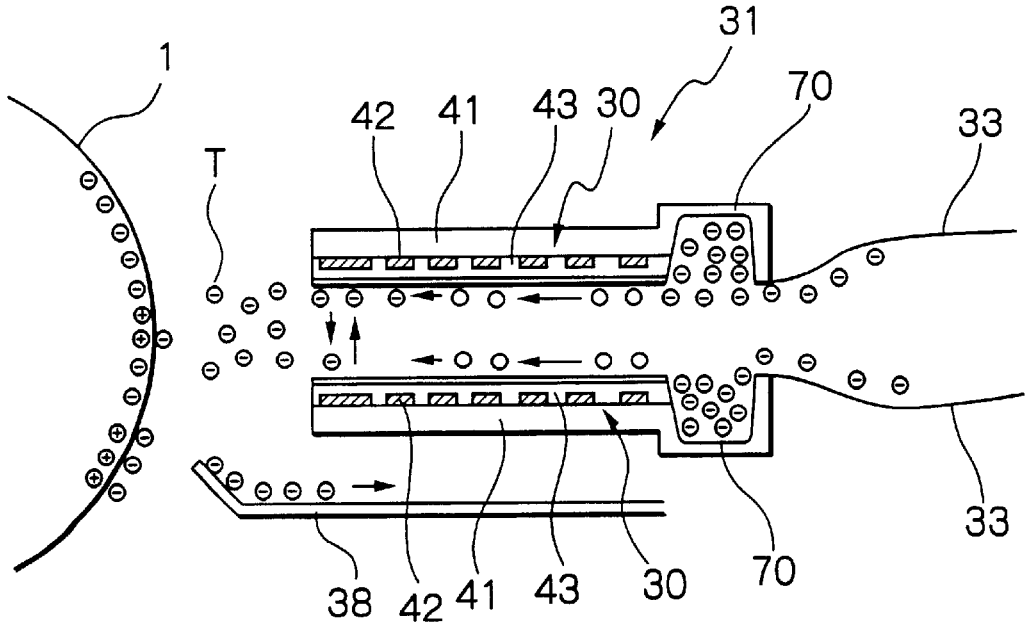
FIG. 23 is a view showing an eighth embodiment of the present invention.

FIG. 23 shows an eighth embodiment of the present invention, particularly the toner flying device 31 thereof. As shown, the conveyance boards 30 each are configured to form a storing portion or recess 70. The storing portions 70 can store the toner fed from the toner box 32 and allow the toner to be continuously conveyed and flown without interruption. Specifically, the toner must be continuously conveyed and flown when consumed in a great amount. If the toner is not replenished to the conveyance boards 30 in good time, then the toner becomes short. In this respect, the storing portions 70 allow the toner to be conveyed while being stored therein and insure the stable conveyance and flight of the toner, preventing image quality from being degraded.

Ninth Embodiment

Figure 24:
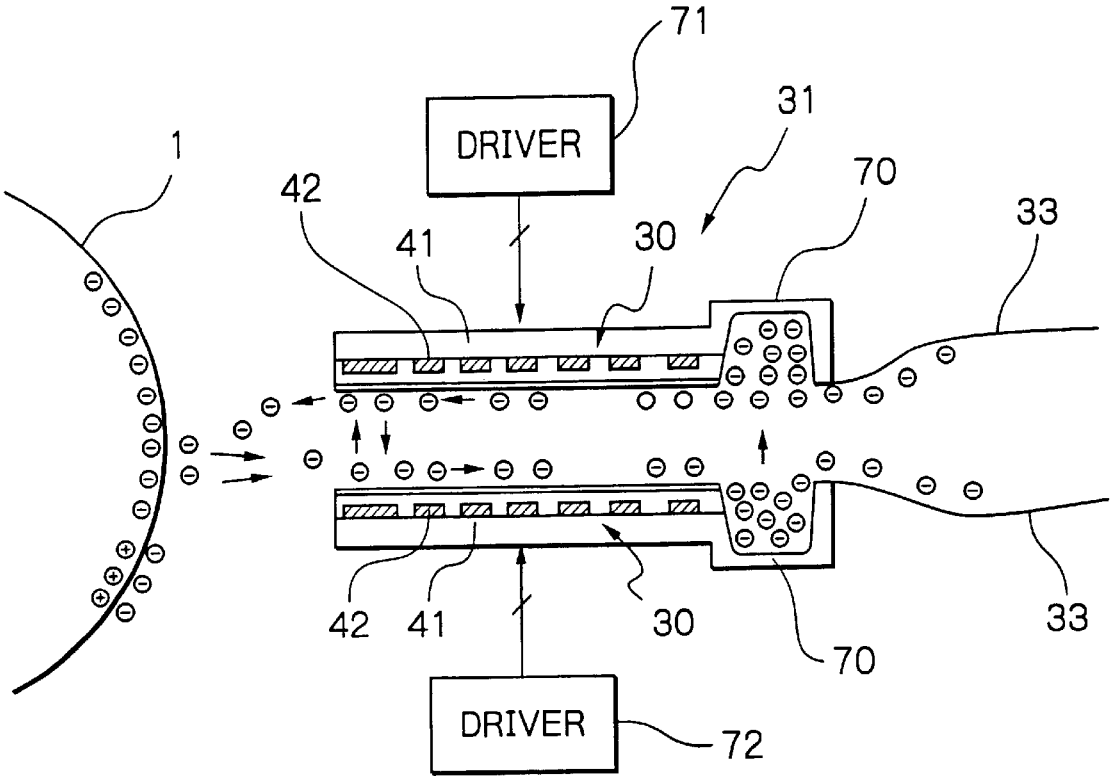
FIG. 24 is a view showing a ninth embodiment of the present invention.

FIG. 24 shows a ninth embodiment of the present invention, particularly the toner flying device 31 thereof. As shown, the conveyance boards 30 each include the previously stated storing portion 70. A drive circuit 71 applies the drive waveforms Va, Vb and Vc, which vary in the pattern shown in FIG. 9, to the upper conveyance board 30. A drive circuit 72 applies the drive waveforms Va, Vb and Vc, which vary in a pattern shown in FIG. 25, to the lower conveyance board 30.

In the configuration shown in FIG. 24, the upper conveyance board 30 conveys the toner in the same manner as in the previous embodiments and causes it to fly toward the drum 1. On the other hand, the lower conveyance board 30 opposite in the pattern of the drive waveforms to the upper conveyance board 30 conveys the toner in the reverse direction, i.e., from the outlet toward the inlet. Therefore, the toner bouncing back without depositing on the drum 1 is conveyed from the outlet to the storing portion 70 by the lower conveyance board 30 and reused. This not only promotes the efficient use of the toner, but also prevents the bounced toner from flying about and thereby improves image quality.

Tenth Embodiment

Figure 25:
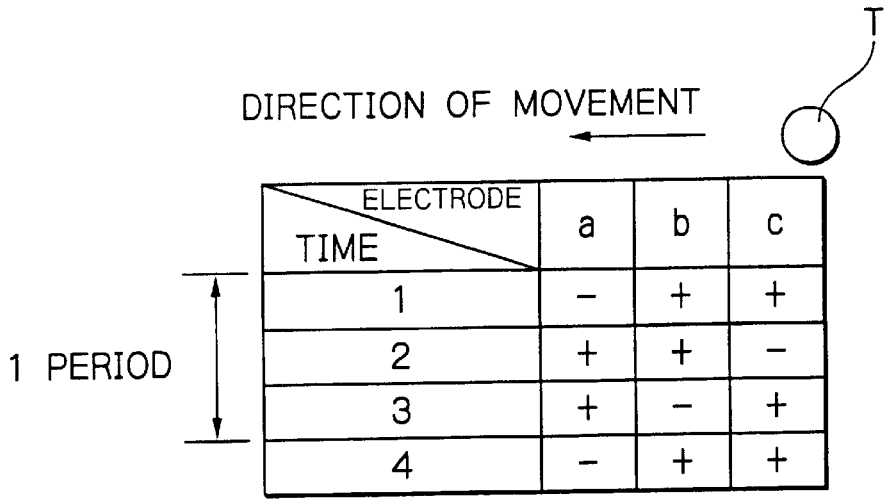
FIG. 25 is a table listing a specific pattern in which drive voltages vary in the ninth embodiment.
Figure 26:
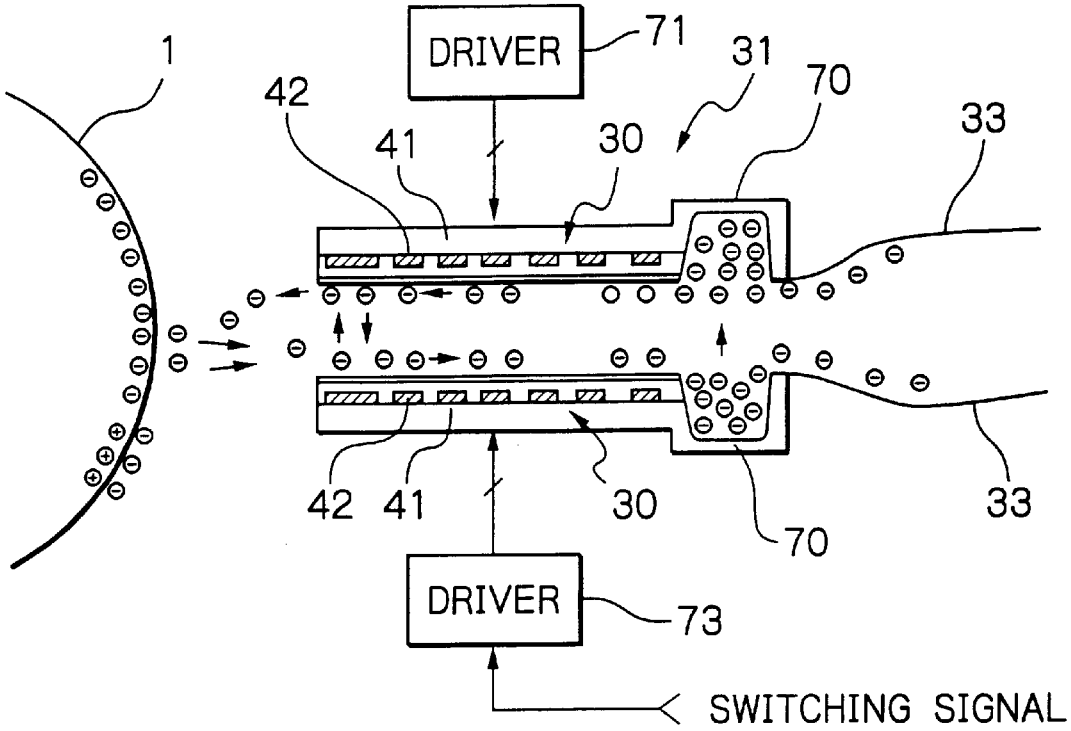
FIG. 26 is a view showing a tenth embodiment of the present invention.
Figure 27:
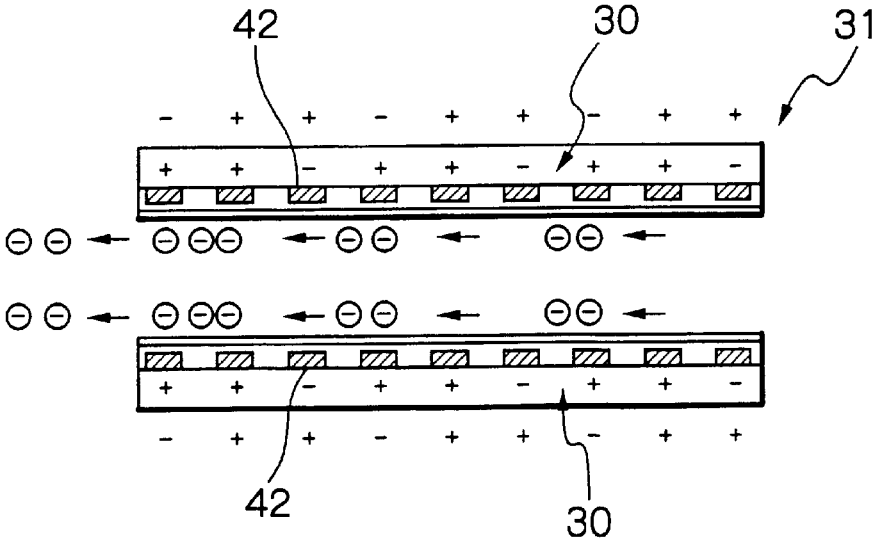
FIG. 27 is a view for describing the flight of toner particular to the tenth embodiment.

FIG. 26 shows a tenth embodiment of the present invention, particularly the toner flying device 31 thereof. As shown, the driver 71 applies the drive waveforms Va, Vb and Vc varying in the pattern of FIG. 9 to the upper conveyance board 30. A driver 73 is selectively operable in two different modes. Specifically, the driver 73 applies the drive waveforms Va, Vb and Vc varying in the pattern of FIG. 9 to the lower conveyance board 30 or applies the drive waveforms Va, Vb and Vc varying in the pattern of FIG. 25 opposite to the pattern of FIG. 9 to the same.

A controller, not shown, sends a mode switching signal to the driver 73. When the apparatus is, e.g., in a standby state, the mode switching signal causes the driver 73 to output the drive waveforms Va, Vb and Vc in the pattern of FIG. 25.

While the apparatus forms images in the usual manner, the controller causes the lower conveyance board 30, as well as the upper conveyance board 30, to apply the drive voltages Va, Vb and Vc varying in the pattern of FIG. 9. As a result, the upper and lower conveyance boards 30 both convey the toner toward the outlet and therefore by an amount two times as great as the amount available with a single conveyance board 30.

Figure 28:
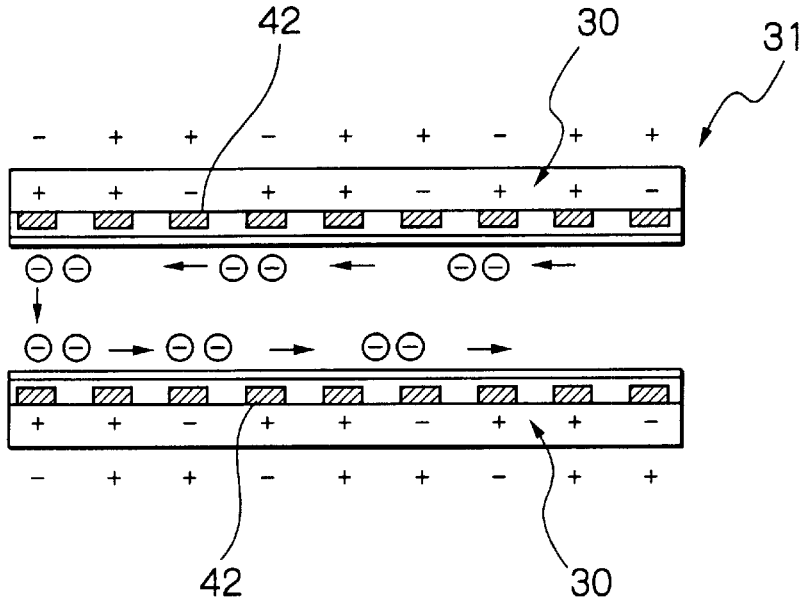
FIG. 28 is a view for describing the circulation of toner particular to the tenth embodiment.

When the apparatus is in a standby state, the controller causes the lower conveyance board 30 to apply the drive voltages Va, Vb and Vc varying in the pattern of FIG. 25. The lower conveyance board 30 therefore conveys the toner in the reverse direction. In this case, as shown in FIG. 28, the toner is simply circulated in the space between the two conveyance boards 30 without flying toward the drum 1. This prevents the toner from being scattered around more positively and thereby enhances image quality. In addition, the lower conveyance board 30, which selectively conveys the toner from the inlet to the outlet or from the outlet to the inlet, simplifies the configuration of the toner flying device 31.

Figure 29:
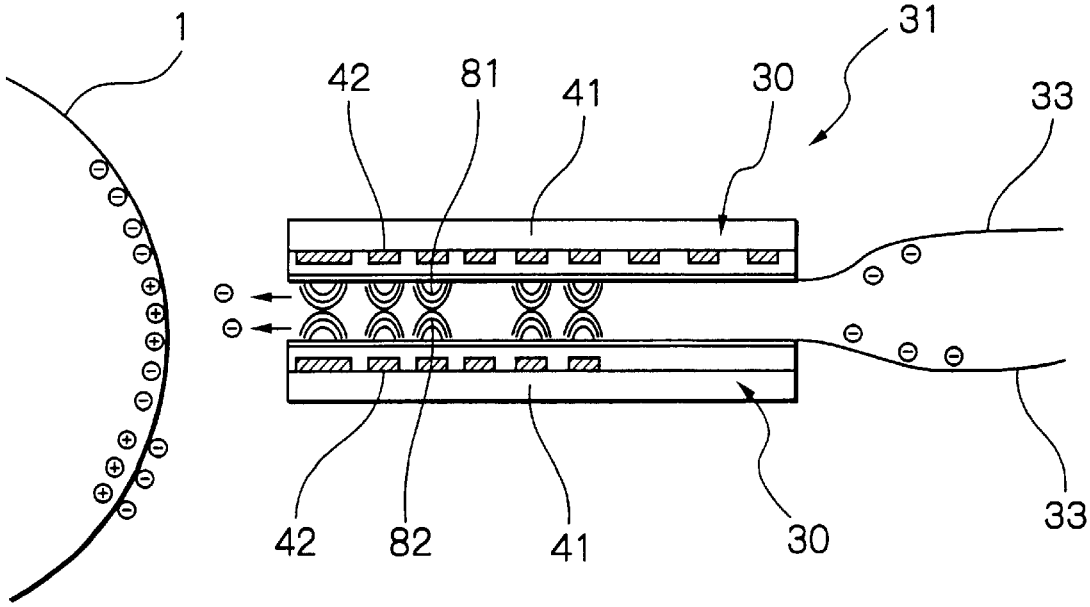
FIG. 29 is a view for describing the conveyance of toner available with any one of the illustrative embodiments.

In any one of the previous embodiments including at least two conveyance boards 30, the drive voltages and the gap between the conveying surfaces may be so selected as to synchronize the drive waveforms to be applied to the electrodes of the conveyance boards 30. In such a case, as shown in FIG. 29, electric field curtains formed by the upper conveyance board 30 and those formed by the lower conveyance board 30 join each other. In this condition, the toner does not move at the positions where the electric field curtains join each other, while forming layers at the other positions. The toner can therefore be intermittently conveyed in the form of consecutive layers if the curtains 81 joining each other are moved toward the outlet with a preselected time constant.

Figure 30:
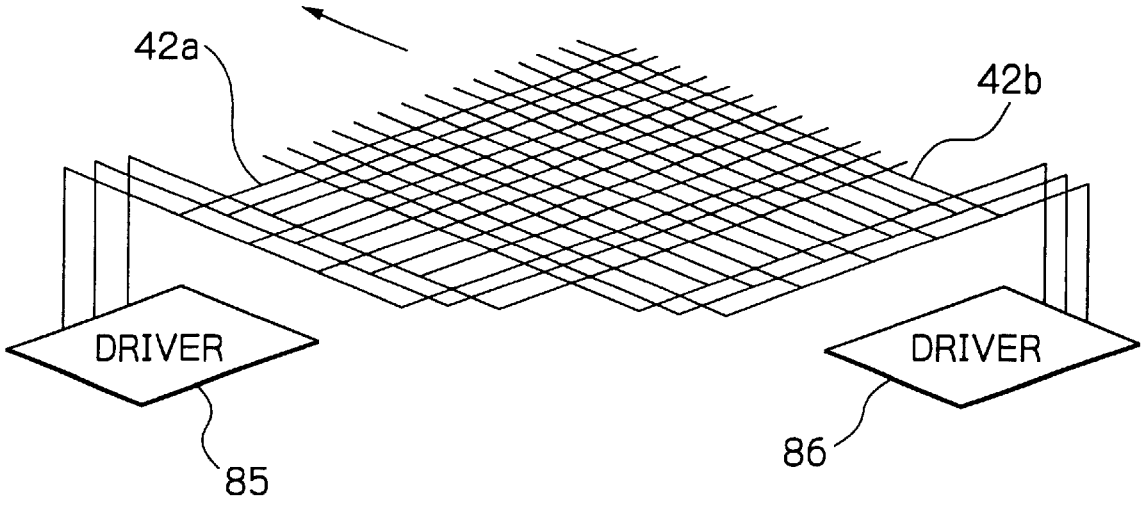
FIG. 30 is a view showing another specific arrangement of electrodes applicable to any one of the illustrative embodiments.

FIG. 30 shows another modification of any one of the illustrative embodiments. As shown, each conveyance board includes electrodes 42*a* extending in x direction and electrodes 42*b* extending in y direction. The electrodes 42*a* and electrodes 42*b* are arranged in a lattice pattern and isolated from each other by an insulating film. A driver 85 applies three-phase drive waveforms to the electrodes 42*a* while a driver 86 applies three-phase drive waveforms to the electrodes 42*b*.

In operation, the toner charged by the electrodes 42*a* extending in x direction are conveyed in a direction indicated by an arrow in FIG. 30. At the same time, the drive waveforms applied to the electrodes 42*b*, which extend in y direction, subject the toner to its electric field also. Consequently, the toner is conveyed while oscillating itself. Toner particles are therefore separated from each other and surely fly independently of each other, thereby enhancing image quality.

Eleventh Embodiment

Figure 31:
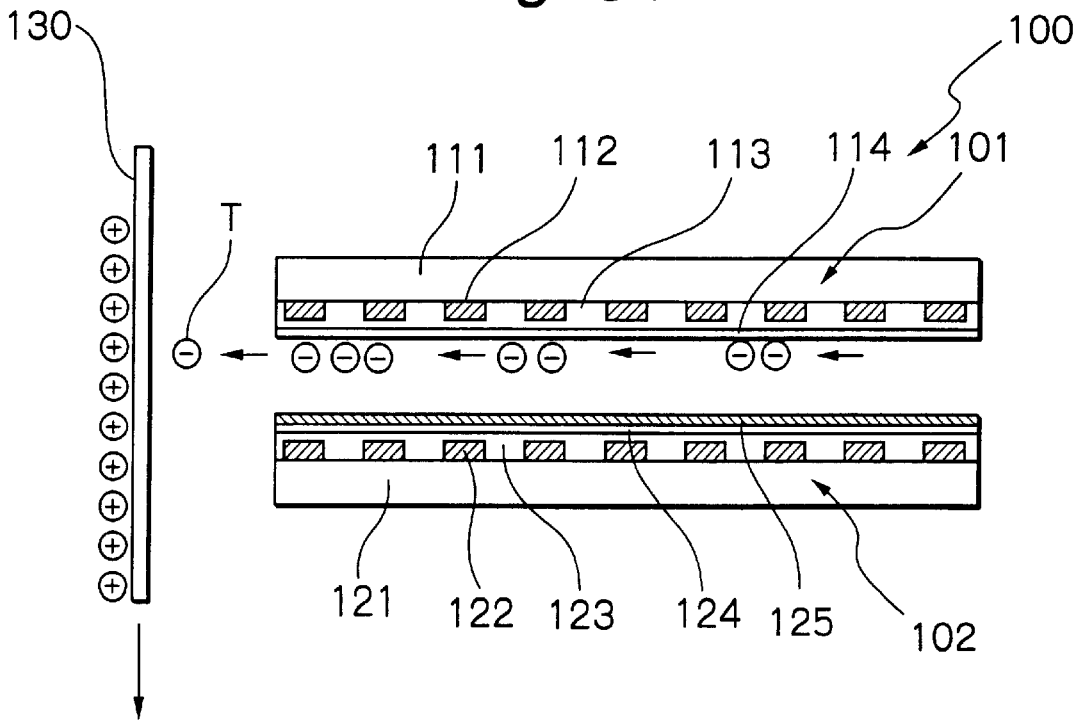
FIG. 31 is a view showing an eleventh embodiment of the present invention.
Figure 32:
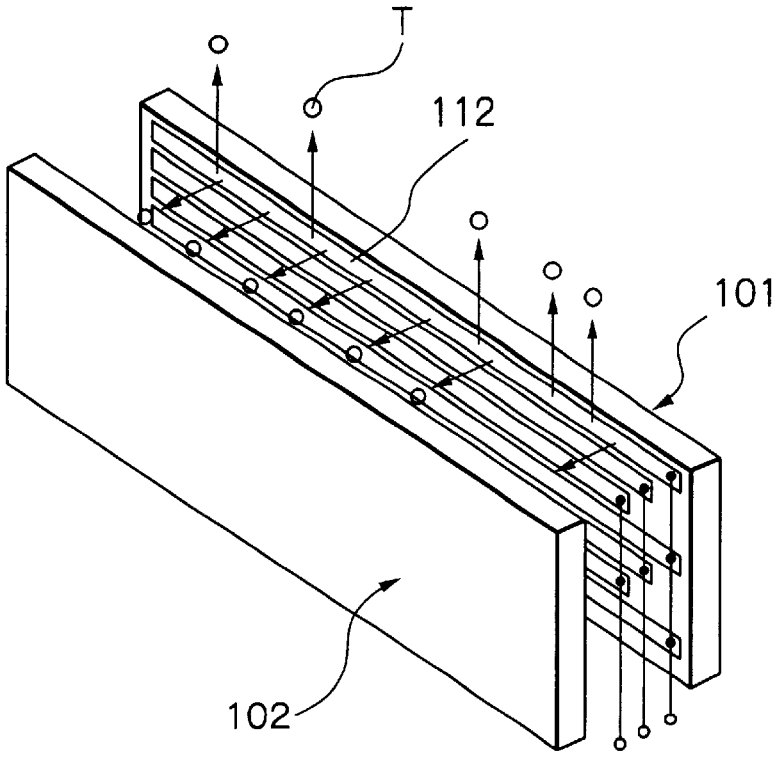
FIG. 32 is an isometric view of the eleventh embodiment.
Figure 33:
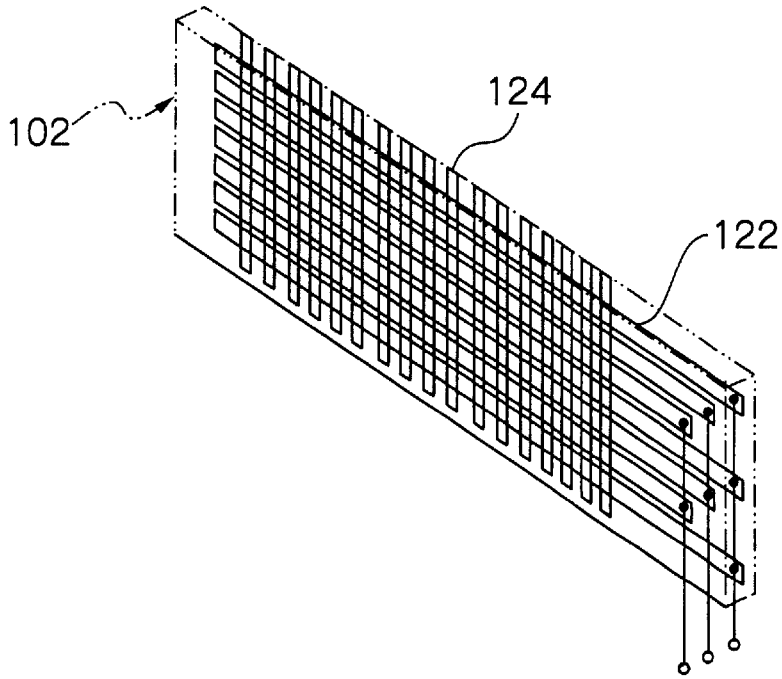
FIG. 33 is a perspective view showing a control board included in the eleventh embodiment.

Referring to FIGS. 31 through 33, an eleventh embodiment of the present invention will be described. FIG. 31 is a fragmentary view of an image forming apparatus. FIG. 32 shows a toner jet head included in the apparatus while FIG. 33 shows a control board included in the toner jet head. As shown, the apparatus includes a toner jet head 100 for causing charged toner to fly in accordance with an image signal. The toner jet head 100 is generally made up of a conveyance board 101 and a control board 102 facing each other.

As shown in FIG. 32 also, the conveyance board 101, like the conveyance board 30, includes a substrate 111 and a number of electrodes 112 arranged on the substrate 111. The electrodes 112, each three of which make a set, each extend in the direction perpendicular to the direction of toner conveyance. A member 113 for forming a conveying surface is formed on the electrodes 112. A coating layer or film 114 is formed on the surface of the member 113 in order to reduce contact resistance between the member 113 and the toner.

As shown in FIG. 33 also, the control board 102 includes a substrate 121. A number of first electrodes 122 are arranged on the substrate 121 for conveying the toner in the reverse direction, and each extend in the direction perpendicular to the direction of toner conveyance. An insulative protection film 123 is formed on the first electrodes 122. A number of second electrodes or pixel electrodes 124 are arranged on the protection film 123, and each extend in the direction perpendicular to the direction of toner conveyance. Further, a protection film 125 is formed on the second electrodes 124

Drive waveforms are applied to the electrodes 112 of the conveyance board 101 in the same manner as in any one of the previous embodiments, causing the board 101 to covey the toner in the same manner as the conveyance board 30. On the other hand, drive waveforms are applied to the first electrodes 122 of the control board 102 in a pattern opposite to the electrodes 122, so that the toner is conveyed from the outlet to the inlet, as stated earlier with reference to FIG. 28.

Assume that a drive waveform for generating an electric field that repulses the charged toner is applied to any one of the second electrodes 124 of the control board 102 in accordance with a pixel signal. Then, the toner being conveyed by the conveyance board 101 flies away from the board 101. On the other hand, when a drive waveform for generating an electric field that attracts the charged toner is applied to the electrode 124, the toner conveyed by the conveyance board 101 as far as the outlet of the board 101 is attracted by the control board 102. More specifically, by controlling the drive waveforms to be applied to the second electrodes 124 in accordance with a pixel signal, it is possible to implement an on-demand type of toner jet head that controls the flight of the toner from the conveyance board 101 pixel by pixel.

The toner T jetted from the toner jet head deposits on a recording medium 130, forming a toner image in accordance with an image signal. Subsequently, the toner image is fixed on the recording medium 130. The illustrative embodiment obviates the need for an image carrier and is therefore simple in construction. Moreover, the illustrative embodiment controls the flight of the toner on a pixel basis to thereby circulate part of the toner that did not fly. This successfully maintains the saturation charge of the toner and thereby causes a minimum of toner to be scattered around.

Twelfth Embodiment

Figure 34:
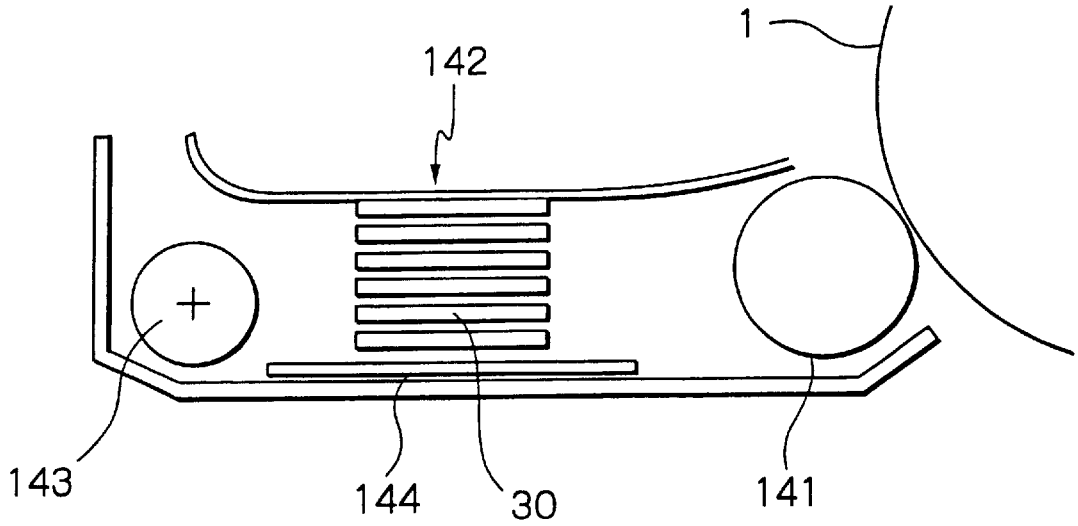
FIG. 34 is a view showing an image forming apparatus including a toner feeding device in accordance with the present invention.
Figure 35:
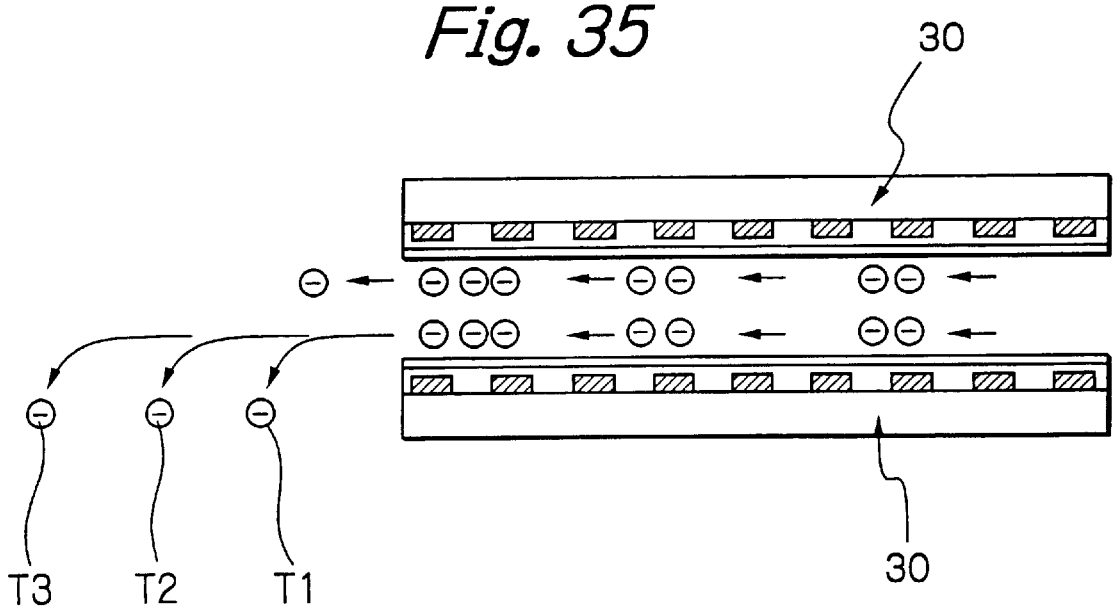
FIG. 35 is a view demonstrating how the toner feeding device of FIG. 34 classifies toner.
Figure 36:
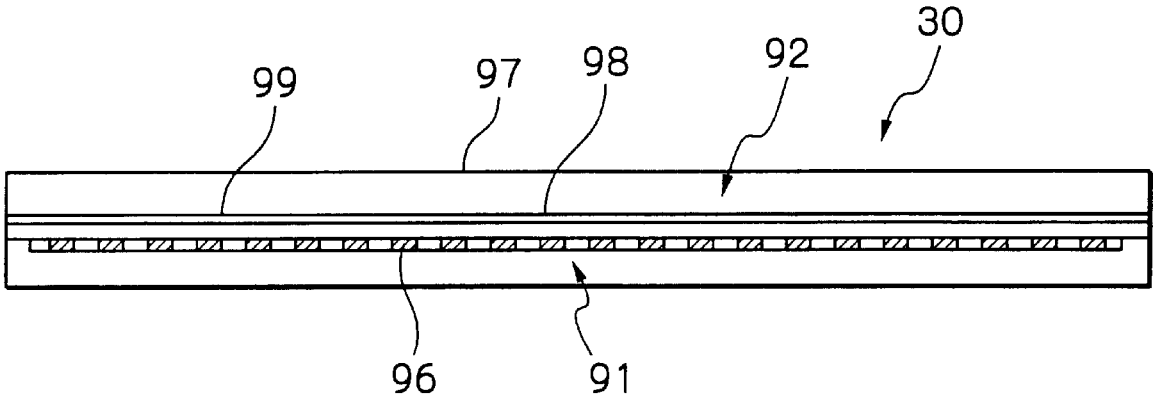
FIG. 36 is a section in the direction of toner conveyance, showing a first specific configuration of a toner conveying device representative of a thirteenth embodiment of the present invention.
Figure 37:
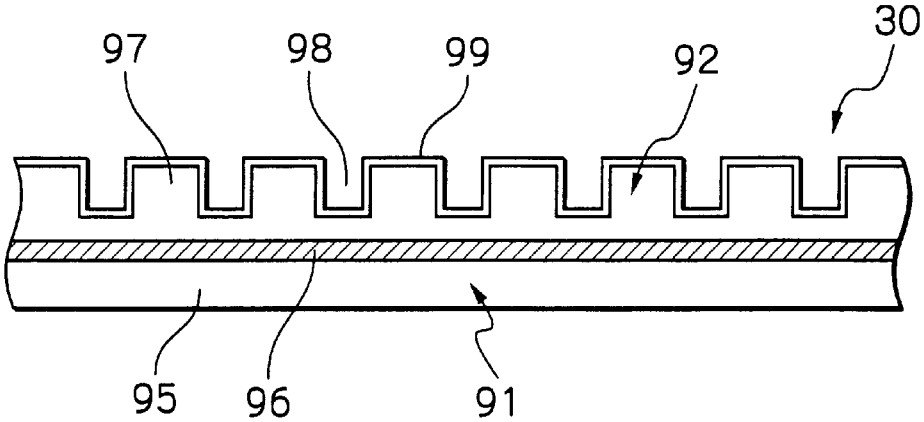
FIG. 37 is a section in a direction perpendicular to the direction of toner conveyance.
Figure 38:
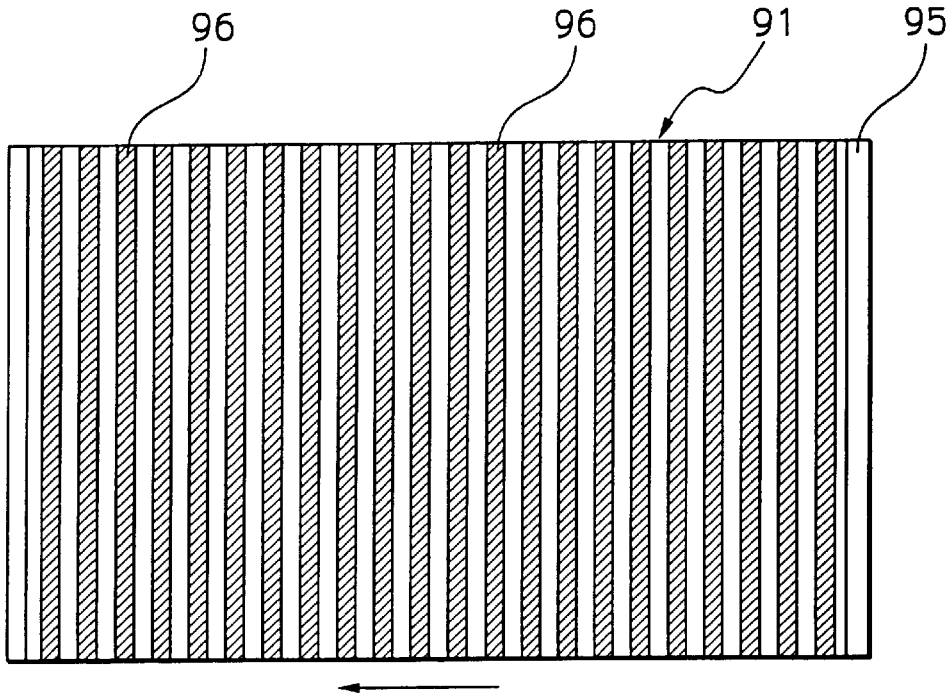
FIG. 38 is a plan view of an electrode board included in the thirteenth embodiment.
Figure 39:
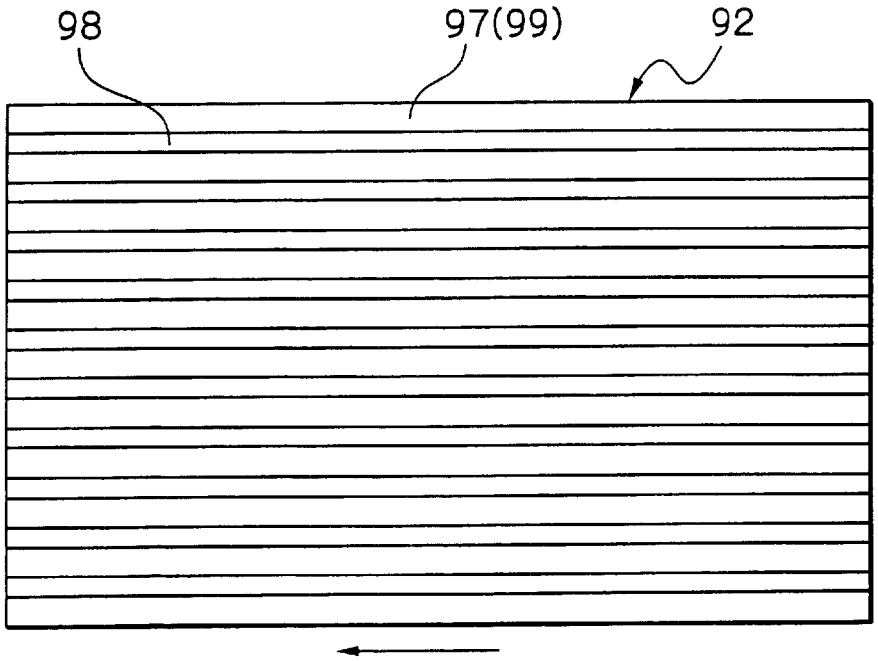
FIG. 39 is a plan view showing a conveyance board included in the thirteenth embodiment.
Figure 40:
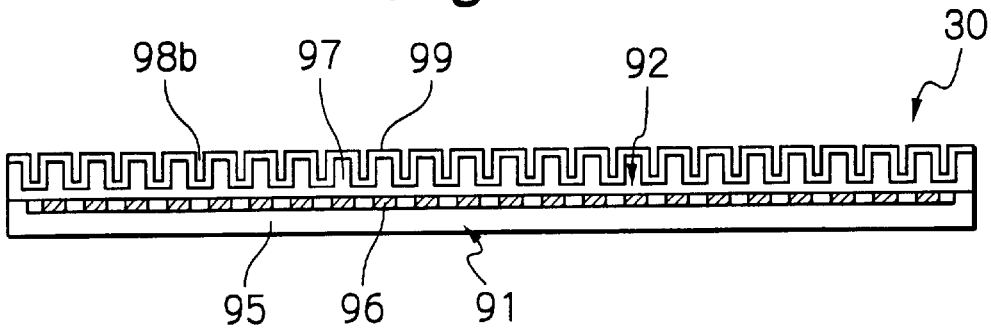
FIG. 40 is a section in the direction of toner conveyance, showing a second specific configuration of the toner conveying device.
Figure 41:
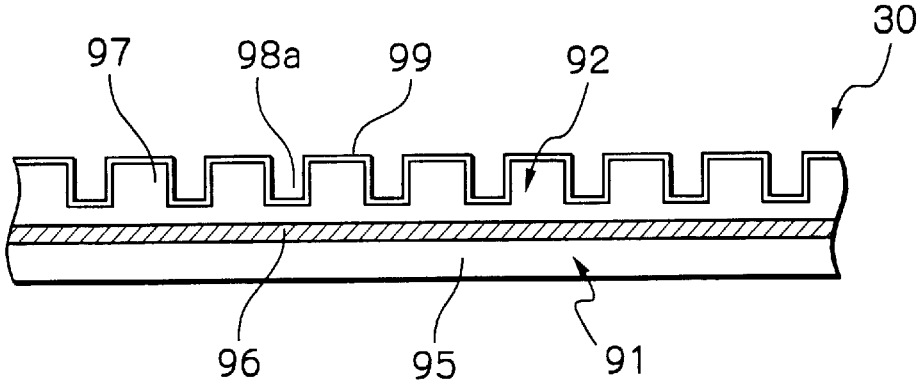
FIG. 41 is a section in a direction perpendicular to the direction of toner conveyance, also showing the second specific configuration.

Reference will be made to FIGS. 34 and 35 for describing a developing device representative of a twelfth embodiment of the present invention. As shown in FIG. 34, the developing device includes a developing roller or developing means 141 for causing toner to deposit on a latent image formed on the drum 1. A toner feeding device or classifying device 142 feeds the toner delivered from a toner hopper to the developing roller 141. The developing roller 141 maybe replaced with the toner flying device 31 stated earlier, if desired.

The toner feeding device 142 includes a number of conveyance boards 30 (including 30A and 30B) described in relation to the previous embodiments. The conveyance boards 30 each convey the toner, which is charged by a charge roller or similar charging means 143, and cause it to fly toward the developing roller 141. A return conveyance board 144 is positioned below the conveyance boards 30 in order to convey the toner toward the inlet in the reverse direction.

With the toner feeding device 142, the developing device is capable of feeding to the developing roller 141 the toner that is substantially uniform in charge and mass. In addition, the developing device is capable of collecting extremely fine toner particles without feeding them to the developing roller 141.

As shown in FIG. 35, when the conveyance boards 30 convey and fly the toner, the conveying speed and flying speed of the toner depend on the amount of charge q and mass m of the toner. Further, the distance of flight of the toner varies in dependence on the initial speed of flight, as represented by toner particles T1, T2 and T3. The toner feeding device 142 therefore causes the toner to fly toward the developing roller 41 to thereby select only toner particles that can fly a required distance (classification).

More specifically, the toner feeding device 142 collects toner particles unable to fly the required distance and returns them to the inlet side or stores them in a storing portion. At this instant, the distance of flight of small toner particles is relatively short, so that such toner particles are not fed to the developing roller 141. It is therefore possible to exclude extremely small toner particles sized less than 5 $\mu$m and therefore to uniform the particle size of toner particles expected to contribute to development. The toner feeding device 142 is similarly applicable to any one of the previous embodiments.

It is to be noted that the powder jetting device and classifying device of the present invention are applicable not only to a developing device, but also to any other device required to jet fine particles or to exclude extremely fine particles.

Thirteenth Embodiment

Hereinafter will be described a thirteenth embodiment of the present invention, particularly specific configurations of each conveyance board 30 included in a toner conveying device 31, which corresponds to the toner flying device 31.

FIGS. 36 through 39 show a first specific configuration of the conveyance board 30 included in the toner conveying device 31. As shown, the conveyance board 30 is generally made up of an electrode board or first board 91 and a path board or second board 92 stacked on the conveyance board 91. The electrode board 41 includes an elongate, flat substrate 95 and a number of electrodes 96 arranged on the substrate 95. The electrodes 96, each three of which make a set, each extend in the direction substantially perpendicular to the direction of toner conveyance. The path board 92 includes an insulative substrate 97 formed with channel-like paths 98 and forming a conveying surface. The paths 98 linearly extend in the direction of toner conveyance and are positioned at preselected intervals in the direction perpendicular to the direction of toner conveyance. A coating layer 99 is formed on the surface of the substrate 97 and exerts smaller contact resistance than the substrate 97 with respect to the toner.

The substrate 95 may be formed of glass, resin, ceramics or similar insulating material or SUS or similar conductive material coated with $SiO_2$ or similar insulating film.

To form the electrodes 96, a film of Al, Ni—Cr, TiN or polysilicon or similar conductive material or Ti, W, Mo or similar high-temperature metal is formed on the substrate 95 and then patterned by photolithography or similar semiconductor technology. The electrodes 96 should preferably be arranged in a density that is one-third to 100 times, particularly one-half to five times, as great as the particle size of toner in terms of lines per space (L/S). This makes toner conveyance desirable in speed and amount. Each electrode 96 should preferably have a width that is one time to three times as great as the particle size of toner in order to guarantee desirable toner conveyance.

The insulative substrate 97 of the path board 92 is implemented as a film of polyimide, $SiO_2$ or $Ta_2O_5$ by way of example and 0.5 $\mu$m to 1 $\mu$m thick. $Ta_2O_3$ has a specific inductive capacity of 28. When use is made of polyimide whose specific inductive capacity is about 3.6, the apparent, specific inductive capacity of polyimide can be increased to 10 to 12 if about 1% of fine $BaTiO_3$ is added in the event of coating.

By increasing the specific inductive capacity of the substrate 97, it is possible to lower required drive voltage and to promote the bounce of the toner particles and high-speed conveyance. Therefore, to surely convey the charged toner by low voltage at a speed that allows the toner to fly, the substrate 97 should preferably be formed of a material whose specific inductive capacity is 10 or above. It was experimentally found that a 1 $\mu$m thick polyimide film required a drive voltage of DC 500 V, but derived an acceptable result with a drive voltage of 300 V when about 1% of fine $BaTiO_3$ particles were added.

The paths 98 are implemented as channels capable of efficiently guiding the toner in the direction of toner conveyance. Further, the paths 98 and electrodes 96 should only cross each other. While the paths 98 and electrodes 96 are shown as being substantially perpendicular to each other, the crux is that the paths 98 and electrodes 96 be not parallel to each other. However, the paths 98 and electrodes 96 should preferably cross each other at an angle of 450° to 900° in order to promote efficient toner conveyance.

The coating layer 99 reduces contact resistance between the conveying surface, i.e., the bottoms of the paths 98 and the charged toner. For this purpose, the coating layer 99 should preferably be formed of a material whose critical surface tension is 30 dyne/cm or below, e.g., PTFE, PFA or similar fluorine-containing resin. Fluorine-containing resin implements the coating layer 49 at low cost.

FIGS. 40 through 43 show a second specific configuration of the conveyance board 30. As shown, the insulative substrate 97 of the path board 92 is formed with two groups of channel-like paths 98*a* and 98*b*. The paths 48*a* linearly extend in the direction of toner conveyance and are formed at preselected intervals in the direction perpendicular to the above direction. The paths 98*b* intersect the paths 98*a* at an angle of 45° and are also arranged at preselected intervals. As for the rest of the configuration, the second specific configuration is identical with the first specific configuration.

Figure 44:
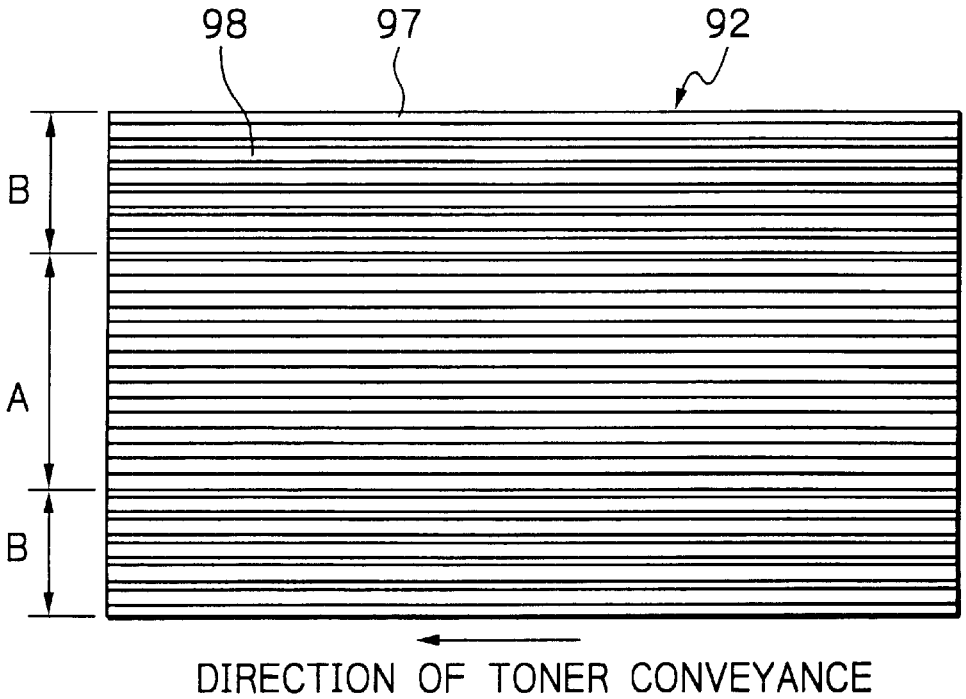
FIG. 44 is a view showing a third specific configuration of the toner conveying device.

FIG. 44 shows a third specific configuration of the conveyance board 30. As shown, the insulative substrate 97 of the path board 92 is formed with the paths 98 extending in the direction of toner conveyance as in the first specific configuration. The surface of the substrate 97 is covered with the coating layer 99. In this specific configuration, the paths 98 are arranged more densely at opposite zones B in the direction perpendicular to the direction of toner conveyance than at the intermediate zone A (B>A). As for the rest of the configuration, this specific configuration is identical with the first specific configuration.

Figure 45:
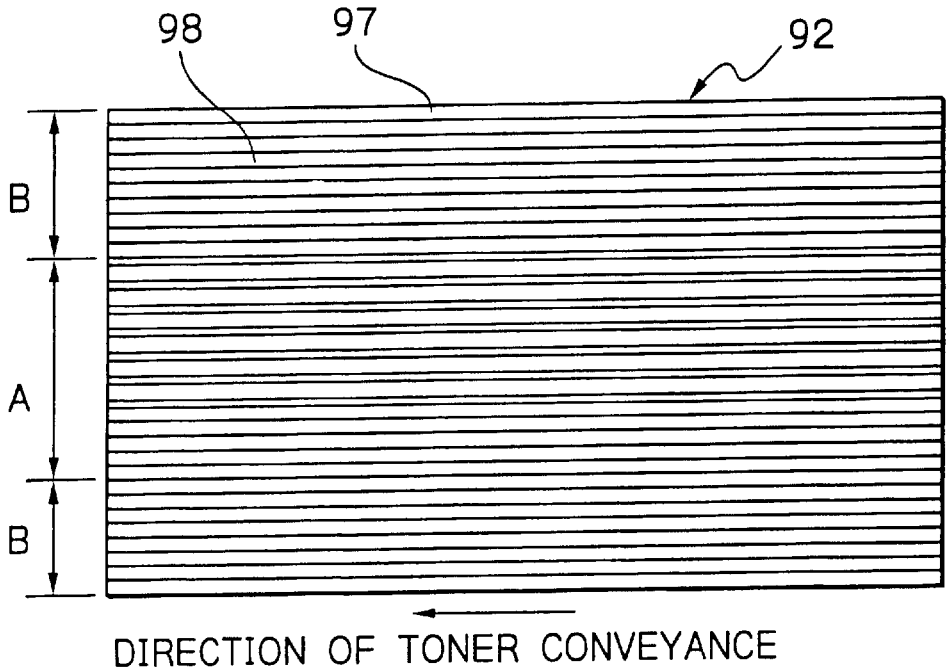
FIG. 45 is a plan view showing a fourth specific configuration of the toner conveying device.

FIG. 45 shows a fourth specific configuration of the conveyance board 30. As shown, the insulative substrate 97 of the path board 92 is formed with the paths 98 extending in the direction of toner conveyance as in the first specific configuration. The surface of the substrate 97 is covered with the coating layer 99. In this specific configuration, the paths 98 are arranged more densely at the intermediate zone A in the direction perpendicular to the direction of toner conveyance than at opposite zones B (A>B). As for the rest of the configuration, this specific configuration is identical with the first specific configuration.

Figure 46:
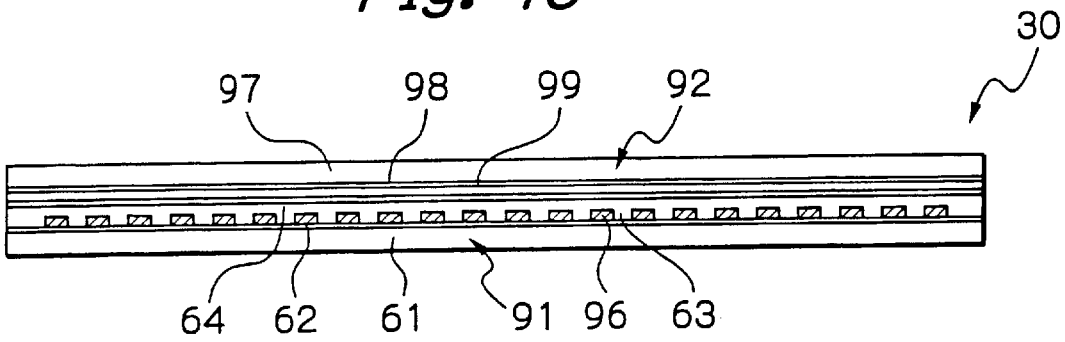
FIG. 46 is a section in the direction of toner conveyance, showing a fifth specific configuration of the toner conveying device.
Figure 47:
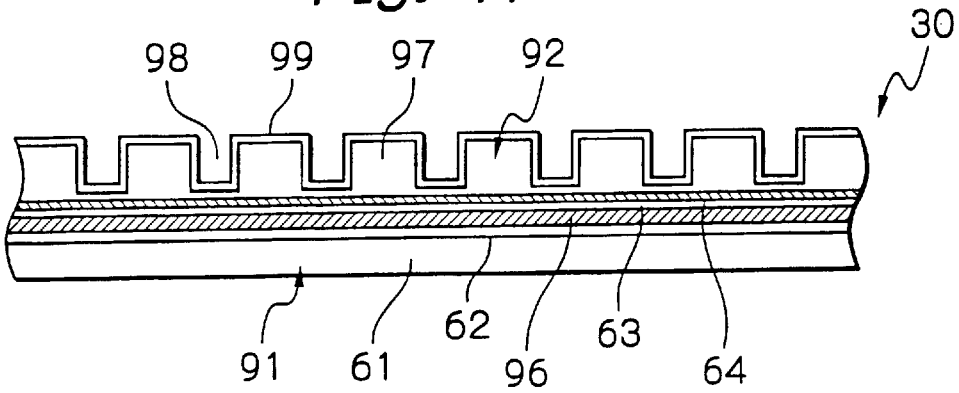
FIG. 47 is a section in the direction perpendicular to the direction of toner conveyance, also showing the fifth specific configuration.

FIGS. 46 and 47 show a fifth specific configuration of the conveyance board 30. As shown, the electrode board 91 includes an insulation film 62 formed on a substrate 61 and the electrodes 96 arranged on the insulation film 62. An insulation film 63 covers the entire surface of the insulation film 62 inclusive of the electrodes 96. Further, a semiconductor film or shield layer 64 is formed on the insulation film 63. The conveyance board 92 is bonded to the semiconductor film 64, so that the semiconductor film 64 intervenes between the electrodes 96 and the path board 92. The semiconductor film 64 is connected to ground although not shown specifically. The semiconductor film 64 playing the role of a shield layer may be replaced with a conductor film, if desired.

Figure 48:
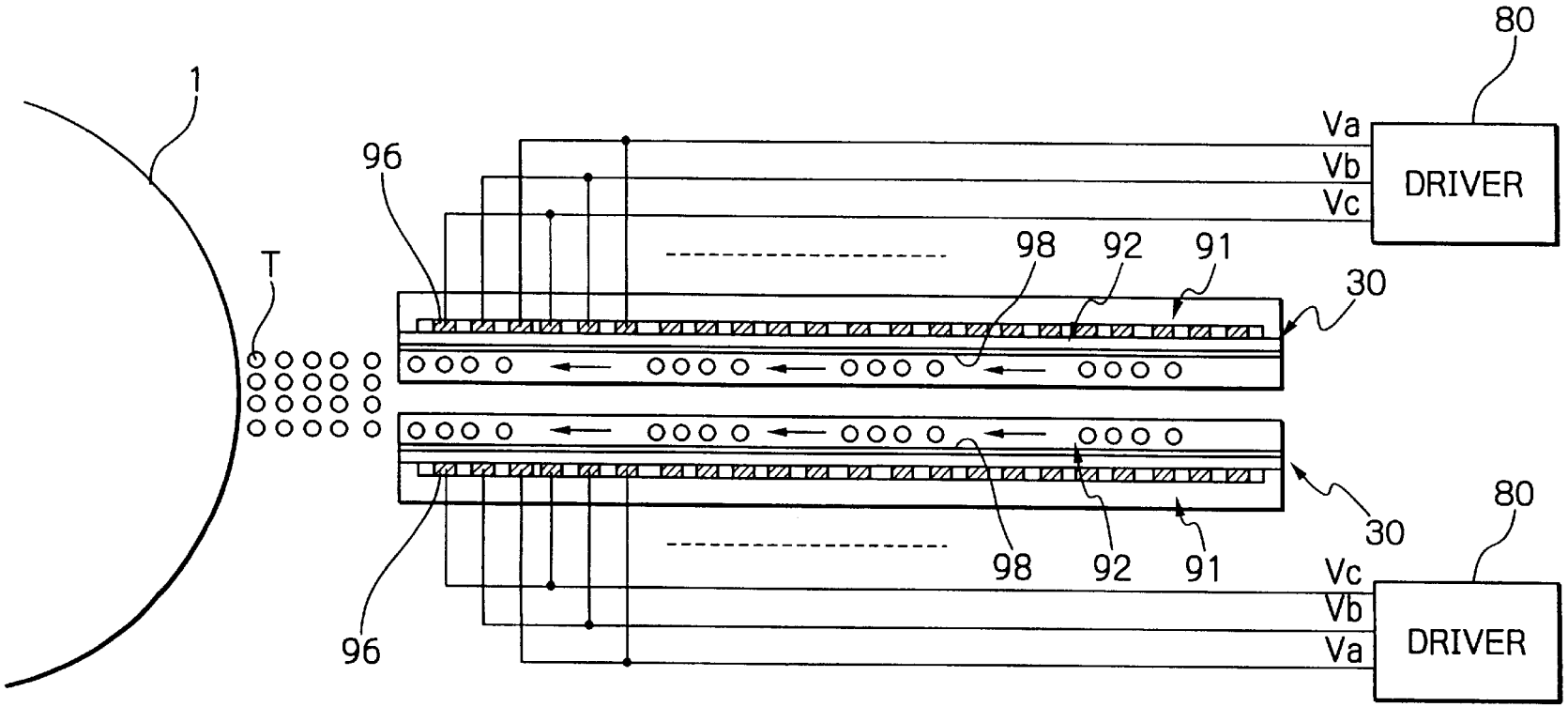
FIG. 48 is a schematic block diagram showing drive circuitry included in the fifth specific configuration.

Referring to FIGS. 48 through 53, how the conveyance boards 30 of the toner conveying device 31 conveys the toner will be described. As shown in FIG. 48, the toner conveying device 31 includes two drivers 80 each for applying three-phase drive waveforms Va, Vb and Vc to each group of three electrodes 96 of one conveyance board 30. Some delay is provided between the drive waveforms Va, Vb and Vc output from each driver 80. The drive waveforms Va, Vb and Vc each selectively take a positive potential, a negative potential and zero potential (not applied).

Figure 49:
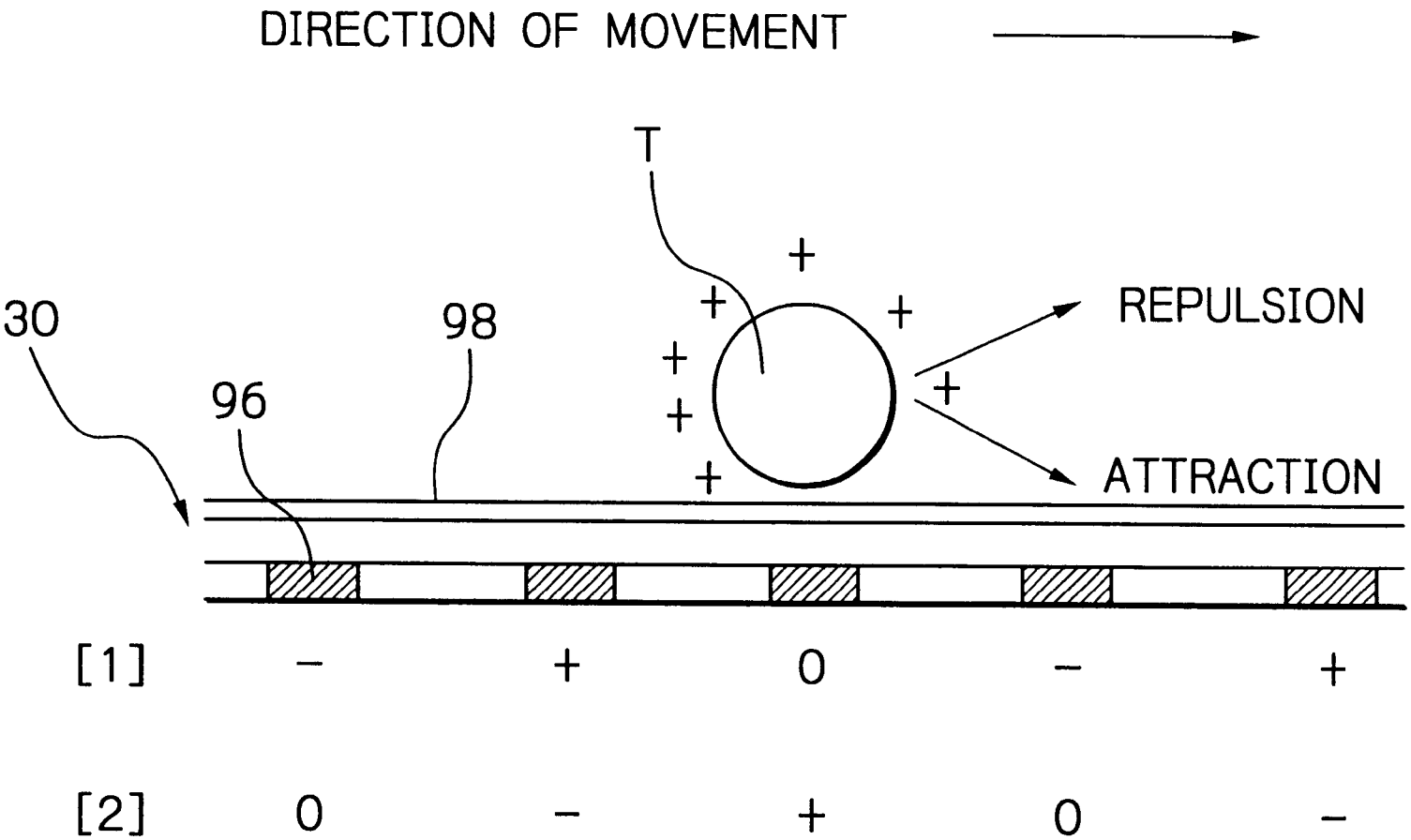
FIG. 49 is a view for describing the principle of operation of the fifth specific configuration.

As shown in FIG. 49, assume that a toner particle T charged to positive polarity is positioned on the conveyance board 30. Also, assume that the potentials "−", "+", "0", "−" and "+" are respectively applied to the consecutive electrodes 96 on the board 30, as indicated by row [1]. Further, assume that the toner particle T is positioned on the "0" electrode 96. Then, repulsion acts between the toner particle T and the "+" electrode 96 positioned at the left-hand side of the "0" electrode 96, as viewed in FIG. 49. At the same time, attraction acts between the toner particle and the "−" electrode 96 positioned at the right-hand side of the "0" electrode 96. As a result, the toner particle T moves to the "−" electrode 96.

Figure 50:
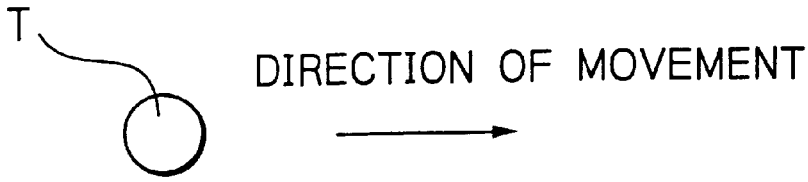
FIGS. 50 through 53 are tables each showing a particular specific pattern in which drive waveforms vary in the fifth specific configuration.

Assume that the driver 80 applies the three-phase drive voltages Va, Vb and Vc to each three electrodes 96 in a specific pattern shown in FIG. 50. Then, the voltages indicated in row [1] of FIG. 49 are replaced with voltages "0", "−", "+", "0" and "−" indicated in row [2] Consequently, no force acts between the toner particle T and the electrode 96 changed from "−" to "0". At the same time, repulsion acts between the toner particle T and the electrode 96 changed from "0" to "−" while attraction acts between the toner particle T and the electrode 42 changed from "+" to "−". The toner particle T therefore moves further to the "−" electrode 96.

As stated above, the potentials of the drive waveforms applied to the electrodes 96 are varied to apparently move the drive waveforms, so that the toner particle T sequentially moves toward the "−" electrode 96. That is, the toner particle T is conveyed along the conveying surface of the conveyance board 30. The pattern shown in FIG. 50 will be reversed when the toner particle is charged to negative polarity. Let the following description concentrate on toner charged to positive polarity.

Figure 51:
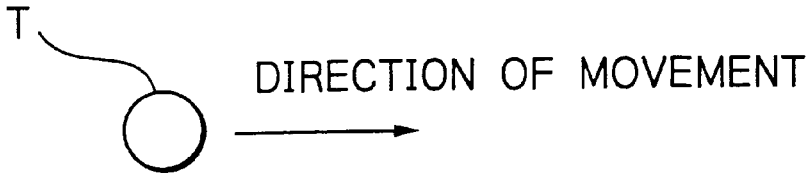

FIG. 51 shows another specific pattern of the three-phase drive voltages Va, Vb and Vc that does not include "0". As shown, a "−" drive waveform is applied to two adjoining ones of three electrodes 96 while a "+" drive waveform is applied to the remaining electrode 96. This is also successful to convey the positively charged toner T along the surface of the conveyance board 30.

Figure 52:
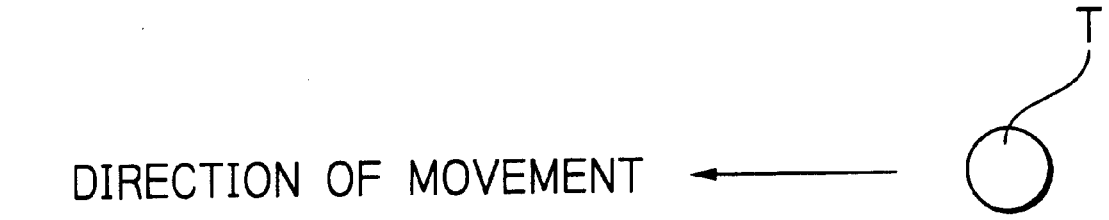
Figure 53:
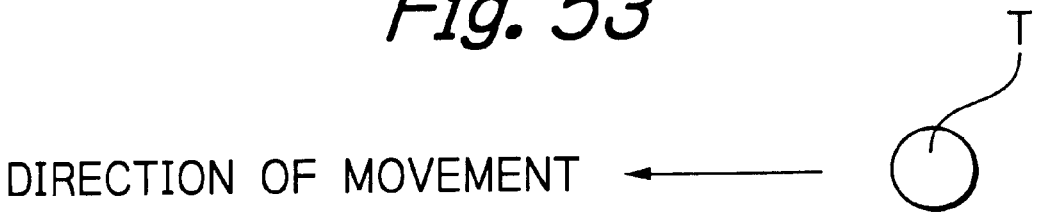

FIG. 52 shows a Va, Vb and Vc pattern opposite to the pattern of FIG. 50. This pattern allows the positively charged toner T to be conveyed in the direction opposite to the direction shown in FIG. 49. Further, FIG. 53 shows a pattern opposite to the pattern of FIG. 51 and causing the positively charged toner T to be conveyed in the reverse direction.

The paths or channels 98 each including a conveying surface are formed in the insulative substrate 97 and reduce contact resistance, as stated earlier. The paths 98 therefore allow a sufficient conveying force to act on the toner and thereby insure sure conveyance of a great amount of toner.

The first to fourth specific configurations of the conveyance board 30 will be described more specifically hereinafter.

The conveyance board 30 of the first specific configuration had the following configuration. The substrate 95 of the electrode board 91 was formed of low-expansion glass and etched to form recesses (grooves) for forming the electrodes 96. Subsequently, an Al, Ni—Cr or similar film was formed on the entire substrate 95 and then patterned to form the stripe-like electrodes 96 by photolithography. On the other hand, the insulative substrate 92 of the other conveyance board 92 was implemented by a 150 $\mu$m thick, polyimide film and formed with a 50 $\mu$m wide pattern having a pitch of 40 $\mu$m and perpendicular to the electrodes 96 of the conveyance board 91. Subsequently, the polyimide film was etched to a depth of 100 $\mu$m to 140 $\mu$m in an oxygen environment to thereby form the paths 98.

Thereafter, the substrate or polyimide film 97 and substrate or low-expansion glass 95 were laid on each other such that the paths 98 and electrodes 96 are substantially perpendicular to each other, and then bonded together by heat and pressure. Subsequently, PFA, PTFE or similar fluorine-containing resin whose critical surface tension was 30 dyne/cm or below was coated on the entire surface of the conveyance board 92 in order to reduce contact resistance.

Experiments showed that when the driver 80, FIG. 48, applied the drive waveforms to the conveyance board 30, charged toner moved in the expected direction.

Figure 42:
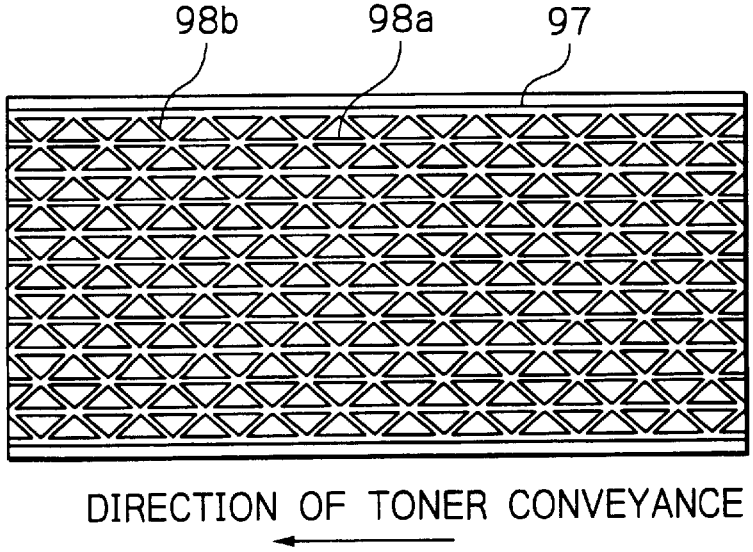
FIG. 42 is a plan view of a conveyance board included in the second specific configuration.
Figure 43:
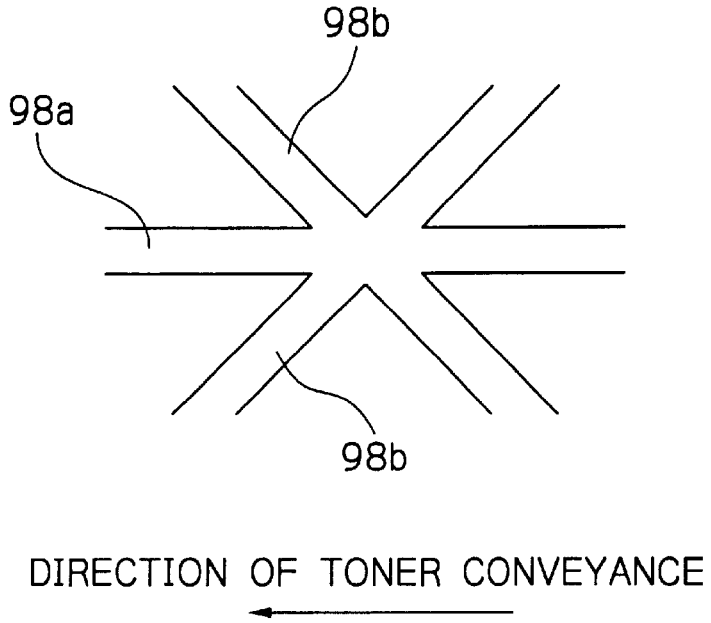
FIG. 43 is an enlarged plan view of part of FIG. 42.

The conveyance board 30 of the second specific configuration had the following configuration. The substrate 95 of the electrode board 91 was formed of low-expansion glass and etched to form recesses (grooves) for forming the electrodes 96. Subsequently, a film of Al, Ni—Cr or similar electrode material was formed on the entire surface of the substrate 95 and then etched to form the stripe-like electrodes 96 by photolithography. A 0.1 $\mu$m to 0.2 $\mu$m thick, insulation film was formed on the entire substrate 95 over the electrodes 96 except for the lead portions of the electrodes 96. Dry film resist was bonded to the insulation film in order to form the insulative substrate 97. The paths or channels 98*a* and 98*b* were formed in the dry film resist, as shown in FIG. 42. Thereafter, PFA, PTFE or similar fluorine-containing resin was coated on the entire dry film resist to thereby form the coating layer 99. The gap between the bottoms of the paths 98*a* and 98*b* and the electrodes 96 was 0.3 $\mu$m to 2.2 $\mu$m.

When the driver 80, FIG. 48, applied the drive waveforms to the conveyance electrode 30, charged toner successfully moved in the expected direction.

The third specific configuration was identical with the first specific configuration except that the paths 98 of the conveyance board 30 was arranged at a density of 150 dpi (dots per inch) at the intermediate zone A and a density of 300 dpi at the opposite side zones B. The fourth specific configuration was identical with the first specific configuration except that the paths 98 had a density of 300 dpi at the intermediate zone A and a density of 150 dpi at the opposite side zones B.

When the driver 80, FIG. 48, applied the drive waveforms to the conveyance boards 30 of the third and fourth specific configurations, charged toner successfully moved in the preselected direction.

Experiments were conducted with the specific configurations described above in order to estimate the scattering of toner and the conveyance of toner toward the outlet facing the drum 1 by video observation. The scattering of toner was not observed in any one of the specific configurations. This is presumably because the conveyance board 30 intensely retained toner with an electrostatic force. As for the conveyance of toner, the second specific configuration was most desirable; the third, fourth and first specific configurations derived better results in this order. This is presumably because conveyance depends on the density of the paths 98 to the end, which faced the drum 1, and the gap between the electrodes 96 and the bottoms of the paths 98 (98*a* and 98*b*). It follows that the gap between the electrodes 96 and the paths 98 should preferably be between 0.1 $\mu$m and 50 $\mu$m, more particularly between 0.5 $\mu$m and 10 $\mu$m.

In the fifth specific configuration, the insulator forming the paths 98 are apt to bring about residual charge. However, the semiconductor film 64 or similar shield layer releases the residual charge and therefore prevents the electrostatic force from decreasing due to the residual charge to thereby enhance reliability.

Even a single conveyance board 30 suffices for conveying the charged toner. In the illustrative embodiment, too, two conveyance boards 30 are positioned with their conveying surfaces facing each other. The conveyance boards 30 are spaced from each other by 30 $\mu$m to 200 $\mu$m. A plurality of conveyance boards 30 increase the amount of toner to fly for a unit period of time.

Figure 54:
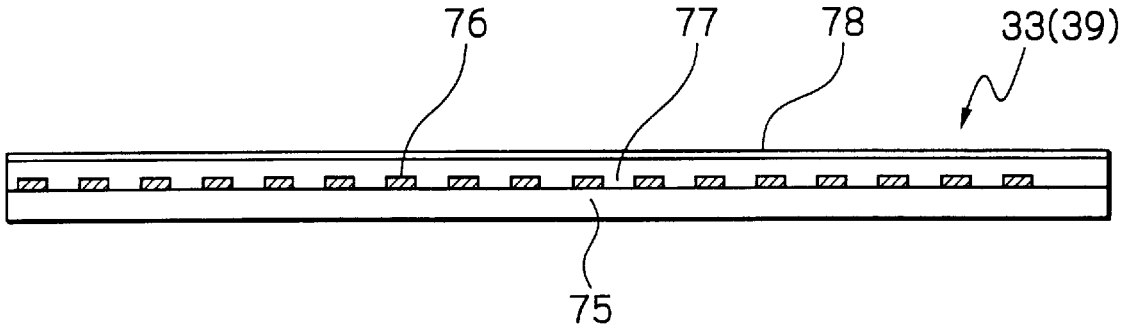
FIG. 54 is a view showing path members and return members included in the developing device.

Reference will also be made to FIG. 54 for describing the path members 33 and return members 39. As shown, the path members 33 and return members 39 each include an insulative FPC substrate 71 on which a number of electrodes 76 are arranged; each three electrodes 76 make a set. The substrates 71 extend in the direction substantially perpendicular to the direction of toner conveyance. A member 77 for forming a conveying surface is formed on the electrodes 72. A coating layer or film 78 is formed on the surface of the member 77 in order to reduce contact resistance between the member 73 and the toner.

The path members 33 and return members 39, like the conveyance board 30, electrostatically convey charged toner when drive voltages are applied to the electrodes 76. The electrodes 76, member 77 and coating layer 78 may be respectively formed of the materials described in relation to the electrodes 96, insulative substrate 97, and coating layer 99. Further, the members to be formed with such electrodes each may be formed of a deformable material in order to facilitate arrangement, if desired. This is also true with any one of the conveyance boards shown and described.

Figure 55:
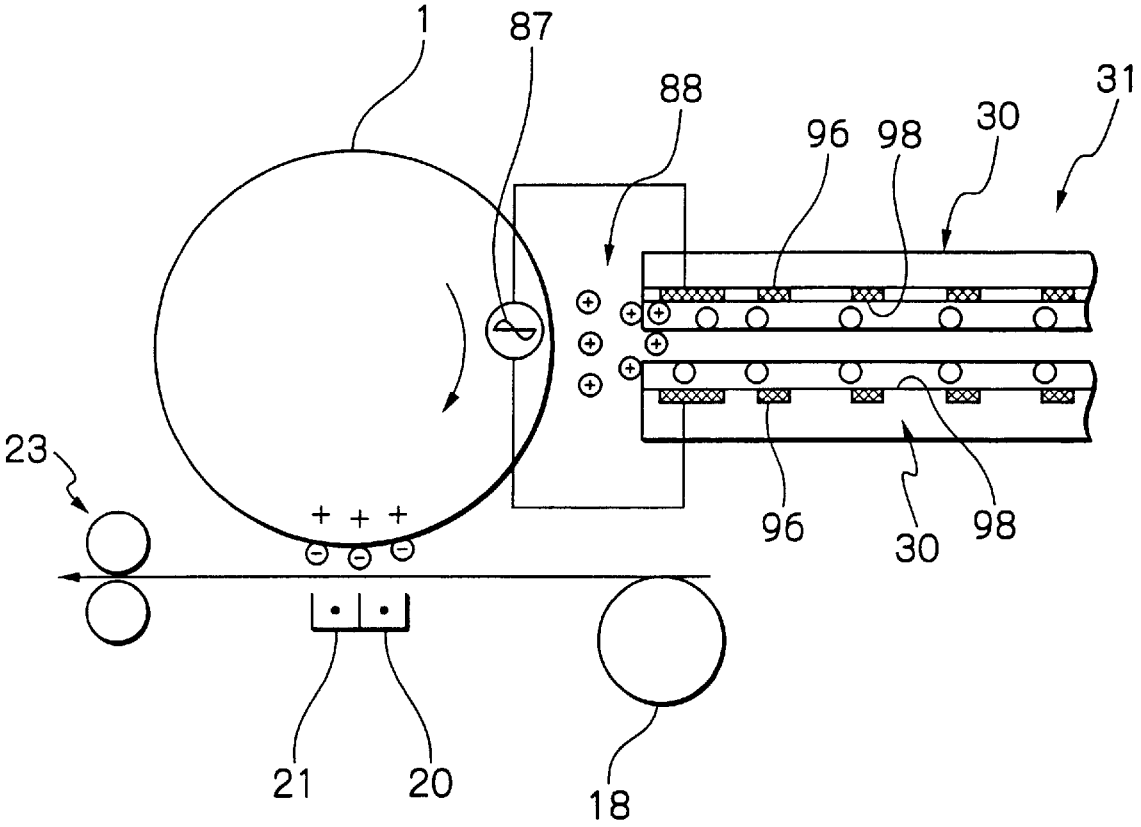
FIG. 55 is a view for describing the principle of development unique to the image forming apparatus.

Development using the developing device 16 will be described hereinafter with reference also made to FIG. 55. As shown, the toner particles with positive charge fly from the toner conveying device 31 toward the end that faces the drum 1 by being conveyed by the conveyance boards 30. The toner particles are then jetted toward the drum 1 and deposit on a latent image, i.e., the negatively charged portions of the surface of the drum 1, thereby developing the latent image. An AC power supply 87 may be connected to the outlet end of the conveyance boards 30 so as to form an AC electric field between the boards 30. The electric field causes the toner T flying toward the drum 1 to form a toner cloud 88 and evenly deposit on the latent image. The toner cloud 88 is successful to enhance image quality.

As stated above, the developing device directly deposits the toner on the drum 1 without contacting the drum 1 and is therefore simple and low cost.

Further, the illustrative embodiment deteriorates the toner less than conventional developing means using a developing roller. Specifically, it is a common practice with developing means to deposit frictionally charged toner on a developing roller together with a carrier, cause the toner electrostatically deposited on the carrier to form a magnet brush, and then bring the magnet brush into contact with an image carrier for thereby developing a latent image. The developing roller, however, kneads the toner or smashes it into fine powder. As a result, $SiO_2$, $TiO_2$ or similar additive is rubbed into the resin of the toner to thereby deteriorate the characteristics of the toner. The illustrative embodiment solves this problem.

Furthermore, in the illustrative embodiment, the toner is conveyed to the image carrier without a developing roller or similar developer carrier being rotated. This obviates the cohesion of the toner in the developing device and electrostatically deposits the toner to thereby reduce the scattering of the toner via seals around the developing section and enhance image quality. In addition, the developing device, which does not need any special material, is compact and low cost.

Figure 56:
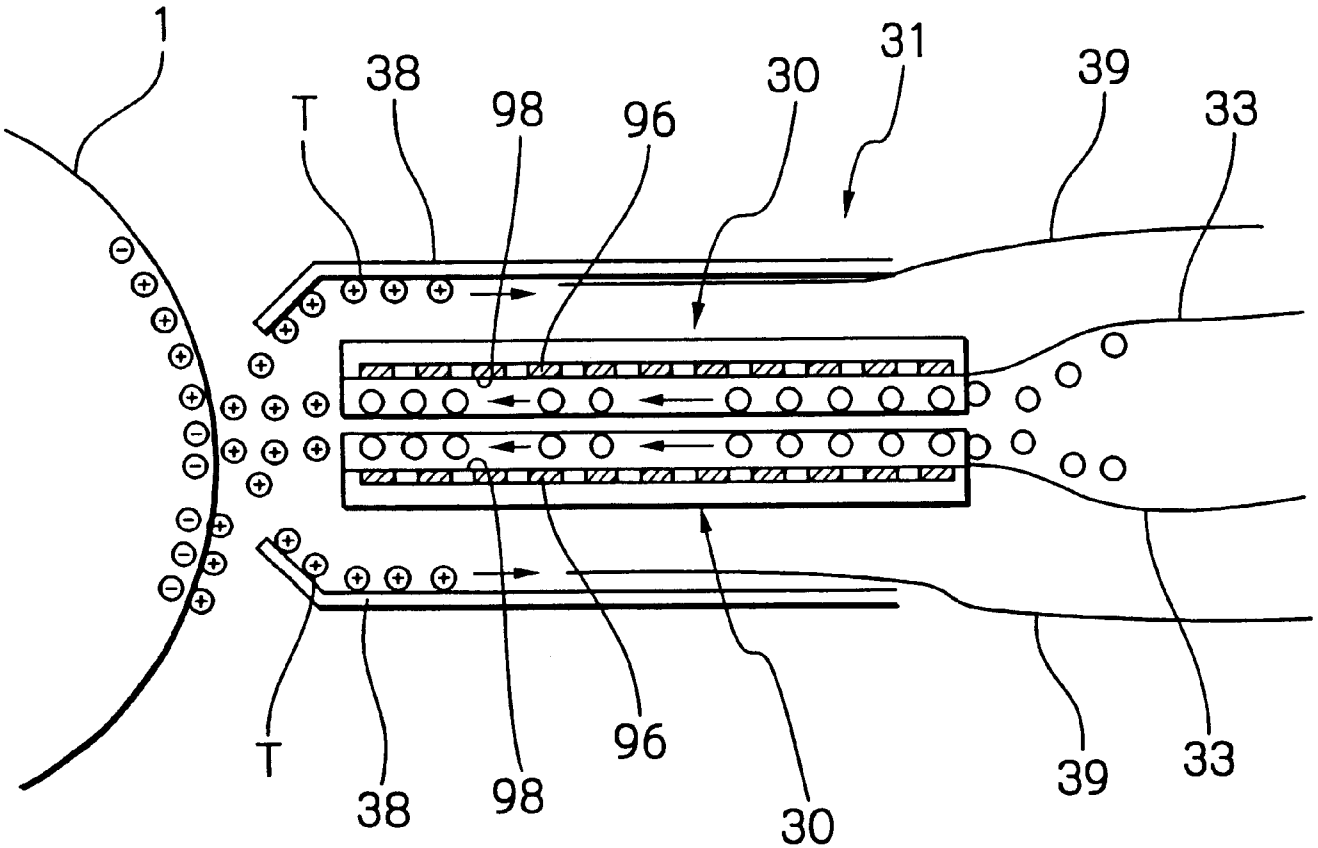
FIG. 56 is a view for describing toner collection practicable with the image forming apparatus.

The collection of the toner will be described with reference also made to FIG. 56. While the toner flies out of the conveyance boards 30 to deposit on the latent image formed on the drum 1, not all toner particles are used for development, as stated earlier. As shown in FIG. 56, the toner gutters 38 are positioned outside of the conveyance boards 30 and cause the toner particles not used for developing and tending to fly about to deposit on the toner gutters 38. The return members 39 convey the above toner particles toward the inlet in the same manner as the conveyance boards 30. Consequently, such toner particles are collected in the toner box 32 and used again.

As stated above, returning means collects the toner not used for development and thereby prevents it from being scattered around. Further, the collecting means includes means for electrostatically returning the collected toner toward the inlet. This successfully promotes the reuse of the toner and thereby reduces the cost.

If desired, a bias voltage of the same polarity as the toner and a bias voltage opposite in polarity to the toner may be alternately applied to each toner gutter 38 in order to selectively attract or repulse the toner. In such a case, the toner will be collected and then returned to the outlet of the conveyance board 30 to be reused thereby. This configuration makes it needless to return the collected toner to the toner box 32.

Fourteenth Embodiment

Figure 57:
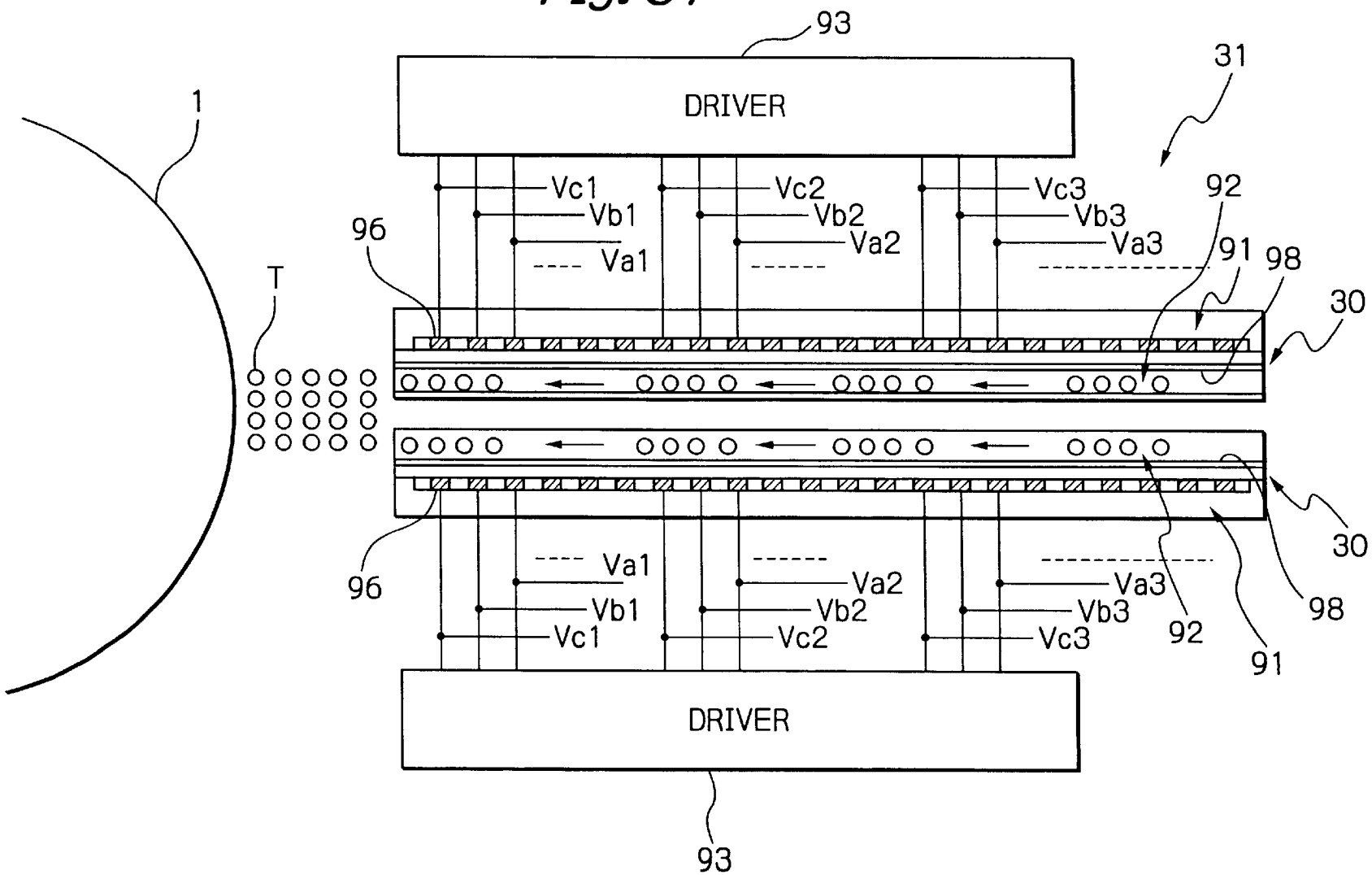
FIG. 57 is a view showing a fourteenth embodiment of the present invention.

FIG. 57 shows a fourteenth embodiment of the present invention, particularly the toner conveying device 31 thereof. As shown, drivers 93 each apply to the electrodes 96 three-phase drive waveforms Va1, Vb1 and Vc1 having a frequency f1, three-phase drive waveforms Va2, Vb2 and Vp2 having a frequency f2, and three-phase drive waveforms Va3, Vb3 and Vc3 having a frequency f3 (f1>f2>f3).

More specifically, the driver 93 applies the drive waveforms Va1, Vb1 and Vc1 to part of the electrodes 96 lying in a preselected zone that adjoins the outlet. The driver 93 applies the drive waveforms Va2, Vb2 and Vc2 to the electrodes 96 lying in the intermediate zone of the conveyance board 30. Further, the driver 96 applies the drive waveforms Va3, Vb3 and Vc3 to part of the electrodes 96 that lies in a preselected zone adjoining the inlet. As for the rest of the construction, this embodiment is identical with the thirteenth embodiment.

In the illustrative embodiment, the frequencies of the drive waveforms Va, Vb and Vc sequentially increase from the inlet toward the outlet stepwise, i.e., from the frequency f3 to the frequency f1. Attraction and repulsion to act on the charged toner vary in a shorter period of time as the frequency of the drive waveform increases. Therefore, the toner entered the space between the conveyance boards 30 via the inlet is sequentially accelerated as the frequency of the drive waveform increases. The toner is therefore conveyed along the conveying surfaces of the conveyance boards 30 while being accelerated.

Fifteenth Embodiment

Figure 58:
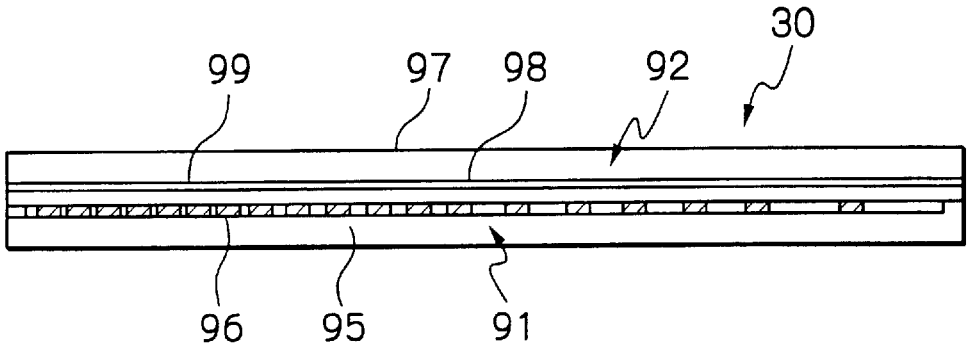
FIG. 58 is a section in the direction of toner conveyance, showing a fifteenth embodiment of the present invention.
Figure 59:
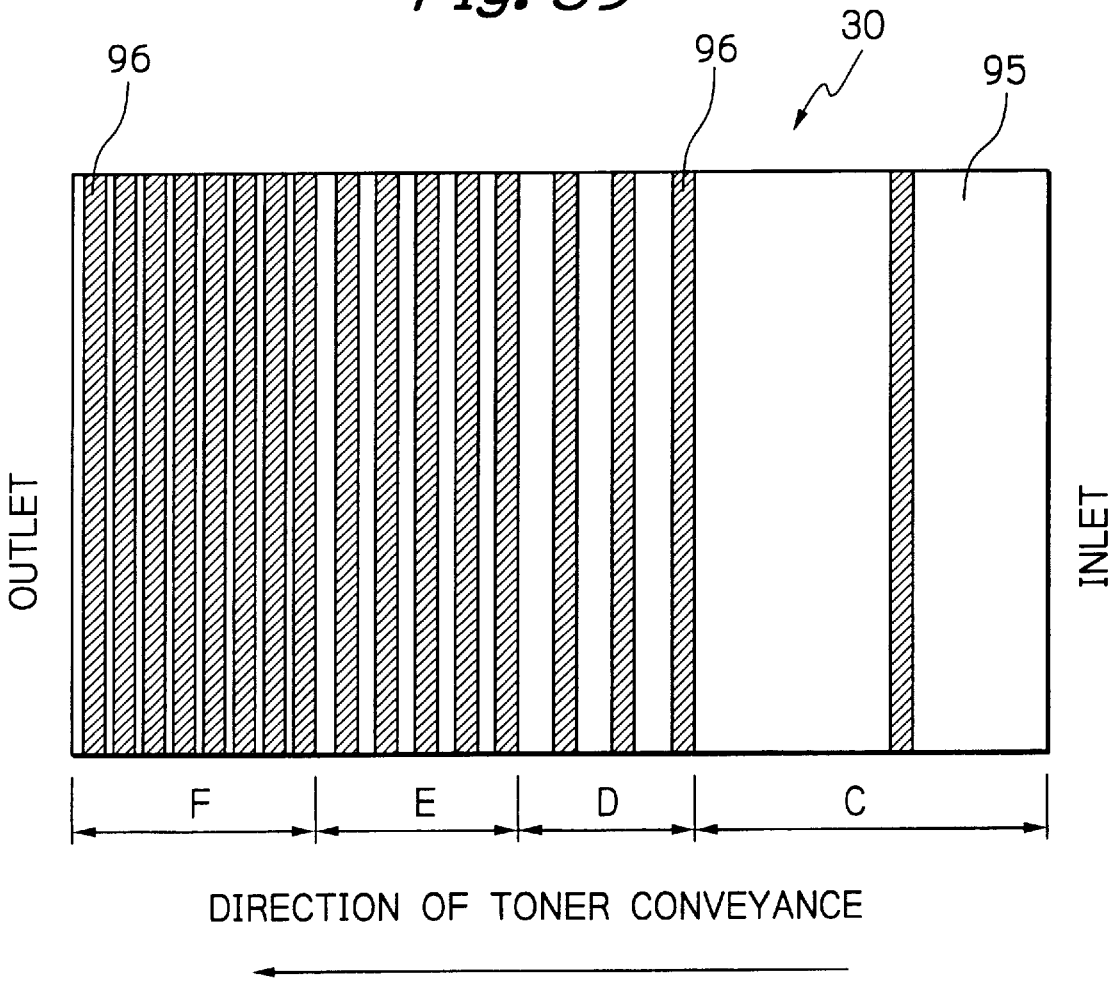
FIG. 59 is a plan view of the fifteenth embodiment.
Figure 60:
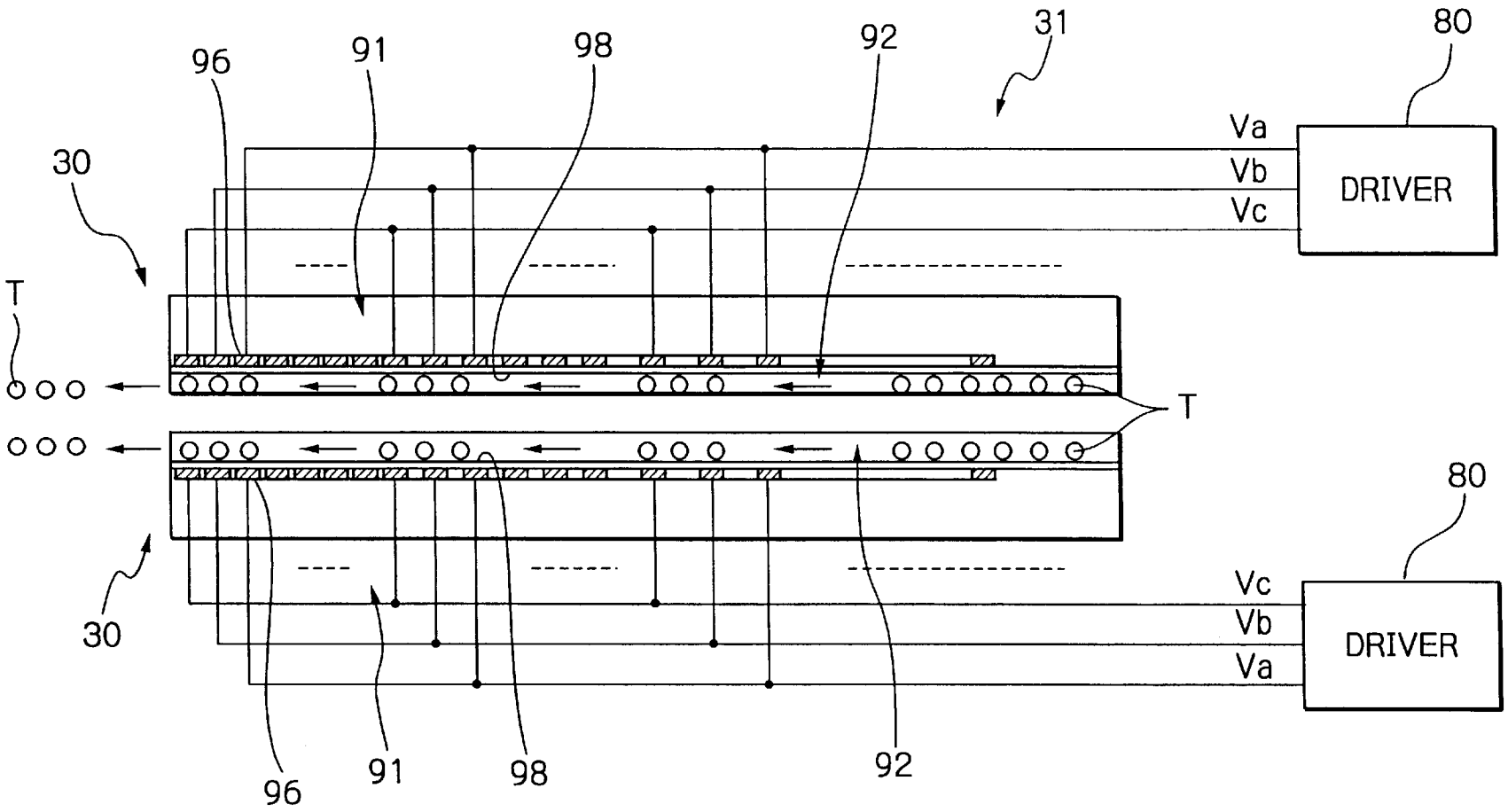
FIG. 60 is a schematic block diagram showing drive circuitry included in the fifteenth embodiment.

FIGS. 58 through 60 show a fifteenth embodiment of the present invention, particularly the toner conveying device 31 thereof. As shown, the density of the electrodes 96 is sequentially increased stepwise in the direction of toner conveyance. For example, as shown in FIG. 59, assume consecutive zones C, D, E and F beginning at the toner inlet and ending at the toner outlet. Then, the electrodes 96 are arranged at intervals of 100 $\mu$m in the zone C, at intervals of 20 $\mu$m in the zone D, at intervals of 10 $\mu$m in the zone E, and at intervals of 5 $\mu$m in the zone F. Assuming that the mean particle size of toner is 8 $\mu$m, the illustrative embodiment provides each electrode 42 with a width of 10 $\mu$m. The driver 80 of the thirteenth embodiment applies the drive voltages to the electrodes 96.

In the illustrative embodiment the distance between nearby electrodes 96 sequentially decreases from the inlet toward the outlet. Attraction and repulsion to act on the charged toner vary in a shorter period of time as the above distance decreases. Therefore, the toner entered the space between the conveyance boards 30 via the inlet is sequentially accelerated stepwise as the distance decreases. The toner therefore flies (jetted) from the outlet of the conveyance boards 30.

Sixteenth Embodiment

Figure 61:
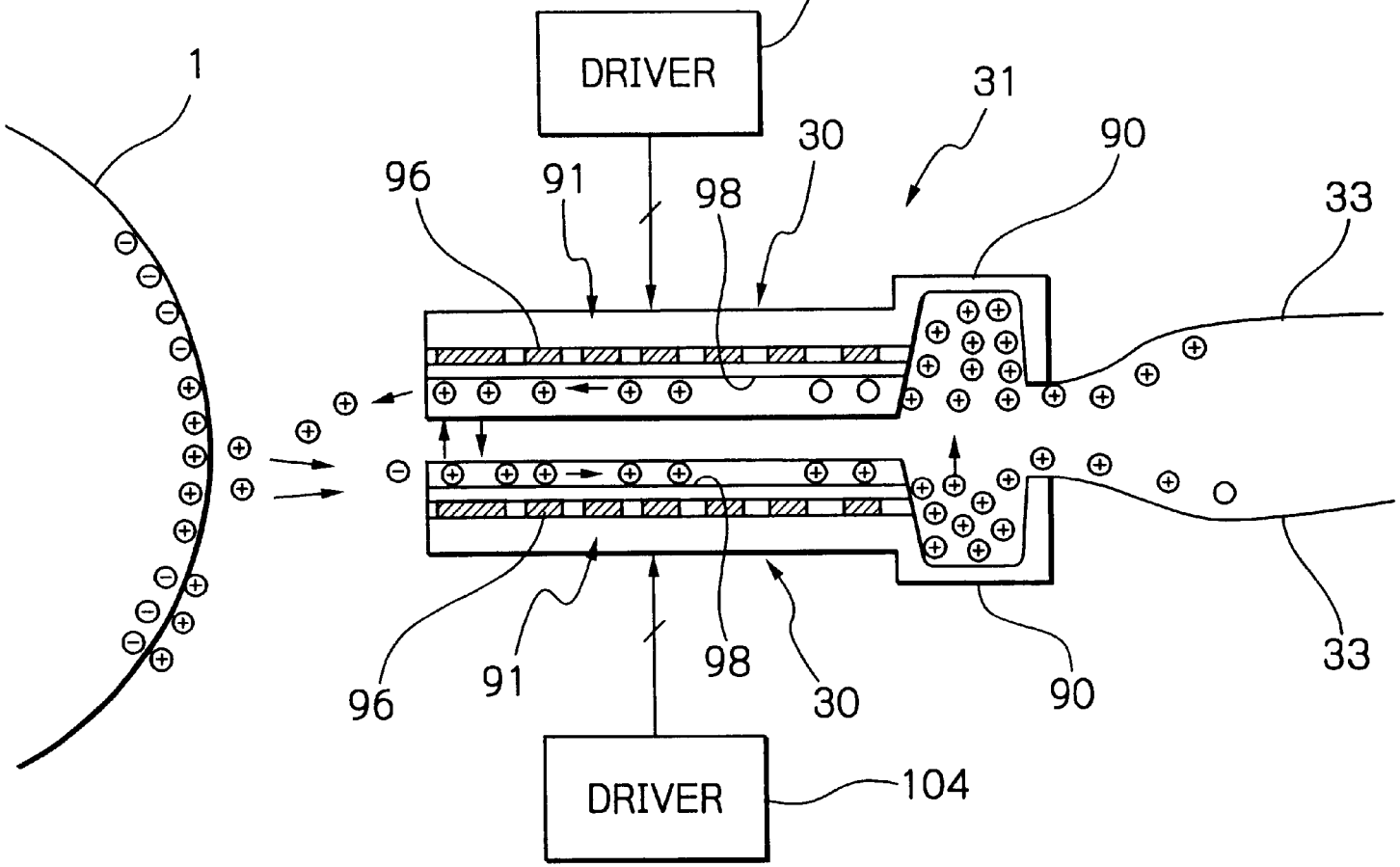
FIG. 61 is a section showing a sixteenth embodiment of the present invention.

FIG. 61 shows a sixteenth embodiment of the present invention, particularly the toner conveying device 31 thereof. As shown, the conveyance boards 30 each include a storing portion 90. A drive circuit 103 applies the drive waveforms Va, Vb and Vc, which vary in the pattern shown in FIG. 51, to the upper conveyance board 30. A drive circuit 194 applies the drive waveforms Va, Vb and Vc, which vary in a pattern shown in FIG. 53, to the lower conveyance board 30.

In the configuration shown in FIG. 61, the upper conveyance board 30 conveys the toner in the same manner as in the previous embodiments and causes it to fly toward the drum 1. On the other hand, the lower conveyance board 30 opposite in the pattern of the drive waveforms to the upper conveyance board 30 conveys the toner in the reverse direction, i.e., from the outlet toward the inlet. Therefore, the toner bouncing back without depositing on the drum 1 is conveyed from the outlet to the storing portion 90 by the lower conveyance board 30 and reused. This not only promotes the efficient use of the toner, but also prevents the bounced toner from being scattered around and thereby improves image quality.

Seventeenth Embodiment

Figure 62:
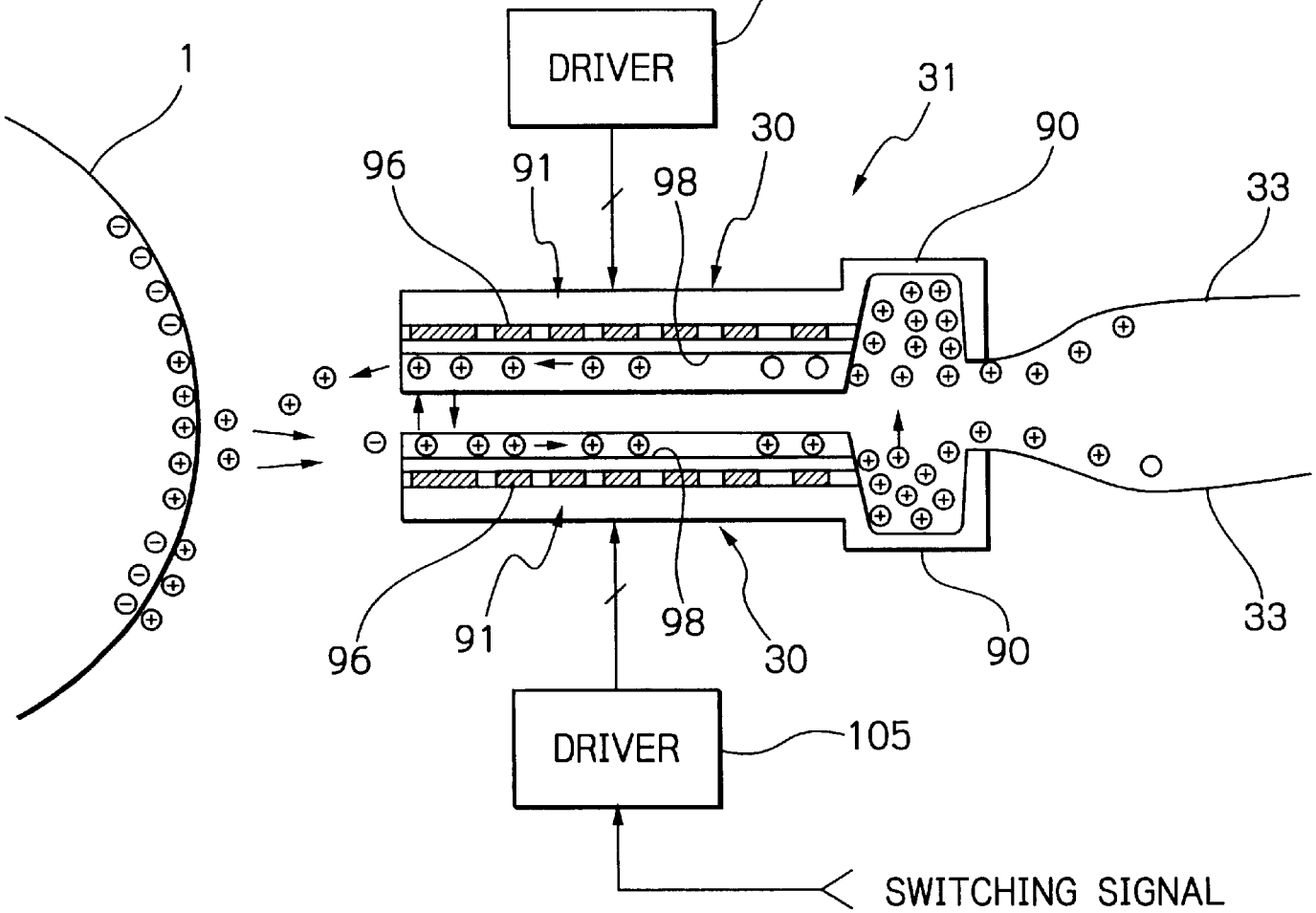
FIG. 62 is a section showing a seventeenth embodiment of the present invention.

FIG. 62 shows a seventeenth embodiment of the present invention, particularly the toner conveying device 31 thereof. As shown, the driver 71 applies the drive waveforms Va, Vb and Vc varying in the pattern of FIG. 51 to the upper conveyance board 30. A driver 105 is selectively operable in two different modes. Specifically, the driver 105 applies the drive waveforms Va, Vb and Vc varying in the pattern of FIG. 51 to the lower conveyance board 30 or applies the drive waveforms Va, Vb and Vc varying in the pattern of FIG. 53 opposite to the pattern of FIG. 51 to the same.

A controller, not shown, sends a mode switching signal to the driver 105. When the apparatus is, e.g., in a standby state, the mode switching signal causes the driver 105 to output the drive waveforms Va, Vb and Vc in the pattern of FIG. 53.

While the apparatus forms images in the usual manner, the controller causes the lower conveyance board 30, as well as the upper conveyance board 30, to apply the drive voltages Va, Vb and Vc varying in the pattern of FIG. 51. As a result, the upper and lower conveyance boards 30 both convey the toner toward the outlet and therefore by an amount two times as great as the amount available with a single conveyance board 30.

When the apparatus is in a standby state, the controller causes the lower conveyance board 30 to apply the drive voltages Va, Vb and Vc varying in the pattern of FIG. 53. The lower conveyance board 30 therefore conveys the toner in the reverse direction. In this case, the toner is simply circulated in the space between the two conveyance boards 30 without flying toward the drum 1. This prevents the toner from being scattered around more positively and thereby enhances image quality. In addition, the lower conveyance board 30, which selectively conveys the toner from the inlet to the outlet or from the outlet to the inlet, simplifies the configuration of the toner conveying device 31.

Eighteenth Embodiment

Figure 63:
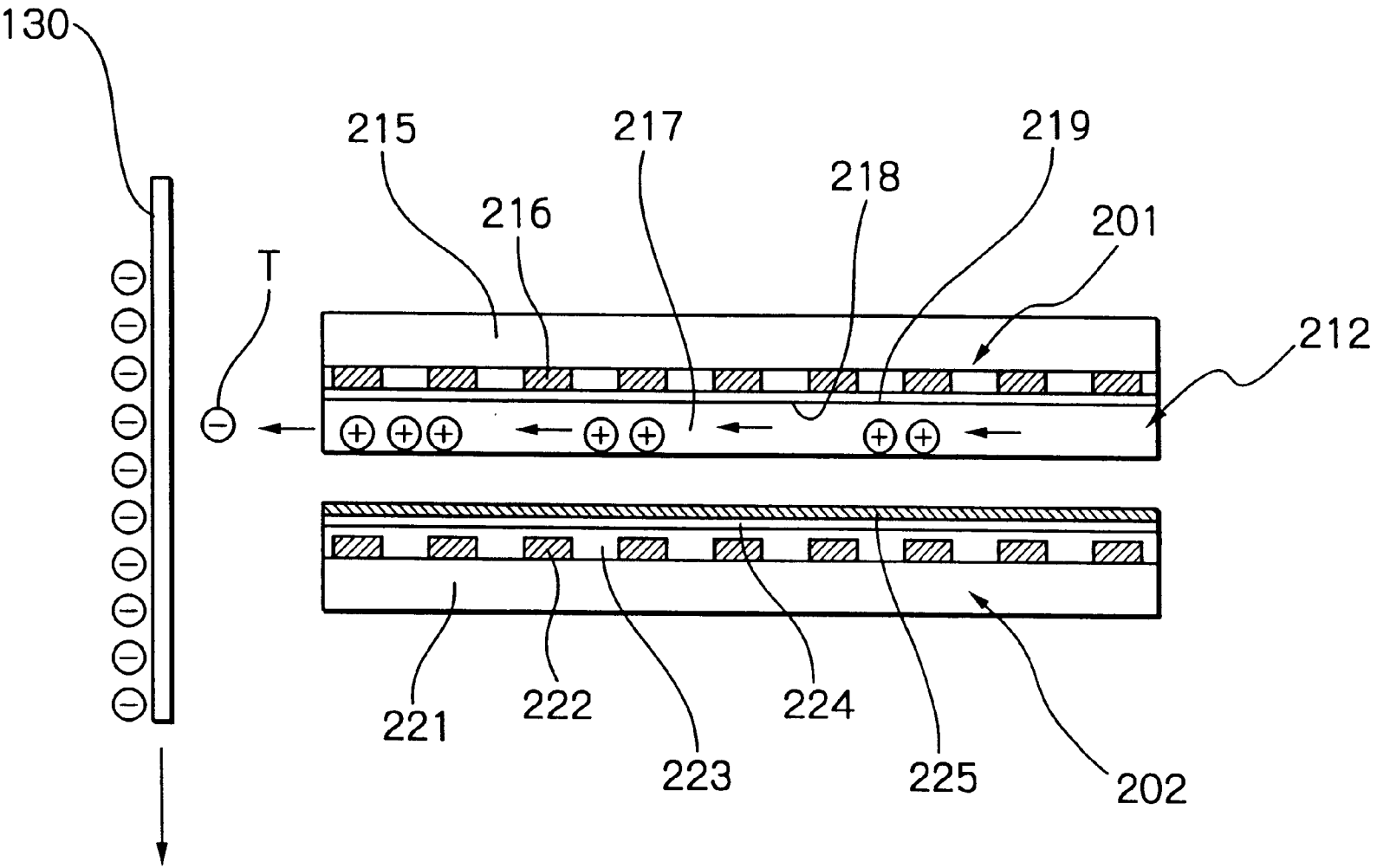
FIG. 63 is a view showing an eighteenth embodiment of the present invention.
Figure 64:
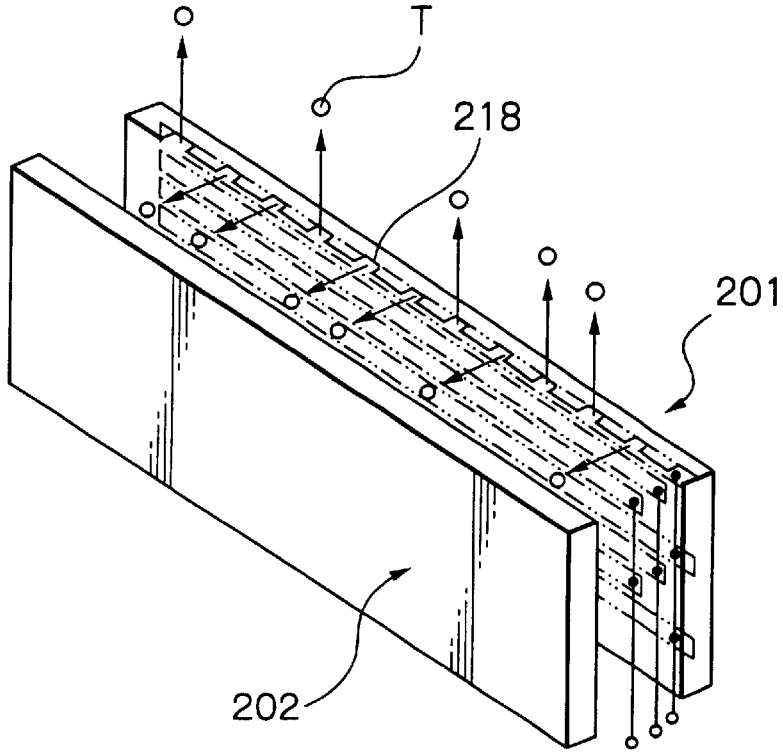
FIG. 64 is an isometric view showing a toner conveying device included in the eighteenth embodiment.
Figure 65:
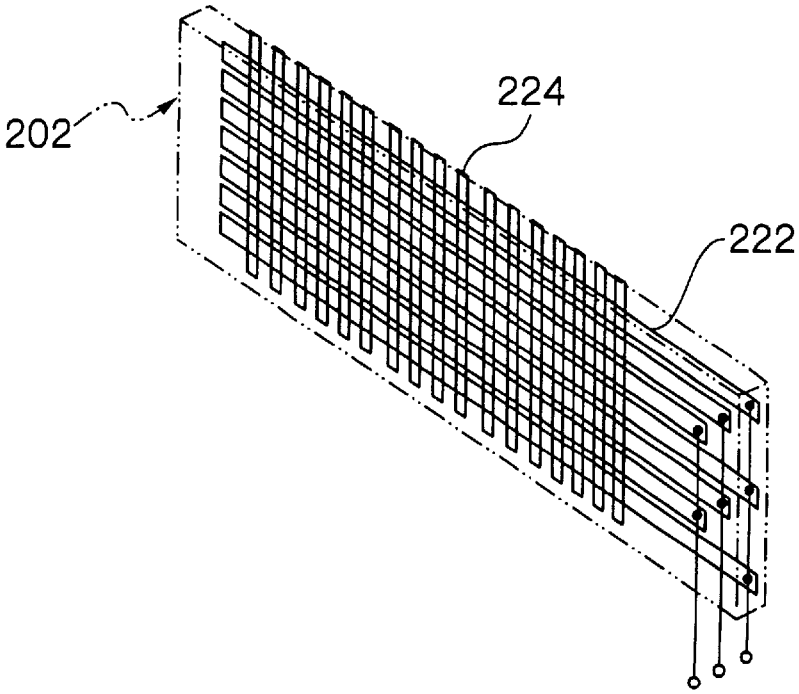
FIG. 65 is an isometric view showing a control board included in the eighteenth embodiment.

Referring to FIGS. 63 through 65, an eighteenth embodiment of the present invention will be described. As shown, the illustrative embodiment includes a toner jet head 200 for causing charged toner to fly in accordance with an image signal. The toner jet head 200 is generally made up of a conveyance board 201 and a control board 202 facing each other.

As shown in FIG. 64 also, the conveyance board 201, like the conveyance board 30, includes an electrode board or first board 218 and a path board or second board 212 bonded to each other. The electrode board 218 includes an elongate, flat substrate 215 and a number of electrodes 216 arranged on the substrate 215 at preselected intervals. The electrodes 216, each three of which make a set, each extend in the direction perpendicular to the direction of toner conveyance. The path board 212 includes an insulative substrate 212 formed with paths 218, which form a conveying surface, on a pixel basis. A coating layer or film 219 is formed on the substrate 212 in order to reduce contact resistance between the substrate and toner.

As shown in FIG. 65 also, the control board 202 includes a substrate 221. A number of first electrodes 222 are arranged on the substrate 221 for conveying the toner in the reverse direction, and each extend in the direction perpendicular to the direction of toner conveyance. An insulative protection film 223 is formed on the first electrodes 222. A number of second electrodes or pixel electrodes 224 are arranged on the protection film 223 on a pixel basis, and each extend in the direction perpendicular to the direction of toner conveyance. Further, a protection film 225 is formed on the second electrodes 224.

Drive waveforms are applied to the electrodes 216 of the conveyance board 201 in the same manner as in any one of the previous embodiments, causing the board 201 to covey the toner in the same manner as the conveyance board 30. On the other hand, drive waveforms are applied to the first electrodes 222 of the control board 202 in a pattern opposite to the electrodes 216, so that the toner is conveyed from the outlet to the inlet and simply circulated.

Assume that a drive waveform for generating an electric field that repulses the charged toner is applied to any one of the second electrodes 224 of the control board 202 in accordance with a pixel signal. Then, the toner being conveyed by the conveyance board 201 flies away from the board 201. On the other hand, when a drive waveform for generating an electric field that attracts the charged toner is applied to the electrode 224, the toner conveyed by the conveyance board 201 as far as the outlet of the board 201 is attracted by the control board 202. More specifically, by controlling the drive waveforms to be applied to the second electrodes 224 in accordance with a pixel signal, it is possible to implement an on-demand type of toner jet head that controls the flight/non-flight of the toner from the conveyance board 201 pixel by pixel.

The toner T jetted from the toner jet head 200 deposits on a recording medium 130, forming a toner image in accordance with an image signal. Subsequently, the toner image is fixed on the recording medium 130. The illustrative embodiment obviates the need for an image carrier and is therefore simple in construction. Moreover, the illustrative embodiment controls the flight/non-flight of the toner on a pixel basis to thereby circulate part of the toner that did not fly. This successfully maintains the saturation charge of the toner and thereby causes a minimum of toner to be scattered around.

Various modifications will become possible for those skilled in the art after receiving the teachings of the present disclosure without departing from the scope thereof.

What is claimed is:

1. An image forming apparatus comprising:

a) an image carrier for forming a latent image; and b) developing means for developing the latent image with charged toner, said developing means electrostatically conveying the charged toner along a conveying surface of a first conveyance board and causing said charged toner to fly from one end of said first conveyance board toward said image carrier, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface;

wherein a distance between adjacent electrodes sequentially decreases toward the one end of said first conveyance board.

2. The apparatus as claimed in claim 1, wherein:

said developing means sequentially accelerates the charged toner while conveying said charged toner.

3. The apparatus as claimed in claim 1, further comprising:

means for applying to part of said electrodes adjoining a second end of said first conveyance board, drive waveforms that provide the charged toner with an initial speed high enough for said charged toner to fly from the one end of said first conveyance board.

4. The apparatus as claimed in claim 1, wherein said developing means further includes:

a second conveyance board including a second conveying surface that faces the conveying surface of said first conveyance board.

5. The apparatus as claimed in claim 1, further comprising:

a return conveyance board for electrostatically conveying the charged toner along the conveying surface in a direction opposite to a direction of toner conveyance in which said charged toner is conveyed.

6. The apparatus as claimed in claim 1, further comprising:

collecting means for collecting the charged toner flown from the one end of said conveyance board, but not used for development.

7. The apparatus as claimed in claim 6, wherein said collecting means includes means for electrostatically conveying the charged toner collected along the conveying surface in a direction opposite to a direction of toner conveyance in which the toner is conveyed.

8. The apparatus as claimed in claim 1, wherein:

said developing means further includes at least a second conveyance board including a second conveying surface that faces the conveying surface of said first conveyance board; and said apparatus further comprises means for forming an AC electric field at respective ends of said first and second conveyance boards.

9. The apparatus as claimed in claim 1, wherein:

said developing means further includes at least a second conveyance board including a second conveying surface that faces the conveying surface of said first conveyance board; and said apparatus further comprises means for forming a DC electric field between said image carrier and said first and second conveyance boards.

10. The apparatus as claimed in claim 1, wherein:

said developing means further includes at least a second conveyance board including a second conveying surface that faces the conveying surface of said first conveyance board; and said apparatus further comprises means for forming an AC electric field at respective ends of said first and second conveyance boards, and means for forming a DC electric field between said image carrier and said first and second conveyance boards.

11. The apparatus as claimed in claim 10, wherein:

said developing means further includes at least a second conveyance board including a second conveying surface that faces the conveying surface of said conveyance board; and one of said first and second conveyance boards includes means for applying waveforms that cause the charged toner to be conveyed away from said one end.

12. The apparatus as claimed in claim 11, further comprising:

a storing portion for storing the charged toner.

13. An image forming apparatus comprising:

a) an image carrier for forming a latent image;

b) developing means for developing the latent image with charged toner, said developing means electrostatically conveying the charged toner along a conveying surface of a first conveyance board and causing said charged toner to fly from one end of said first conveyance board toward said image carrier, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface; and c) means for applying to said electrodes, drive waveforms sequentially increasing in frequency toward one or more of said electrodes adjoining the one end of said first conveyance board.

14. An image forming apparatus comprising:

a) an image carrier for forming a latent image;

b) developing means for developing the latent image with charged toner, said developing means electrostatically conveying the charged toner along a conveying surface of a first conveyance board and causing said charged toner to fly from one end of said first conveyance board toward said image carrier, said conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface; and c) means for applying to said electrodes, drive waveforms sequentially increasing in crest value toward one or more of said electrodes adjoining the one end of said first conveyance board.

15. An image forming apparatus comprising:

a) an image carrier for forming a latent image; and b) developing means for developing the latent image with charged toner, said developing means electrostatically conveying the charged toner along a conveying surface of a first conveyance board and causing said charged toner to fly from one end of said first conveyance board toward said image carrier, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface;

wherein said developing means includes at least second and third conveyance boards; and wherein an intermediate conveyance board, from among said first, second and third conveyance boards, has a conveying surface on both sides thereof.

16. A developing device configured to develop a latent image formed on an image carrier with charged toner, the device comprising:

a first conveyance board having a conveying surface and configured to electrostatically convey said charged toner along said conveying surface toward one end of the first conveyance board and to cause said charged toner to fly toward said image carrier, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface;

wherein a distance between adjacent electrodes sequentially decreases toward the one end.

17. The device as claimed in claim 16, wherein:

said conveyance board sequentially accelerates the charged toner while conveying said charged toner.

18. The device as claimed in claim 16, wherein said conveyance board further includes:

a coating layer formed on a surface of said member for reducing contact resistance between said surface and the charged toner.

19. The device as claimed in claim 16, wherein:

said member is formed of a material having a specific inductive capacity of 2 or above.

20. The device as claimed in claim 19, wherein:

the material includes $SiO_2$ or $Ta_2O_5$.

21. The device as claimed in claim 16, further comprising:

a second conveyance board having a second conveying surface that faces the conveying surface of said first conveyance board.

22. The device as claimed in claim 16, comprising:

a storing portion for storing the charged toner.

23. A developing device configured to develop a latent image formed on an image carrier with charged toner, the device comprising:

a) a first conveyance board having a conveying surface and configured to electrostatically convey said charged toner along said conveying surface and to cause said charged toner to fly toward said image carrier, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface; and b) at least second and third conveyance boards;

wherein an intermediate conveyance board, from among said first, second and third conveyance boards, has a conveying surface on both sides thereof.

24. A toner feeding device configured to deposit charged toner to an image carrier or a recording medium, the device comprising:

a first conveyance board having a conveying surface and configured to electrostatically convey said charged toner along said conveying surface toward one end of the first conveyance board and to cause said charged toner to fly toward said image carrier or recording medium, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface;

wherein a distance between adjacent electrodes sequentially decreases toward the one end.

25. The device as claimed in claim 24, wherein said conveyance board further includes:

a coating layer formed on a surface of said member for reducing contact resistance between said surface and the charged toner.

26. The device as claimed in claim 24, further comprising:

a second conveyance board including a conveying surface that faces the conveying surface of said first conveyance board.

27. An image forming apparatus configured to deposit charged toner on a recording medium to form a toner image, the apparatus comprising:

means for causing a first conveyance board having a conveying surface to electrostatically convey said charged toner along said conveying surface toward one end of the first conveyance board and to cause said charged toner to fly toward said image carrier or recording medium, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface;

wherein a distance between adjacent electrodes sequentially decreases toward the one end.

28. The apparatus as claimed in claim 27, wherein:

said first conveyance board accelerates the charged toner while conveying said charged toner.

29. The apparatus as claimed in claim 27, further comprising:

a control board facing the conveying surface of said first conveyance board for controlling flight/non-flight of the charged toner from said first conveyance board.

30. The apparatus as claimed in claim 29, wherein:

said control board conveys the charged toner not flown from the one end toward the other end of said first conveyance board.

31. The apparatus as claimed in claim 27, wherein said first conveyance board further includes:

a coating layer formed on a surface of said member for reducing contact resistance between said surface and the charged toner.

32. The apparatus as claimed in claim 27, further comprising:

means for applying to said electrodes, drive waveforms that provide the charged toner with an initial speed high enough for said charged toner to fly from the one end of said first conveyance board.

33. An image forming apparatus configured to deposit charged toner on a recording medium to form a toner image, the apparatus comprising:

means for causing a first conveyance board having a conveying surface to electrostatically convey said charged toner along said conveying surface toward one end of the first conveyance board and to cause said charged toner to fly toward said image carrier or recording medium, said first conveyance board including:

1) a substrate;

2) a plurality of electrodes arranged on said substrate in a direction of toner conveyance, with each electrode extending in a direction perpendicular to said direction of toner conveyance; and 3) a member formed on said substrate over said plurality of electrodes for forming the conveying surface; and means for applying to said electrodes, drive waveforms sequentially increasing in crest value toward one or more of said electrodes adjoining the one end of said conveyance board.

34. A powder jetting device configured to jet charged powder, the device comprising:

means for causing a first conveyance board having a conveying surface to convey and to accelerate said charged powder along said conveying surface, and to jet said charged power from one end of said first conveyance board, said first conveyance board including:

1) a substrate;

2) a plurality of electrodes arranged on said substrate in a direction of powder conveyance, with each electrode extending in a direction perpendicular to said direction of powder conveyance; and 3) a member formed on said substrate over said plurality of electrodes for forming the conveying surface;

wherein a distance between adjacent electrodes sequentially decreases toward the one end.

35. A classifying device configured to classify charged powder, the device comprising:

means for causing a first conveyance board having a conveying surface to electrostatically convey and to accelerate said charged powder along said conveying surface, and to jet said charged powder from one end of said first conveyance board, said first conveyance board including:

1) a substrate;

2) a plurality of electrodes arranged on said substrate in a direction of powder conveyance, with each electrode extending in a direction perpendicular to said direction of powder conveyance; and 3) a member formed on said substrate over said plurality of electrodes for forming the conveying surface;

wherein a distance between adjacent electrodes sequentially decreases toward the one end.

36. In a toner conveying device for electrostatically conveying toner, a conveyance board comprising:

a first board comprising a substrate and a plurality of substantially parallel electrodes arranged at a preselected distance in a direction of toner conveyance, in which the toner is conveyed, and each extending in a direction crossing said direction of toner conveyance; and a second board comprising an insulative substrate and a surface layer formed on a surface of said insulative substrate and having low contact resistance with respect to the toner, said surface layer forming a conveying surface;

wherein said first board and said second board are stacked on each other.

37. The device as claimed in claim 36, wherein said electrodes are arranged at a pitch that is one-half to 100 times as great as a particle size of the toner.

38. The device as claimed in claim 36, wherein said surface layer is formed of a material having a critical surface tension of 30 dyne/cm or below.

39. The device as claimed in claim 38, wherein the material comprises fluorine-containing resin.

40. The device as claimed in claim 36, wherein said conveyance board further comprises either one of a semiconductor film and a conductor film intervening between said electrodes of said first board and said insulative substrate of said second board and isolated from said electrodes by an insulation film.

41. The device as claimed in claim 36, wherein said second board is formed with channels constituting paths each including said conveying surface.

42. The device as claimed in claim 41, wherein part of said channels extends substantially perpendicularly to said electrodes while the other part of said channels extends substantially at an angle of 45° relative to said electrodes.

43. The device as claimed in claim 36, wherein said channels are arranged in a density varying in a direction substantially perpendicular to the direction of toner conveyance.

44. The device as claimed in claim 36, wherein surfaces of said electrodes and said conveying surface are spaced from each other by a gap lying in a range of from 0.5 $\mu$m to 10 $\mu$m.

45. The device as claimed in claim 36, wherein at least two conveyance boards are provided.

46. The device as claimed in claim 43, wherein:

said at least two conveyance boards have respective conveying surfaces facing each other.

47. In a developing device for depositing toner on a latent image formed on an image carrier to thereby develop said latent image and including a toner conveying device for electrostatically conveying said toner, said toner conveying device comprising a conveyance board comprising:

a first board comprising a substrate and a plurality of substantially parallel electrodes arranged at a preselected distance in a direction of toner conveyance, in which the toner is conveyed, and each extending in a direction crossing said direction of toner conveyance; and a second board comprising an insulative substrate and a surface layer formed on a surface of said insulative substrate and having low contact resistance with respect to the toner, said surface layer forming a conveying surface;

wherein said first board and said second board are stacked on each other.

48. The device as claimed in claim 47, wherein a distance between nearby ones of said electrodes sequentially decreases toward a downstream side in the direction of toner conveyance.

49. The device as claimed in claim 48, further comprising:

a storing portion for storing the toner at a toner inlet side of said conveyance board.

50. In an image forming apparatus comprising a developing device for depositing toner on a latent image formed on an image carrier to thereby develop said latent image, said developing device comprising a toner conveying device for electrostatically conveying said toner, said toner conveying device comprising:

a first board comprising a substrate and a plurality of substantially parallel electrodes arranged at a preselected distance in a direction of toner conveyance, in which the toner is conveyed, and each extending in a direction crossing said direction of toner conveyance; and a second board comprising an insulative substrate and a surface layer formed on a surface of said insulative substrate and having low contact resistance with respect to the toner, said surface layer forming a conveying surface;

wherein said first board and said second board are stacked on each other.

51. The apparatus as claimed in claim 50, wherein said toner conveying device further comprises means for applying to downstream ones of said electrodes in the direction of toner conveyance drive voltages higher in frequency than drive voltages applied to upstream ones of said electrodes.

52. In an image forming apparatus for depositing toner on a latent image formed on an image carrier to thereby develop said latent image and comprising a toner conveying device for electrostatically conveying said toner, said toner conveying device comprising:

a first board comprising a substrate and a plurality of substantially parallel electrodes arranged at a preselected distance in a direction of toner conveyance, in which the toner is conveyed, and each extending in a direction crossing said direction of toner conveyance; and a second board comprising an insulative substrate and a surface layer formed on a surface of said insulative substrate and having low contact resistance with respect to the toner, said surface layer forming a conveying surface;

wherein said first board and said second board are stacked on each other.

53. The apparatus as claimed in claim 52, wherein a distance between nearby ones of said electrodes sequentially decreases toward a downstream side in the direction of toner conveyance.

54. The apparatus as claimed in claim 53, wherein said toner conveying device further comprises means for applying to downstream ones of said electrodes in the direction of toner conveyance drive voltages higher in frequency than drive voltages applied to upstream ones of said electrodes.

55. The apparatus as claimed in claim 52, wherein said toner conveying device further comprises a control board facing the conveying surface of said conveyance board for controlling flight/non-flight of the charged toner from said conveyance board.

56. In a toner feeding device for electrostatically conveying toner to developing means with a toner conveying device, said toner conveying device comprising:

a first board comprising a substrate and a plurality of substantially parallel electrodes arranged at a preselected distance in a direction of toner conveyance, in which the toner is conveyed, and each extending in a direction crossing said direction of toner conveyance; and a second board comprising an insulative substrate and a surface layer formed on a surface of said insulative substrate and having low contact resistance with respect to the toner, said surface layer forming a conveying surface;

wherein said first board and said second board are stacked on each other.

57. The device as claimed in claim 56, wherein a distance between nearby ones of said electrodes sequentially decreases toward a downstream side in the direction of toner conveyance.

58. The apparatus as claimed in claim 56, wherein said toner feeding device further comprises means for applying to downstream ones of said electrodes in the direction of toner conveyance drive voltages higher in frequency than drive voltages applied to upstream ones of said electrodes.

59. An image forming apparatus comprising:

an image carrier for forming a latent image thereon; and developing means for developing the latent image with charged toner to thereby form a corresponding toner image;

wherein said developing means electrostatically conveys the charged toner toward one end of a first conveyance board along a conveying surface of said first conveyance board and causes said charged toner to fly toward said image carrier from said one end, said developing means further comprises a second conveyance board whose conveying surface faces the conveying surface of said first conveyance board, and the surfaces conveying toner in a direction of toner conveyance face each other.

* * * * *